US007833027B2

(12) United States Patent
Jong

(10) Patent No.: US 7,833,027 B2
(45) Date of Patent: Nov. 16, 2010

(54) ELECTRICAL POWER DISTRIBUTION APPARATUS WITH SWITCH

(75) Inventor: Choon Jong, Singapore (SG)

(73) Assignee: Nutek Private Limited, Singapore (SG)

( * ) Notice: Subject to any disclaimer, the term of this patent is extended or adjusted under 35 U.S.C. 154(b) by 0 days.

(21) Appl. No.: 12/367,949

(22) Filed: Feb. 9, 2009

(65) Prior Publication Data

US 2009/0149076 A1 Jun. 11, 2009

Related U.S. Application Data

(62) Division of application No. 10/568,624, filed as application No. PCT/SG2004/000023 on Jan. 21, 2004, now Pat. No. 7,544,071.

(30) Foreign Application Priority Data

Aug. 21, 2003 (SG) ..... 200304490-6

(51) Int. Cl.
*H01R 25/00* (2006.01)

(52) U.S. Cl. ..... 439/118; 200/51.09

(58) Field of Classification Search ..... 439/122, 439/113, 114, 118, 119, 120, 188; 200/51.02, 200/50.09

See application file for complete search history.

(56) References Cited

U.S. PATENT DOCUMENTS

| | | | | |
|---|---|---|---|---|
| 1,272,163 | A * | 7/1918 | Wiedey | 200/51.17 |
| 2,654,074 | A | 9/1953 | Lancelot | |
| 2,706,225 | A * | 4/1955 | Freeman | 200/51.02 |
| 3,704,437 | A | 11/1972 | Hhesse | |
| 3,753,209 | A | 8/1973 | Hhesse | |
| 3,757,273 | A * | 9/1973 | Hesse | 439/117 |
| 3,951,488 | A | 4/1976 | Hesse et al. | |
| 4,139,252 | A | 2/1979 | Gorny | |
| 4,218,108 | A * | 8/1980 | El Mouchi | 200/51 R |
| 4,243,284 | A | 1/1981 | Humphreys | |
| 4,479,687 | A | 10/1984 | Humphreys et al. | |
| 4,494,808 | A * | 1/1985 | Widell et al. | 439/119 |

(Continued)

FOREIGN PATENT DOCUMENTS

DE 3245384 7/1983

(Continued)

OTHER PUBLICATIONS

English language Abstract of JP 52-118297.

(Continued)

*Primary Examiner*—Neil Abrams
(74) *Attorney, Agent, or Firm*—Greenblum & Bernstein P.L.C.

(57) ABSTRACT

In one embodiment, an electrical power distribution apparatus is disclosed which includes a track made up of a plurality of track sections connected together by/to joints and end sections. The track sections are each provided with a slot with which a power point connector may be engaged at any point by inserting a contact member of the connector through the slot at a chosen point and then rotating the connector by 90 degrees to bring the contact member into engagement with electrical conductors, of the track. The apparatus may comprise a further conduit containing conductors used to distribute communication signals. Also included are a switch operable in response to rotation of the connector and a sound producer to indicate when the switch has reached one of its end positions.

13 Claims, 57 Drawing Sheets

U.S. PATENT DOCUMENTS

| | | | |
|---|---|---|---|
| 4,720,768 | A | 1/1988 | Schindele |
| 5,067,910 | A | 11/1991 | Knox et al. |
| 5,120,246 | A | 6/1992 | Knox |
| 5,167,516 | A | 12/1992 | Tan et al. |
| 5,418,328 | A | 5/1995 | Nadeau |
| 5,447,441 | A | 9/1995 | Mueller et al. |
| 5,688,132 | A | 11/1997 | Rogers et al. |
| 5,759,051 | A | 6/1998 | Cancellieri et al. |
| 6,106,341 | A | 8/2000 | Leach, III |
| 6,496,377 | B1 | 12/2002 | Happ et al. |
| 7,128,585 | B2 | 10/2006 | Evilsizer |
| 2003/0224636 | A1 | 12/2003 | Lorenzen et al. |
| 2005/0215093 | A1 | 9/2005 | Jong |

FOREIGN PATENT DOCUMENTS

| | | |
|---|---|---|
| EP | 0465099 | 1/1992 |
| JP | 52-118297 | 10/1977 |
| JP | 63-501180 | 4/1988 |
| RU | 2036503 | 5/1995 |
| RU | 95 113556 | 6/1997 |
| RU | 2089985 | 9/1997 |
| RU | 2116689 | 7/1998 |
| TW | 257397 | 9/1995 |
| TW | 360602 | 6/1999 |
| TW | 434956 | 5/2001 |
| TW | 438126 | 5/2001 |
| WO | 87/01524 | 3/1987 |
| WO | 93/19506 | 9/1993 |
| WO | 03/096489 | 11/2003 |

OTHER PUBLICATIONS

English language Abstract of DE 3245384.
English language Abstract of RU 95 113556.
English language Abstract of TW 43495, May 16, 2001.

* cited by examiner

ON POSITION

ELECTRICAL POWER DISTRIBUTION APPARATUS WITH SWITCH

CROSS-REFERENCE TO RELATED APPLICATION

This application is a division of U.S. patent application Ser. No. 10/568,624, which was filed on Jul. 16, 2006, which is a National Stage Application of International Application No. PCT/SG2004/000023, filed Jan. 21, 2004, which claims priority under 35 U.S.C. §119 of Singapore Application No. SG200304490-6, filed Aug. 21, 2003 the entire subject matter of which is incorporated by reference in their entireties.

BACKGROUND AND FIELD OF THE INVENTION

This invention relates to an improvement for electrical power distribution apparatus more particularly to an apparatus enabling an electrical power supply to be provided to an electrical power point.

The conventional system of electrical power distribution in domestic and commercial environments is provided by power points which are installed in a wall cavity or a surface mounted power outlet at predetermined places. The location of such power points needs to be chosen in advance and often subsequent requirements can mean that the power points are provided in the wrong location and/or in insufficient numbers.

In a co-pending PCT application no. PCT/SG03/00100, there is disclosed a flexible electrical power distribution apparatus and it is an object of the present invention to provide improvements for a more flexible electrical power distribution apparatus.

SUMMARY OF THE INVENTION

According to the invention in a first aspect, there is provided electrical power supply distribution apparatus comprising a conduit including at least one elongate conductor, the conduit having an opening through which a connector is able to be inserted to connect electrically with the conductor; a plurality of conductive members disposed between the opening and the conductor, each conductive member being separately supported and resiliently displaceable by a said connector to provide access to the conductor.

With the conductive member separately supported, this allows each conductive member to be individually displaced by a connector. This provides a modular conductive member which allows easier assembly and replacement.

Preferably, the apparatus further comprises a plurality of resilient support members so that each conductive member being separately supported by a resilient support member.

Preferably, the conductive member forms an earth connector and is resiliently biased by the support member towards and/or occludes and/or seals the opening and the apparatus may further comprise a displaceable flap for the opening, the conductive member underlying the flap.

Preferably, the plurality of conductive elements are spaced apart from each other. The conductive member may have a sheet-like surface and a side portion which engages the support member. The conductive member may further comprise two opposed side portions and the or each portion is of winged form.

Preferably, each support member has side sections corresponding to the winged portions of the conductive member.

The support member may further comprise a support portion for supporting a said conductive member and a base connected to the support portion, whereby the support portion is resiliently displaceable towards the base. Preferably, the support member has one or two resilient portions extending towards the base.

Either one or both resilient portions may have a central void and a depression facing the base. The base may have an abutment surface arranged to engage the depression. The abutment surface thus biases the resilient portions away from the base. Preferably, the resilient portion is oval-shaped. The resilient portions provide a further "spring effect" within the support member.

The support member may be formed from plastic material and may comprise means to align the support member with a like support member. In the described embodiment, the alignment means is in the form of a lug and a corresponding slot for receiving a said lug of a like support member.

The support member may also include means for connecting to the conductive member. Preferably, the connection means is in the form of a catch. Alternatively or additionally, the conductive member may include means for connecting to the support member. Preferably, the connection means is in the form of a clip.

Preferably, the apparatus comprises an elongate tray for receiving the plurality of support members. The tray may be formed from conductive material so that the tray can be electrically connected to each conductive element.

Preferably, the tray comprises a plurality of spaced arched strips, each strip being arranged to locate within a slot of a said support member.

According to the invention in a second aspect, there is provided an electrical connector comprising first and second electrical contacts arranged to engage corresponding conductors of an electrical power supply distribution apparatus to provide a power inlet, the contacts being disposed at opposed ends of an arm rotatable between a first position in which the contacts are arranged to disengage from the conductors and a second position in which the contacts are arranged to engage with the conductors, a connection member arranged to provide a power outlet; and a switching device operable to connect or disconnect one of the contacts to the connection member in response to the rotation of the arm.

Thus, having the switching device to control the connection between the connection member and one of the contacts, "arching" between the contacts and the corresponding conductors (when the contacts engage the corresponding conductors) will be transferred to the switch.

Preferably, the electrical connector further comprises an actuating member rotatable in response to the rotation of the arm for actuating the switching device to connect or disconnect said contact to the connection member. The actuating member may be arranged to actuate the switching device to connect said contact to the connection member after the arm is rotated to the second position. Further, the actuating member may be arranged to actuate the switching device to disconnect said contact from the connection member before the arm is rotated to the first position.

Preferably, the switching device comprises a lever movable between a first position in which the lever is arranged to electrically disconnect the contact from the connection member, and a second position in which the lever is arranged to electrically connect the contact to the connection member. Typically, the switching device further comprises means for moving the lever between the two positions, the moving means being actuated by the actuating member. The moving means may include a plunger and a rocker arm connected to the plunger, the plunger being coupled to the lever and arranged to urge the lever between the two positions in response to the movement of the rocker arm, the rocker arm being arranged to be actuated by the actuating member.

The electrical connector may further comprise means for producing a sound when the arm is in the first position or when the arm is in the second position.

Preferably, the connection member is in the form of a female member arranged to receive a male member of an electrical plug. Alternatively, the connection member is arranged to be connected to an electrical wire.

Typically, the contacts are disposed on two separate arms.

According to the invention in a third aspect, there is provided an electrical connector comprising first and second electrical contacts arranged to engage corresponding conductors of an electrical power supply distribution apparatus to provide a power inlet, the contacts being disposed at opposed ends of an arm rotatable between a first position in which the contacts are arranged to disengage from the conductors and a second position in which the contacts are arranged to engage with the conductors, a connection member arranged to provide a power outlet; and a switching device operable to connect one of the contacts to the connection member after the contact has engaged the corresponding conductors of the power distribution apparatus.

According to the invention in a fourth aspect, there is provided an electrical connector comprising first and second electrical contacts arranged to engage corresponding conductors of an electrical power supply distribution apparatus to provide a power inlet; a connection member arranged to provide a power outlet; and a switching device operable to connect one of the contacts to the connection member after the contact has engaged the corresponding conductors of the power distribution apparatus.

BRIEF DESCRIPTION OF THE DRAWINGS

Embodiments of the invention will now be described by way of example with reference to the accompanying drawings in which.

DETAILED DESCRIPTION OF THE PREFERRED EMBODIMENTS

Figure 1:
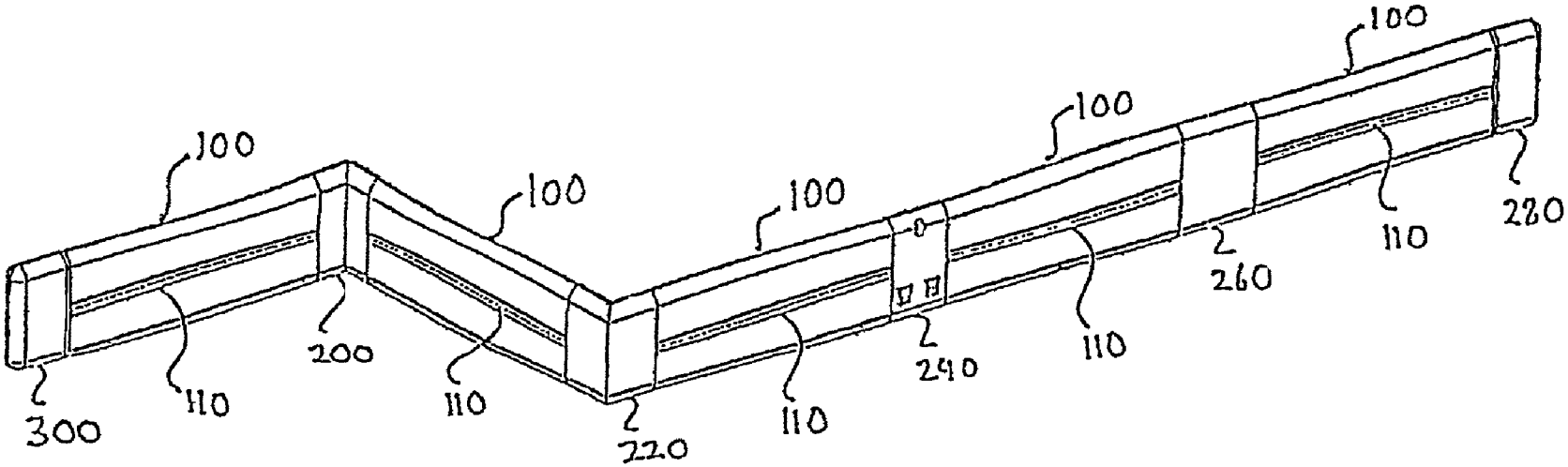
FIG. 1 is a three dimensional view of a track of a first embodiment of power supply apparatus of the invention.
Figure 2:
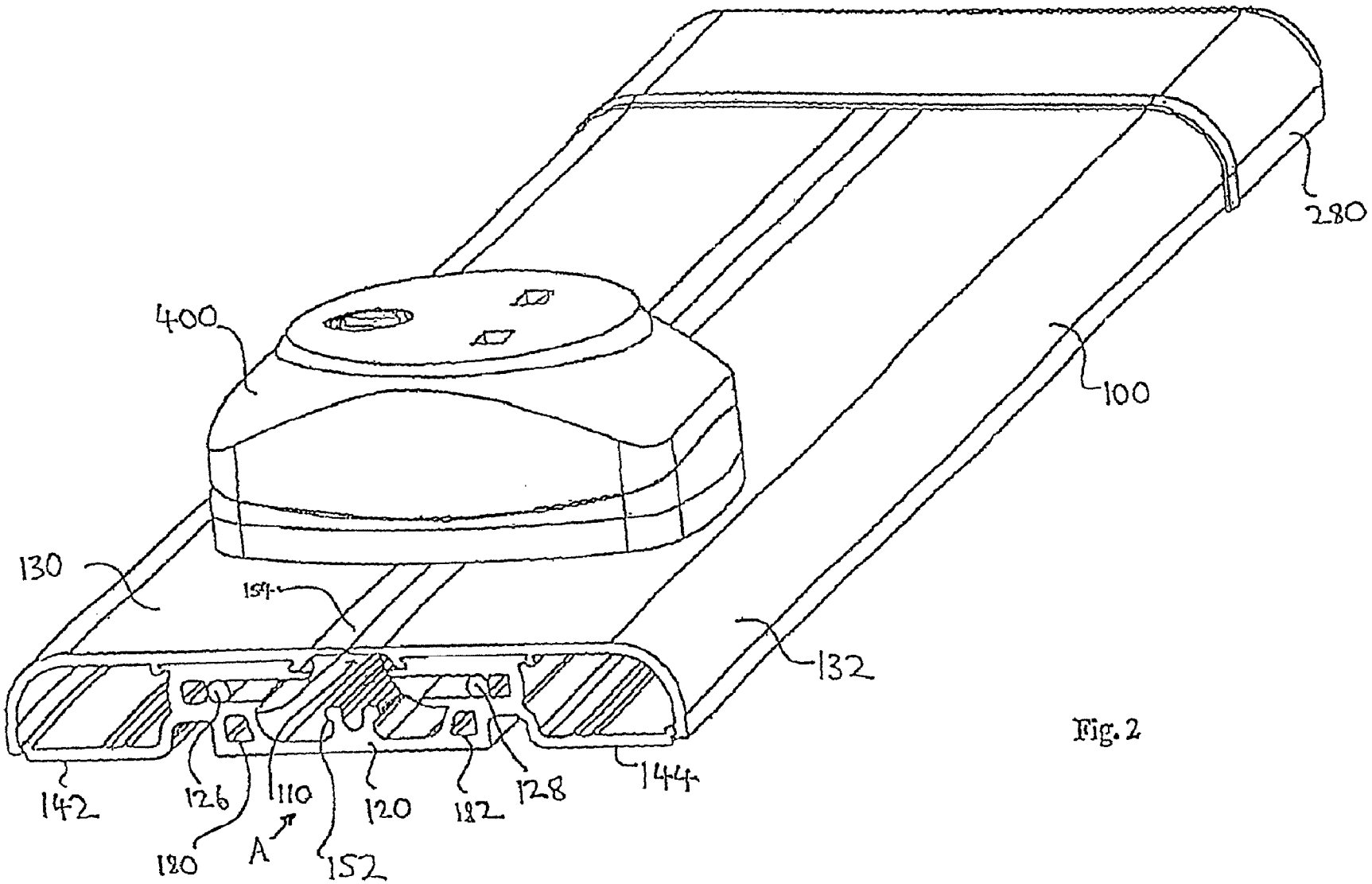
FIG. 2 is an enlarged view of a track section of the embodiment of FIG. 1 showing a power point connector connected to the track section.

With reference to FIGS. 1 and 2, general views of the elements of an embodiment of the apparatus of the invention are shown. The apparatus provides a means for selecting a position in which power points may be placed thus allowing flexibility in position and/or number of power points which may be provided. A track is shown in FIG. 1 and comprises a plurality of identical track sections 100, each having a slot 110, connected together by means of joints 200-260 and end connectors 280, 300. Within the connectors 200-300 are provided power supply/connection units described hereafter which connect the track as a whole to the electrical mains supply and provide electrical continuity between track sections 100. Joint 240 also provides an interface to data and/or communication cables which run through the track as will be described below. At any point along slots 110, one or more power point connector(s) 400 may be engaged with a track section 100 to provide a supply connection between the power supply connected to the track and a device to be plugged into the or each connector 400.

With reference to FIGS. 2-6 a track section 100 is shown in more detail and comprises a conduit formed from an elongate extruded plastics base 120 which includes cavities 122, 124 each for receiving an elongate cylindrical conductor 126, 128, each cavity 122, 124 being provided with arcuate portions for engaging the sides of each conductor 126, 128 in a snap-fit arrangement. First and second cover members 130, 132 which clip to base member 120 via formations 134, 135, 136, 138, 139, 140 are also provided. The cover members 130, 132 together with portions 142, 144 of the base member 120 form elongate enclosures 146, 148 which provide cable runs. The cavities 122, 124 together meet in a central cavity 150 which has an opening forming the elongate slot 110. The cover members 130, 132 are provided with elongate deformable plastic flaps 154 which provide a cover for the slot 110.

Figure 6:
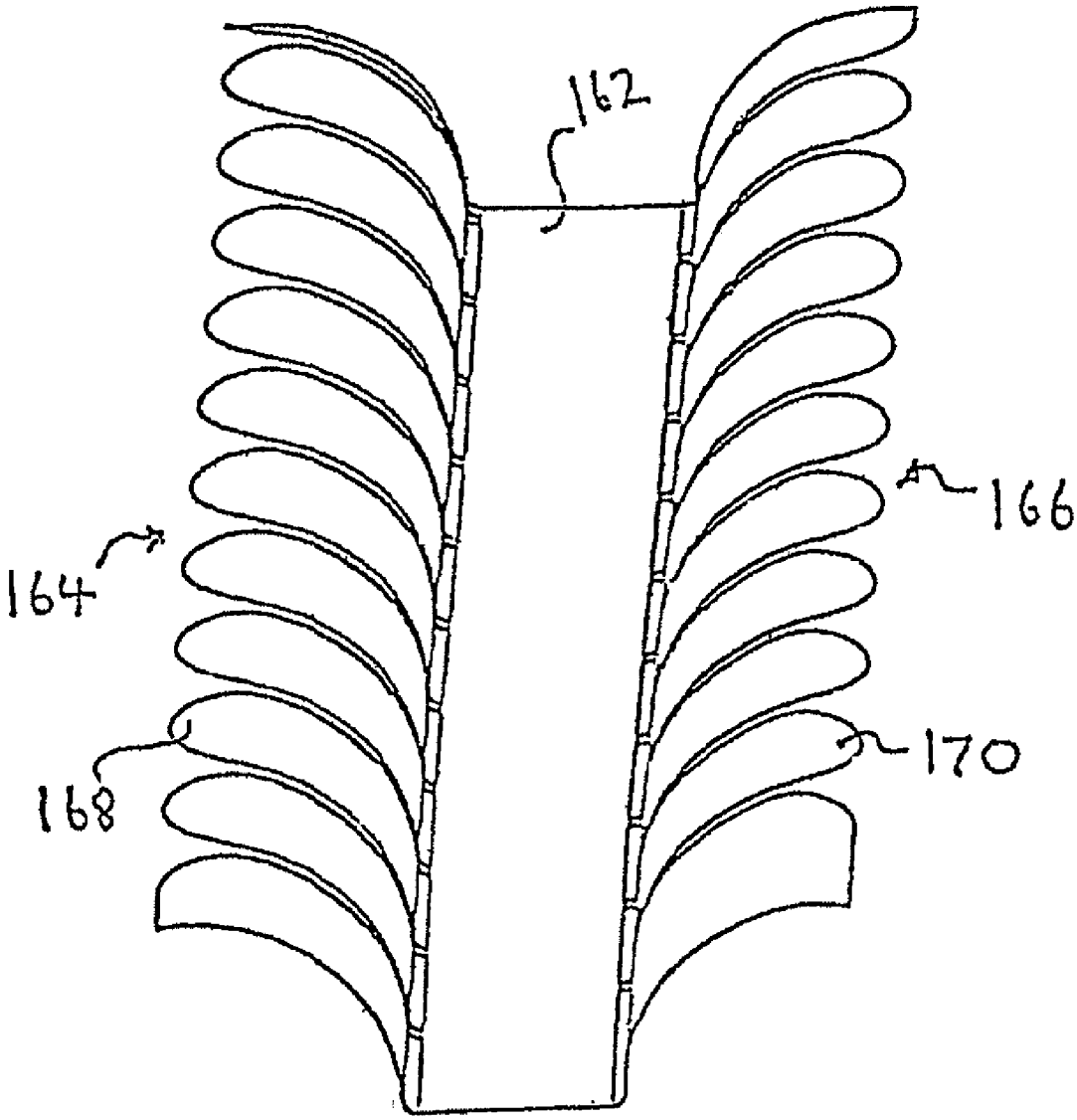
FIG. 6 is an underneath view of the earth spring of FIG. 5.

An earth spring 160 formed from flexible, resilient conductive material is provided in the cavity 150. The earth spring 160 is connectable to earth and has a flat, elongate, sheet-like central portion 162 with wings 164, 166 projecting arcuately away from the portion 162. Each wing 164, 166 is divided into a plurality of wing members 168, 170 individually attached to the portion 162 as shown in FIG. 6. The wings 164, 166 rest in elongate slots 172, 174 which hold the ends of the wings in position. The surface 162 projects outwardly to cover slot 110 just below flaps 154. The cavities 122, 124 further have projecting edges 176, 178 which engage the sides of wings 164, 166 and provide further support for the earth spring 160. The earth spring 160 is locally resiliently displaceable from the position shown in FIG. 2 to a position in which the central portion 162 is depressed downwardly to, in the limit, abut against a projection 152 of the base 120. In this position, the ends of the wings 164, 166 remain in the elongate slots 172, 174. The earth spring 160 in this position allows access to the electrical conductors 126, 128 by the power point connector 400.

Each portion 142, 144 is provided with a plurality of openings 143 to allow fixing of the track section 100 to a supporting surface. The base further includes elongate channels 180, 182 for receiving connector lugs as will be described hereinafter.

The base 120 and covers 130, 132 are formed from extruded plastic materials, for example PVC or PP (Polypropylene). The flaps 154 are co-extruded with the covers 130, 132 and are formed from the same material but of lower hardness. The cylindrical conductors 126, 128 are preferably formed from copper with the earth spring 160 being formed from a conductive spring material, preferably an alloy such as beryllium copper or phosphorous bronze.

Figure 7:
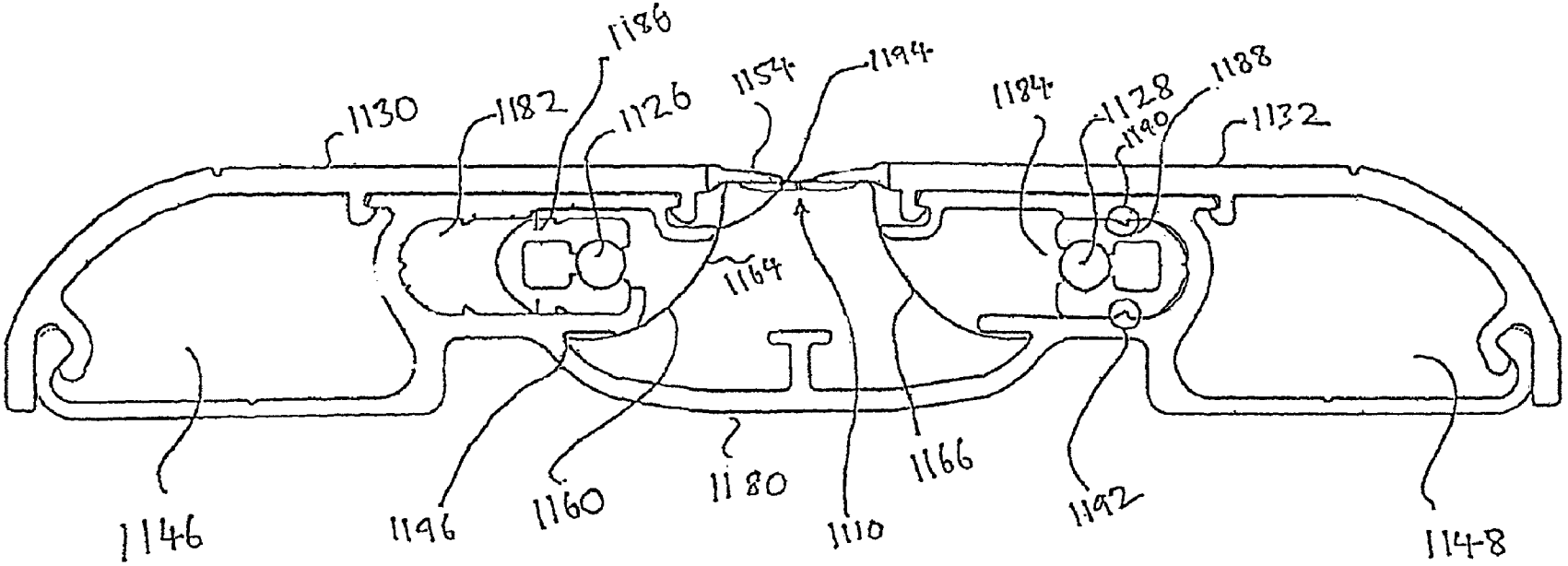
FIG. 7 is a cross-sectional view of a track section similar to that shown in FIG. 3 and which forms a second embodiment of the invention.

A second embodiment of track section 100 is shown in FIG. 7. This is generally similar to that described with reference to FIGS. 1-6 and similar parts have similar reference numerals with the addition of 1000. The essential difference between this embodiment and that of the previous figures concerns the base member 1180 which instead of being extruded from plastics material is extruded from metal, preferably aluminium. Each conductor 1126, 1128 is disposed in a cavity 1182, 1184 slightly differently shaped compared to the first embodiment via an elongate insulating member 1186, 1188. The insulating members 1186, 1188 are extruded from PVC or PP and are a snap-fit in the cavities 1182, 1184, held in place by co-operating formations ringed at 1190 and 1192. Insulating member 1188 is shown snapped in place in cavity 1184 with member 1186 removed from the cavity 1182. The insulating members 1186, 1188 have opposed jaws which hold the conductors 1126, 1128 in place. In use, the metal extrusion forming the base 1180 and the cavities 1192, 1194 provides an EMI shield between the conductors 1126, 1128 and the data and telecommunications cable runs 1146 and 1148. The EMI shield is further enhanced by the wings 1164, 1166 of the earth spring 1160 which contact the metal base member 1180 at points 1194, 1196 to form a conductive loop around the conductor. The base member 1180 is preferably connected to earth as well as or instead of the earth spring 1160, so that the combination of earth spring and base provides earth protection.

Figure 7A:
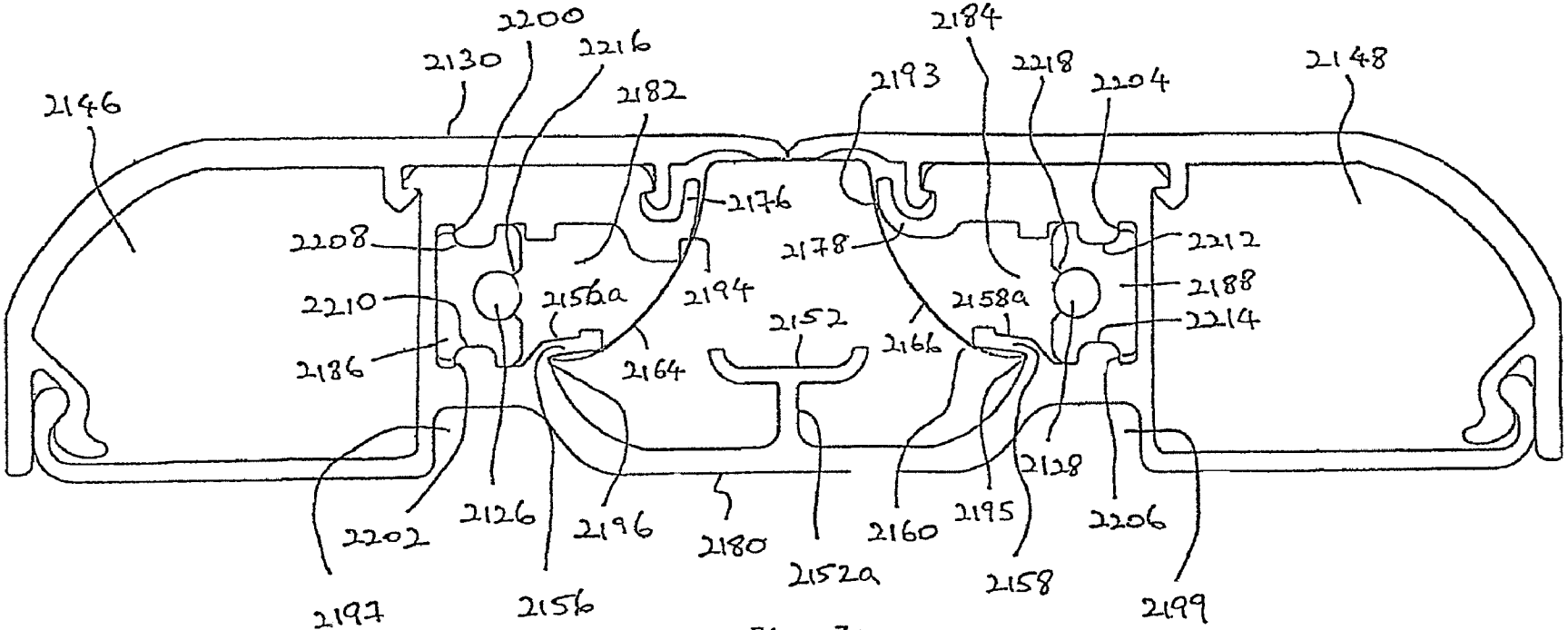
FIG. 7*a* is a cross-sectional view of a variation of the second embodiment of the track section shown in FIG. 7 and which forms a third embodiment of the invention.

A third, preferred embodiment of the track section 100 is shown in FIG. 7*a*. This is generally similar to the second embodiment and similar parts have similar reference numerals with the addition of a further 1000. The main difference between the second and third embodiments is the structure of the base member 2180 which is also extruded preferably from aluminium. Each conductor 2126,2128 is disposed in a cavity 2182,2184 slightly differently shaped compared to the second embodiment via an elongate insulating member 2186,2188 which is also in a different form. The insulating members 2186,2188 are typically made of the same material as the insulating members 1186,1188 of the second embodiment and are a friction-fit in the cavities 2182,2184, held in place by opposing lugs 2200, 2202, 2204,2206 engaging respective co-operating grooves 2208,2210,2212,2214 in the insulating members 2186,2188. Each insulating member 2186,2188 includes an elongate part cylindrical channel 2216,2218 extending along the length direction of the insulating member 2186,2188 so that the conductors 2126, 2128 are a sliding fit therein. The projecting edges 2176,2178 are shaped differently from the previous embodiments and in this embodiment, the edges 2176,2178 curved upwards towards the cover 2130 to engage the arcuate wings 2164,2166 of the earth spring 2160. The T-shaped projection 2152 extending from the base is also differently shaped at the ends. In use, the metal extrusion forming the base 2180 and the cavities 2182,2184 provides an EMI shield between the conductors 2126,2128 and the data and telecommunications cable runs 2146,2148 similar to the second embodiment. The enhancement effect is also provided by conductive loops formed by the wings 2164, 2166 of the earth spring 2160 and respective contact points 2193,2194,2195,2196.

In a further variation, a plastic extrusion provided with a metal conductive film may be used for the second and third embodiments of the apparatus of the invention instead of a metal extrusion. In a further alternative, a plastic extrusion of a first embodiment may be used with a conductive paint or film covering the internal surfaces of the or each cable run 146, 148.

Figure 8:
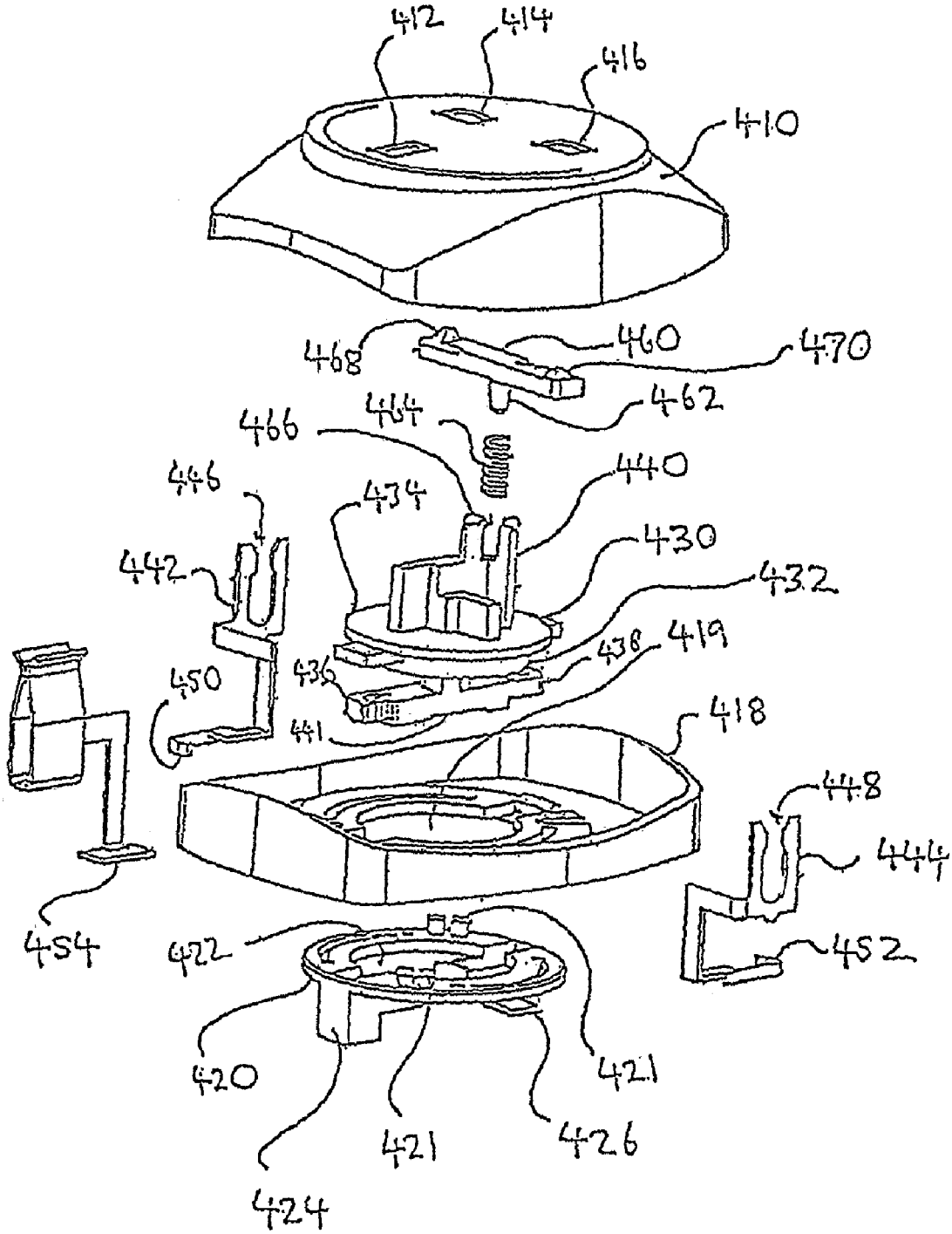
FIG. 8 is an exploded perspective view of the power point connector shown in FIG. 2.

The power point connector 400 shown in FIG. 2 will now be described with more details with reference to FIGS. 8, 9*a* and 9*b*. The connector includes a cover 410 with openings 412, 414, 416 of a standard UK type three pin plug arrangement, although this, and the supporting mechanism, could be changed to any suitable plug/socket system. The cover 410 and a base 418 together form a housing. The base 418 has a generally circular opening 419 formed therein. A flange member 420 rests in the opening 419 held axially in place against the rim of the opening 419 by snap-fit catch 421 but rotatable relative to the rim. The flange member 420 has itself a circular opening 422 and is provided with radially inwardly extending contact protection members 424, 426 best shown in FIG. 9.

Figure 3:
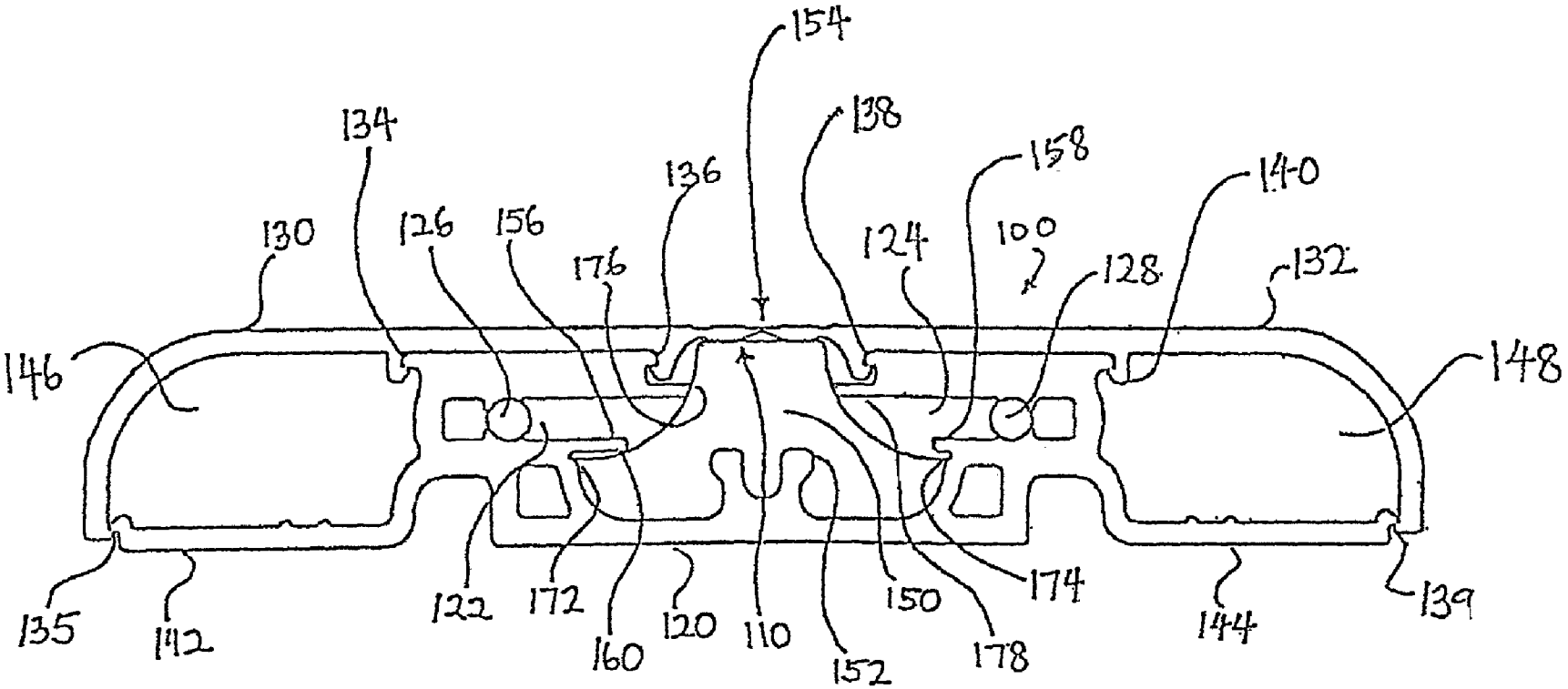
FIG. 3 is a view of the track section in direction of the arrow A of FIG. 2.
Figure 4:
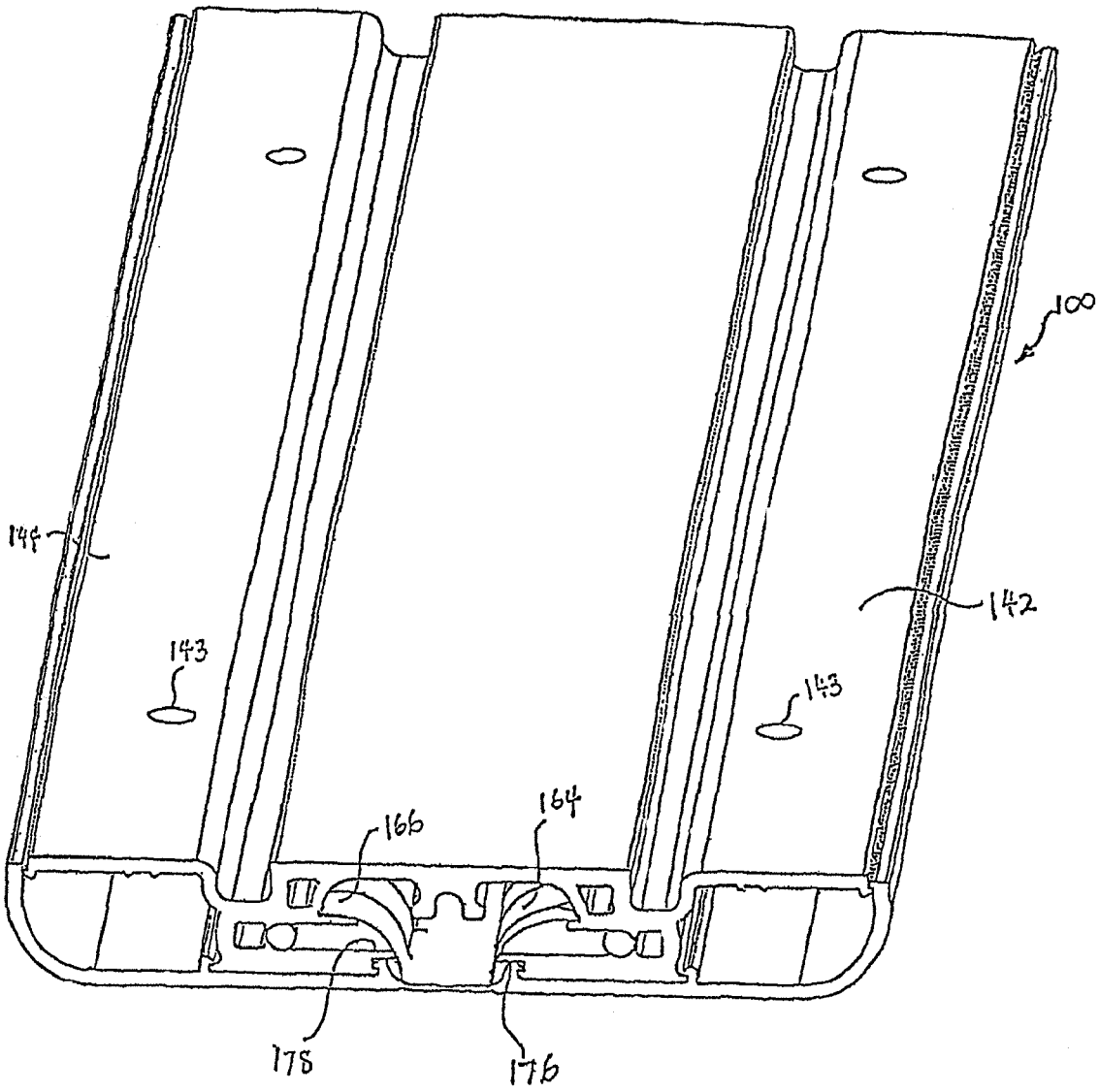
FIG. 4 is an underneath three-dimensional view of the track section of FIG. 2.

An electrical contact mounting member 430 is snapped on in opening 422. The member 430 has a cylindrical bearing portion 432 connected to a larger cylindrical flange 434. The bearing portion 432 rests in opening 422 with the flange 434 being supported by the edge of the opening. Connected to the bearing portion 432 is a contact arm 441 which is provided with contact holders 436, 438 at each end. The contact arm 441 is further provided with a raised section 435 extending only part of the length of the arm, offset relative to the axis of rotation of the arm. As shown in FIG. 3, in the second embodiment, the cavities 122, 124 are each provided with an inwardly projecting surface 156, 158 of a different length. The surfaces 156, 158 and projection 435 co-operate to allow only rotation of the arm 441 in one direction and not the other to ensure that a desired polarity of connection between the contact arm 441 and the conductors 126, 128 is maintained.

In the third embodiment of FIG. 7*a*, the rotation of the arm 441 is limited to one direction by the uniquely shaped projecting edges 2176,2178 which are at different heights relative to the base 2180. The thickness of the contact arm 441 would also be adapted such that one end is thicker than the other (not shown) so that the contact arm 441 can only rotate in one direction and prevented from rotating in another direction by the lower edge 2176.

Each electrical contact holder 436, 438 is of a hook form, the tail of the hook being connected to the remainder of the arm 441 and the head being spaced from but resiliently displaceable towards the remainder of the arm. The length of the arm is such that when contact is made with the conductors 126, 128 there is a slide interference fit, so that the contact portions 436, 438 deform to give a pressing electrical contact.

The flange 434 provides a platform for a contact engaging formation 440 which holds live and neutral contacts 442, 444 in place. Each contact 442, 444 includes a pair of opposed arms 446, 448 which are arranged to receive a pin of a mains plug in sliding engagement when inserted through respective openings 414, 416. Arms 446 are connected via a series of angular elements to contacts 450, 452 which engage around the outside of the contacts supporting portions 436, 438 as is best illustrated in FIG. 9*b*.

Earth connection 454 protrudes out of flange 434 and freely makes electrical contact with earth spring 160 once the power point connector 400 is pushed through slot 154. In the embodiment of FIG. 7, the earth spring provides a bridge between the earth connection 454 and the aluminium base member 1180 which provides a further earth shield.

A shutter member 460 for closing off socket openings 414, 416 is provided. The shutter member 460 occludes the sockets 414, 416, overlying the arms 446, 448 of the electrical contacts 442, 444. The shutter member 460 has a spindle 462 which is received within a spring 464 which is in turn mounted between four orthogonal posts 466 of the mounting formation 440. The shutter member 460 has slanting engagement surfaces 468, 470 which when a mains plug is inserted through sockets 414, 416 will cause shutter member 470 to rotate and be depressed away from the path of movement of the plug pins allowing the plug pins to engage with arms 446, 448 to make an electrical connection.

Figure 9A:
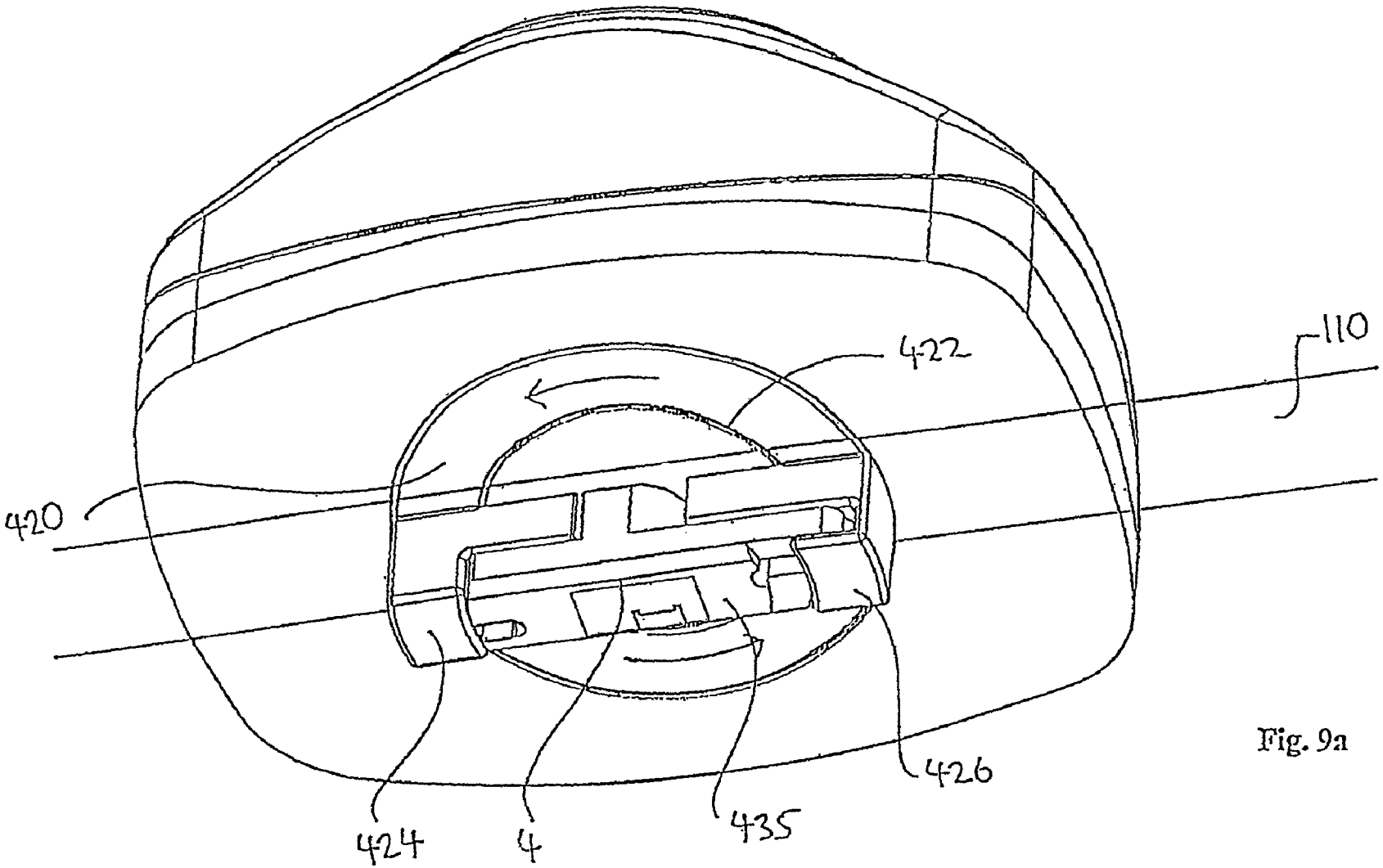
FIG. 9*a* is an assembled view of the connector of FIG. 8 in the first position in which connector is inserted into the slot in the track section and FIG. 9*b* being a similar view of the connector in a second position where the connector engages electrical conductors and earth spring of the track section which are also shown.
Figure 9B:
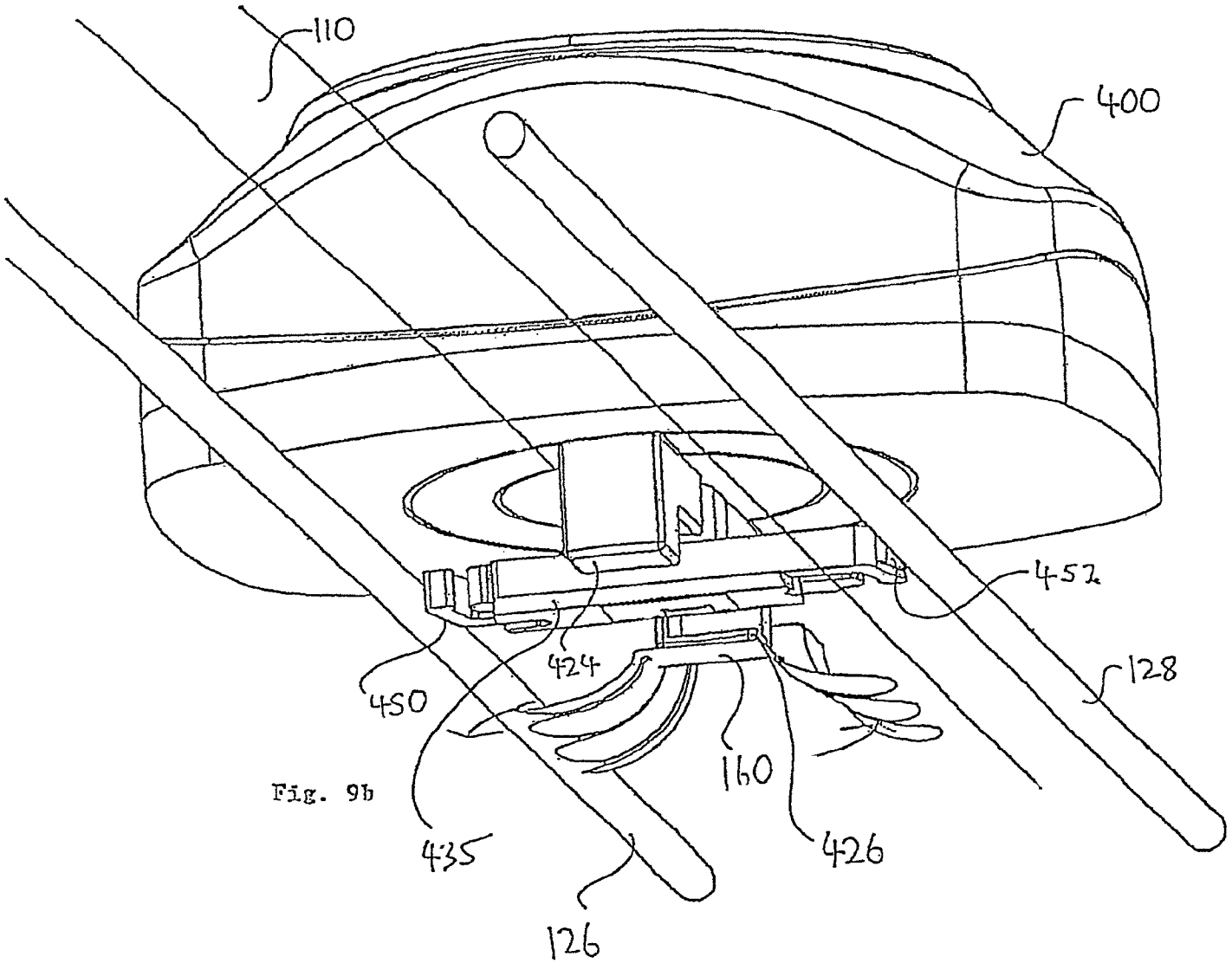

When assembled, the arm 441 projects through opening 422 and is rotatable between the position shown in FIG. 9*a* in which the contacts 450, 452 are covered by protection members 424, 426, and it is in this position that the connector 400 is inserted through slot 152 of track section 100, and the position shown in FIG. 9*b* after 90 degree clockwise rotation in which the contact member is at right angles to the protection members 424, 426. It is in this position that the contacts 450, 452 engage with the conductors 126, 128, with the protection members 424, 426 remaining in the slot 110 and locally depressing the earth spring 160.

Figure 10:
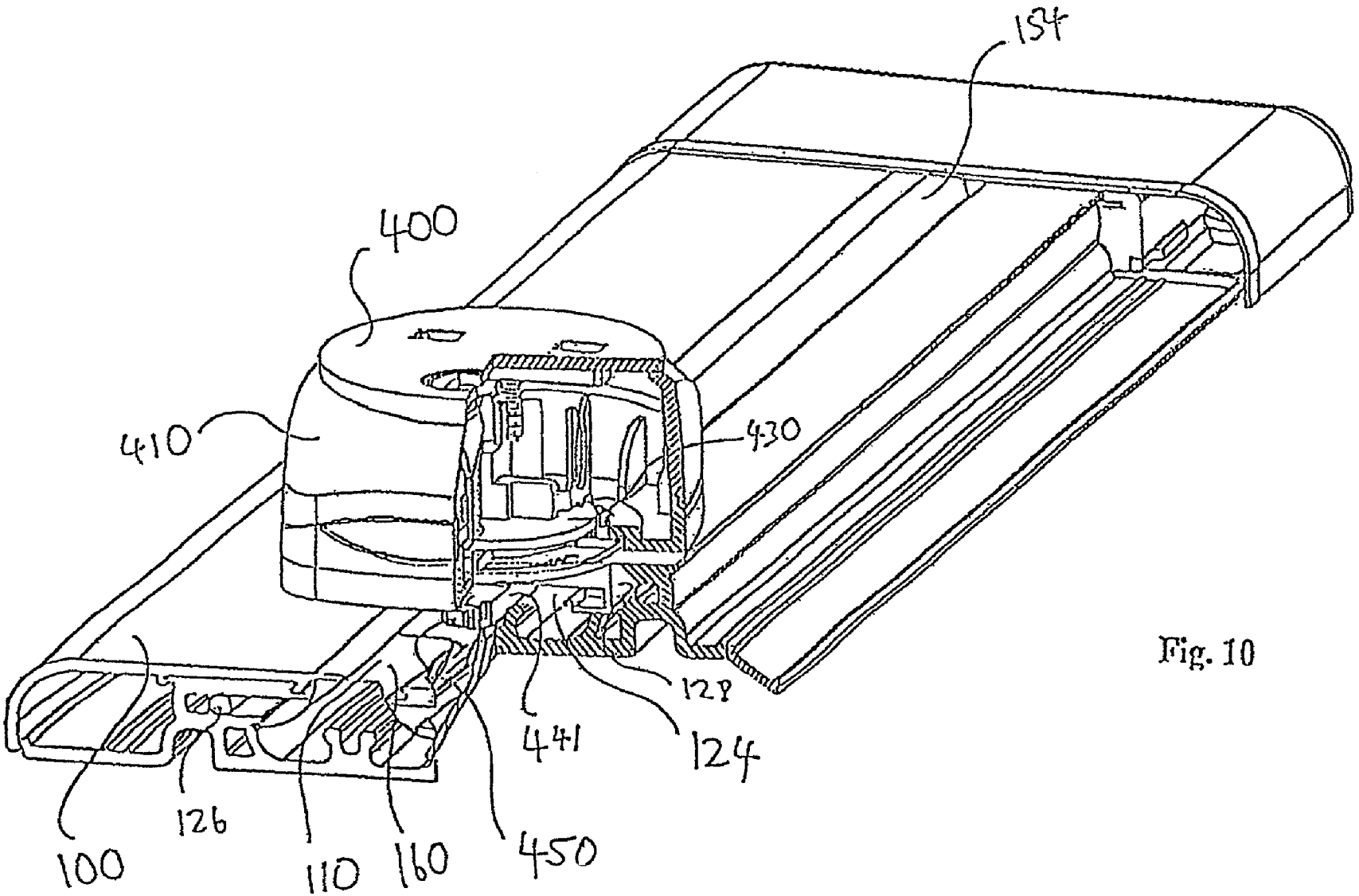
FIG. 10 is a part-section perspective view of the track section and power point connector of FIG. 9*a*, with the connector having been inserted into the track section.
Figure 11:
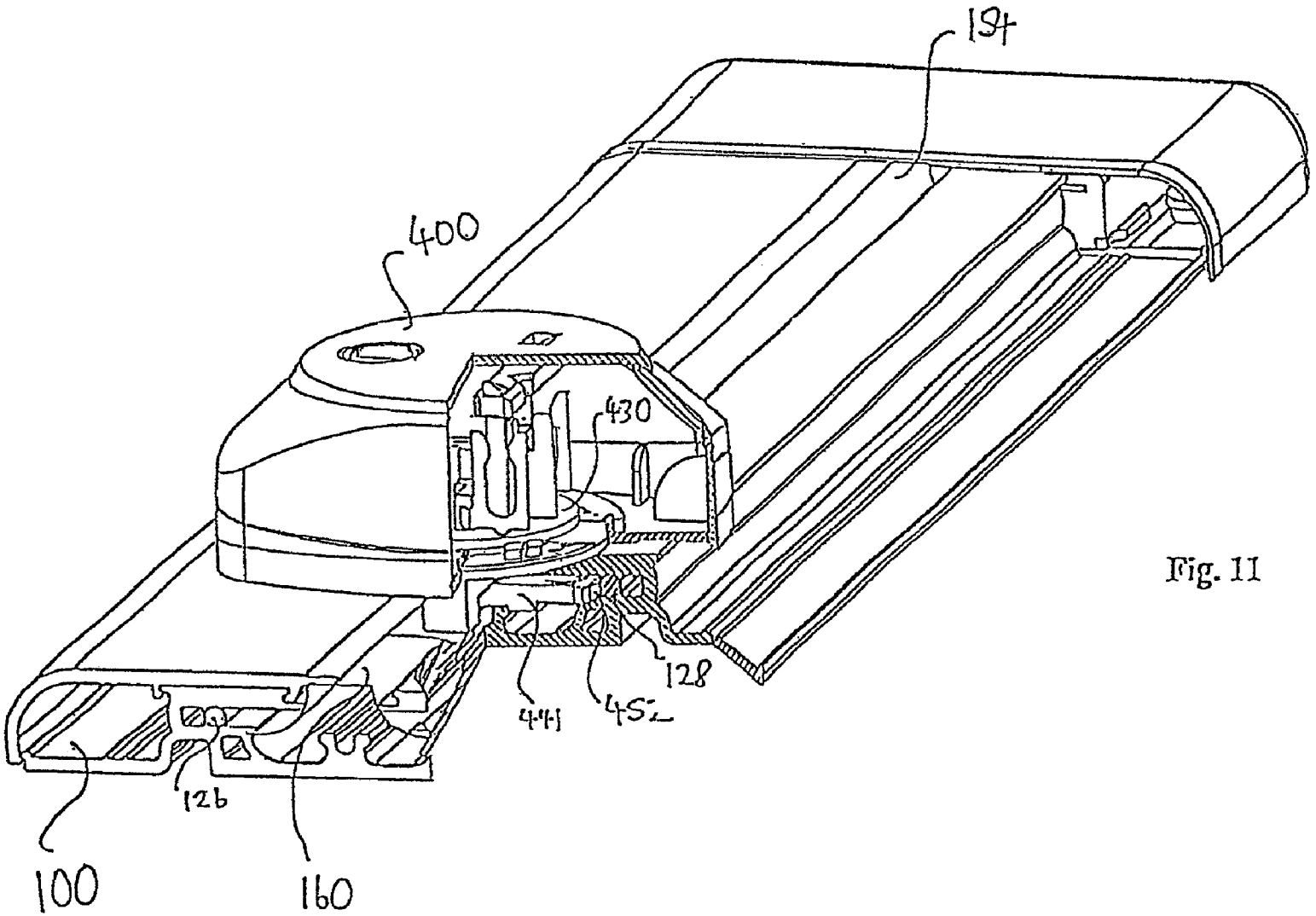
FIG. 11 is a view similar to FIG. 10 showing the power point connector rotated to engage the electrical conductors of the track section.

Operation of the embodiment of the invention will now be described with reference to FIGS. 10 and 11 which are part section views, in FIG. 10, of the power point connector 400 when initially inserted into the track section 100 (see FIG. 3) and, in FIG. 11, subsequently rotated clockwise, electrically to engage the conductors of the track section 100. It is to be understood that the location at which the connector 400 engages the track is chosen by the user in accordance with requirements. Once this location is chosen, the connector 400 is placed in a position shown in FIG. 9*a* with the protection members 424, 426 aligned with slot 110. The connector 400 is then pushed through the cover 154 against the bias of the earth spring 160, pressing this down at the point of entry of the connector 400. The bias of the spring provides a resistance to entry and gives a feeling of positive location of the connectors in the slot to the user. Since the earth spring 160 is formed from flexible material, the spring resiliently deforms only at the point of entry of the connector 400 and remains in a position to cover slot 110 elsewhere. When fully depressed, the cover 410 is then rotated through 90 degrees. The cover, being connected to the rotatable member 430 also causes the arm 434 to rotate through 90 degrees so that this moves from a position in line with slot 152 to a position in which the arm 434 sweeps into cavities 122, 124 until the contacts 450, 452 engage conductors 126, 128 in sliding, engagement to provide an electrical path between the conductors 126, 128 and the arms 446, 448. The direction of rotation is dependent on which way the connector is inserted into the slot, since the offset projection 435 will strike surface 158 if the connector is turned the wrong way. Only when turned the right way will the projection 153 not strike the projecting surface 158, thus only allowing connection of the contacts to the correct conductors. Flange member 420 remains in place during this rotation with contact protection members 424, 426 being held in the channel. The engagement of the arm 446, 448 with conductors 126, 128 and the sides of the adjacent cavities lock the power point connector 400 in place at the chosen location. The connector 400 may then be used by any normal electrical power point.

Figure 12:
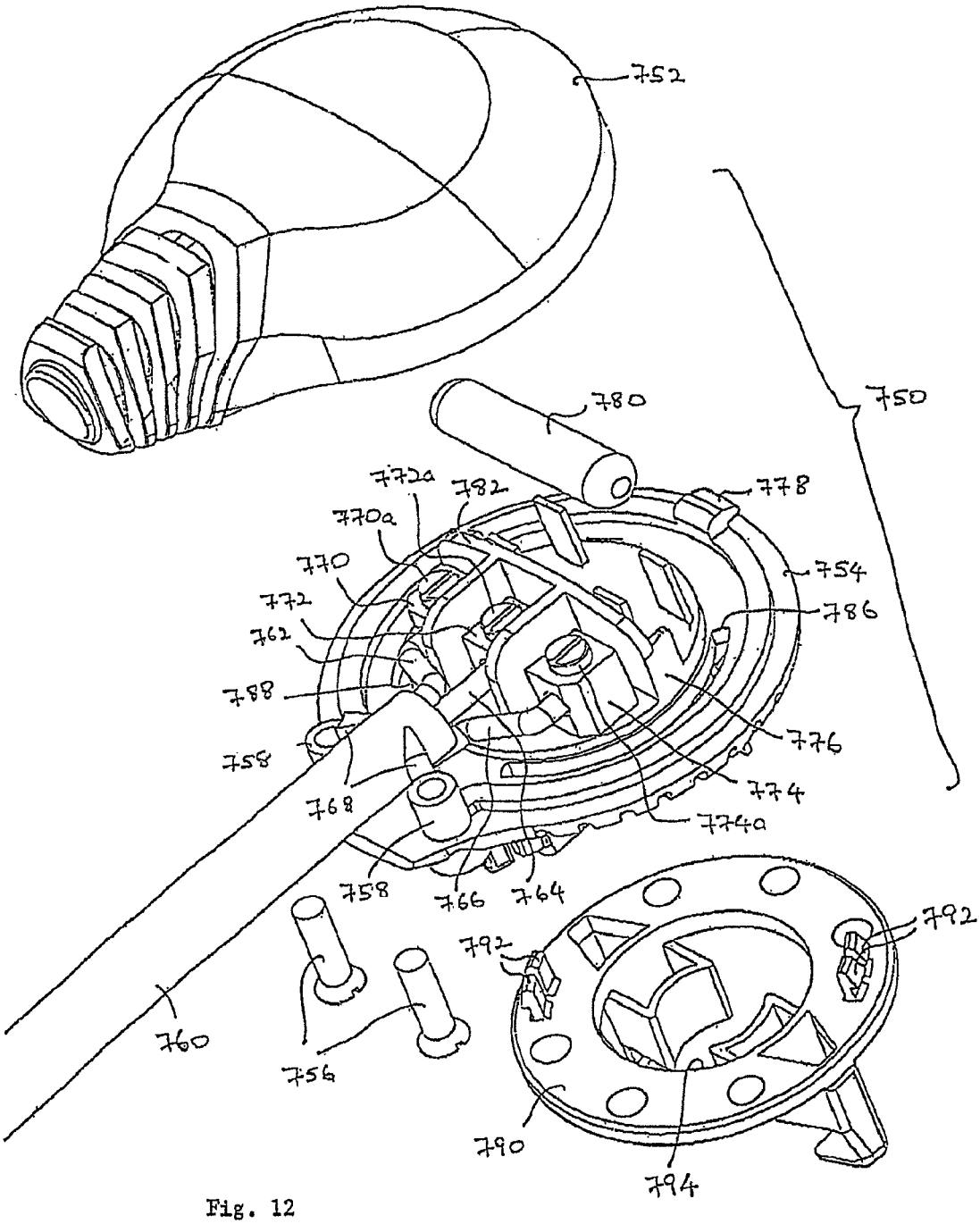
FIG. 12 shows an electrical plug which can be used to connect directly to the track section of FIG. 1 without using the power point connector of FIG. 8.
Figure 15:
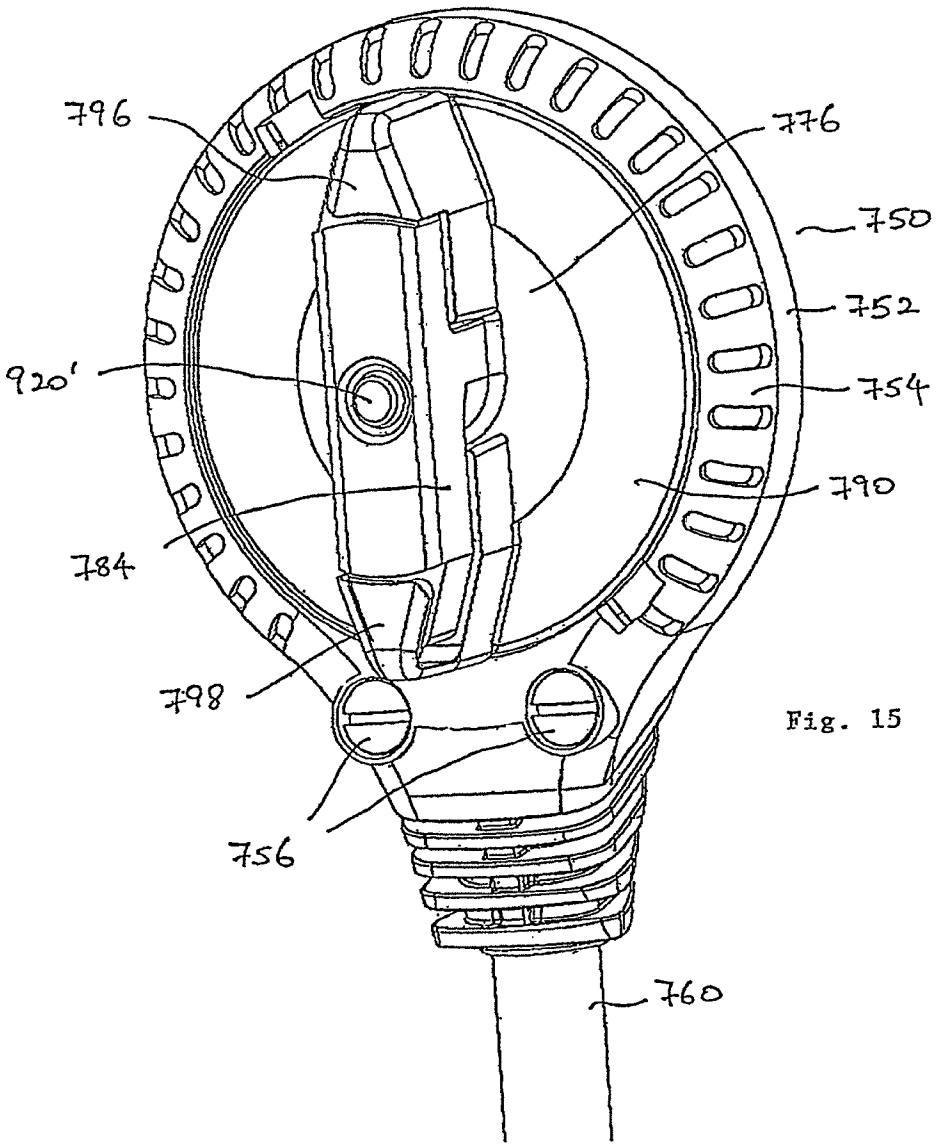
FIG. 15 shows a bottom perspective view of the electrical plug of FIG. 12 illustrating a contact arm with ends covered by two protection members.

In one variation instead of a power point connector 400 which allows an electrical device to be connected to the track section 100, the device may be wired directly to an electrical plug for direct connection to the track section 100 and FIG. 12 shows an exploded view of an embodiment of the plug 750. The plug 750 includes a cover 752 and a ringed base 754 forming a housing. The cover 752 is attached to the base 754 via screws 756 through threaded holes 758 so that the cover 752 can be separated from the base 754 with ease. A cable 760 carrying three electrical wires 762,764,766 for "Earth", "Neutral" and "Live" polarities of a power supply has one end connected to an electrical device and the other end connected to the plug 750. Two elastomeric members 768 are disposed in the plug 750 near the entry of the cable 760 to resiliently hold the cable 760. The three wires 762,764,766, which are typically insulated, are stripped to expose a length of copper and attached to respective conductive terminals 770,772,774 using terminal screws 770*a*,772*a*,774*a*. The terminals 770, 772,774 are made of metal so that each wire 762,764,766 is electrically connected to each terminal 770,772,774 and are supported on a circular mounting member 776. The mounting member 776 rests in an opening of the ringed base 754 supported from a lug 778 formed at an edge of the mounting member 776. A fuse 780 is provided to prevent over-supply of current which may damage an electrical device connected to the plug 750. The mounting member 776 also has an insulative partition 782 formed on the base 754 to reduce the possibility of any short-circuit between the terminals 770,772, 774 from occurring. Protruding from the other side of the mounting member 776 is a contact arm 784 which instead of a hook shape supporting portion at opposed ends of the contact arm, a resiliently displaceable hemispheric contact or head 900', 902' is used and this is shown more clearly in FIG. 13. The plug 750 also has an engagement surface 920' and as shown in FIG. 15, this and the heads 900,902 protrude out at different points of the contact arm 784. When the plug 750 is inserted through a slot 110 similar to that shown in FIG. 9*a*, the engagement surface 920' abuts the central portion 162 of the earth spring 160 and resiliently biases the central portion 162 towards the base 2180 (using the embodiment of FIG. 7*a* as an example). In this way, electrical contact is formed between earth and the earth pin of the plug 750.

Figure 13:
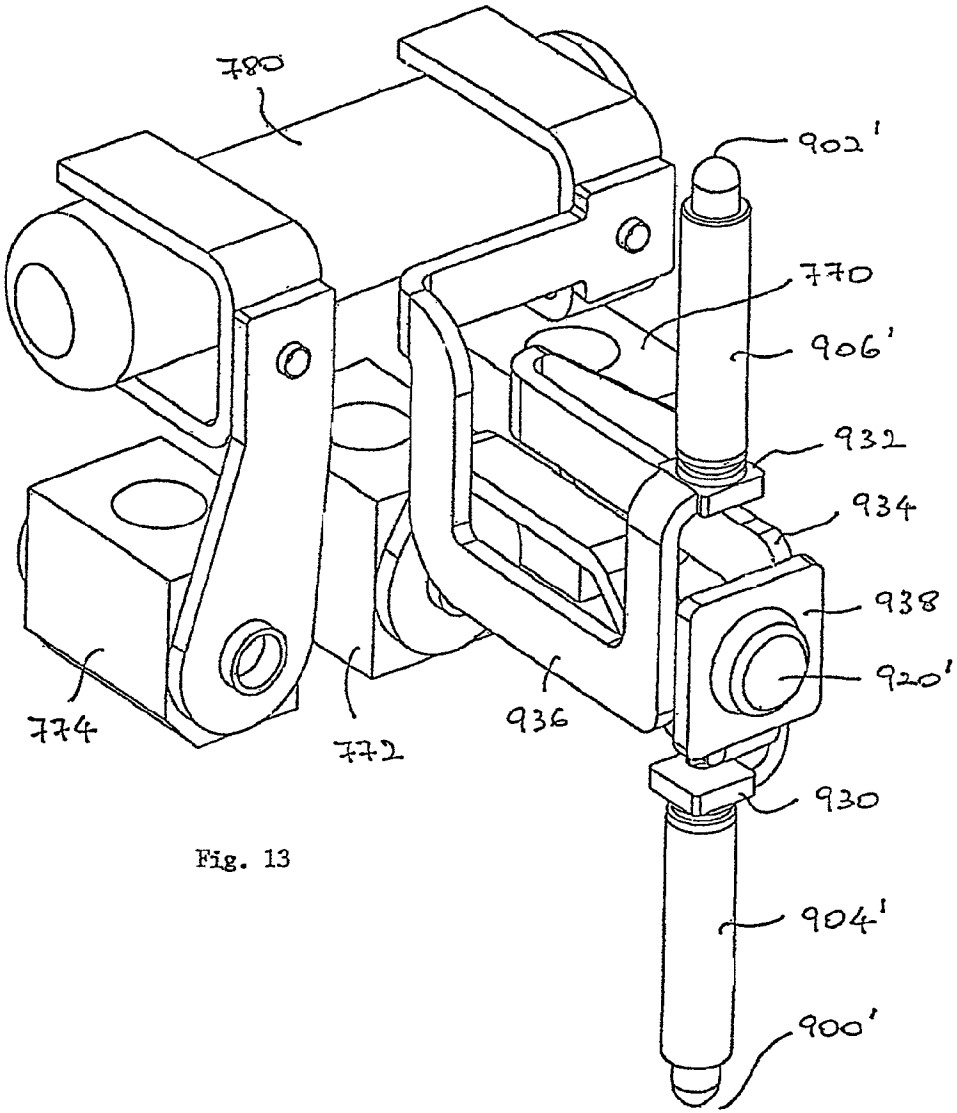
FIGS. 13 and 14 shows different perspective views of an internal structure of the electrical plug of FIG. 12.

Concerning FIG. 13, this shows how the cylindrical holders 904', 906' are connected to the terminals 770, 772,774 (with the rest of the components of the plug 750 not shown). Next, how the protruding heads 900', 902' and surface 920' are electrically connected to the respective terminals 770, 772, 774 will be described.

Figure 14:
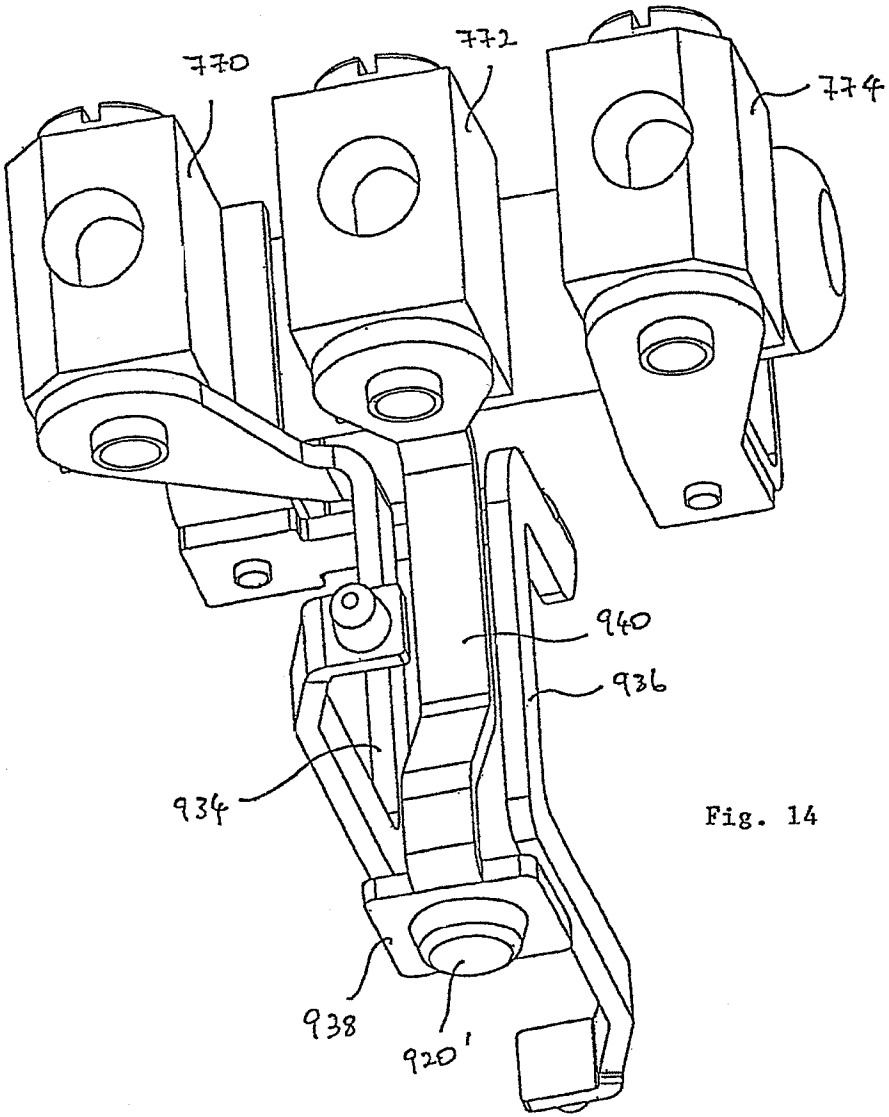

Each holder 904', 906' stands on a support element 930, 932 which is connected via a series of angular elements 934, 936 to respective "neutral" and "live" terminals 770, 774. The structure of the angular elements 934, 936 is shown in a different perspective in FIG. 14, with the holders 904', 906' omitted. In this embodiment, the angular element 936 is connected to the "live" terminal 774 via the fuse 780 which provides short-circuit protection. The engagement surface 920' is also provided on a support element 938 and is connected to the earth terminal 772 via an angular element 940 (see FIG. 14). When assembled, the holders 904', 906' are housed in the contact arm 784 with each head 900', 902' and the surface 920' protruding out of the contact arm, as described earlier.

Figure 16:
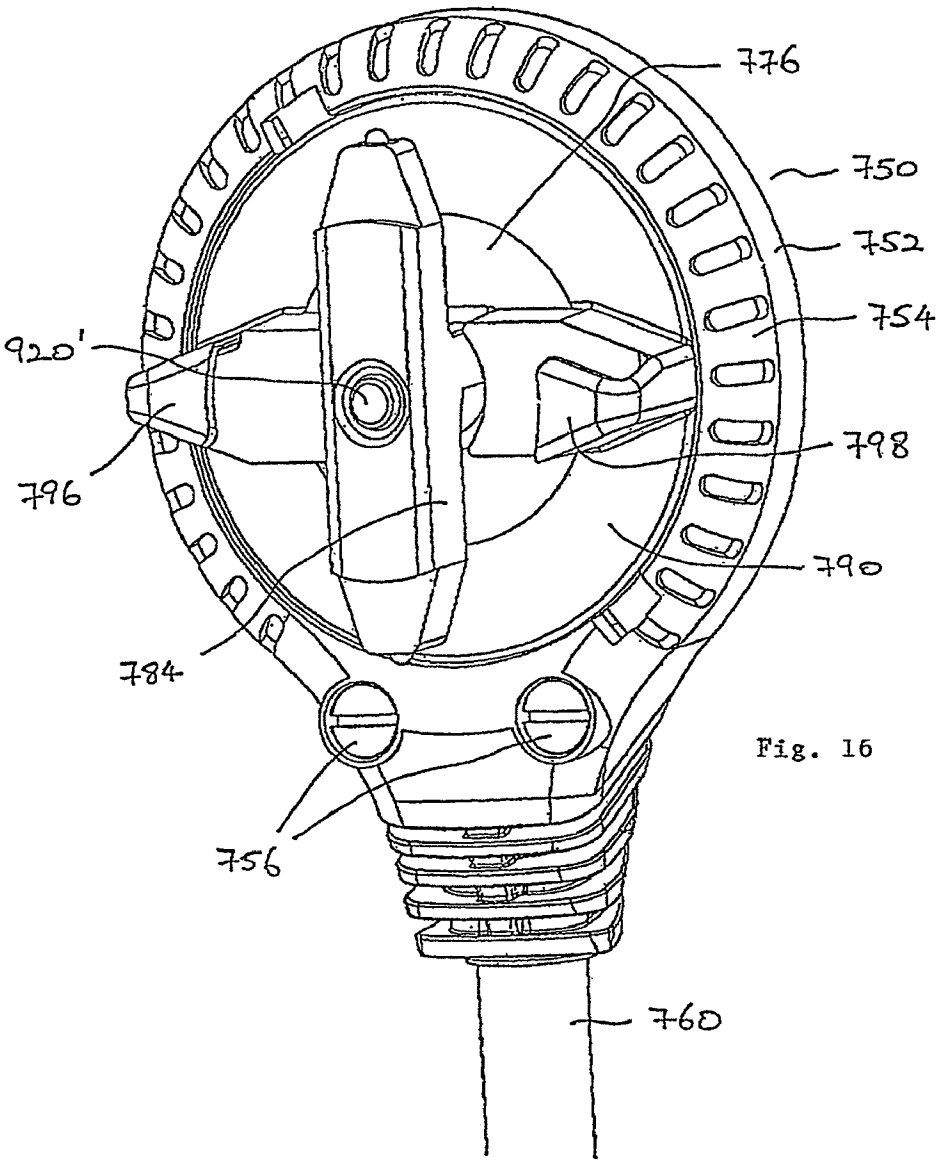
FIG. 16 shows the same view of FIG. 15 with the contact arm rotated.

Coming back to FIG. 12, the base 754 has a semi-circular channel 786,788 formed on each side of the terminals 770, 772,774 for attaching a flange member 790 similar to that used for the power point connector 400 described earlier. The flange member 790 includes snap fit connectors 792 to clip onto the semi-circular channels 786,788 so that the flange member 790 is movable relative to the base 754. The flange member 790 has a circular opening 794 to allow the contact arm 784 to protrude through when the mounting member 776 sits on the ringed base 754. Similar to the connector 400', both ends of the contact arm 784 are covered by inwardly extending protection members 796,798. This arrangement is conceptually similar to that of the connector 400 of FIG. 9*a*/9*b* and the contact arm 784 is also rotatable with respect to the protection members 796,798 as shown in FIGS. 15 and 16.

Using the first embodiment of the track section, as an example, in use, the plug 750 is inserted into the slot 110 (see FIGS. 1 and 3) at a desired point with the contact arm 784 aligned with the protection members 796,798 as shown in FIG. 15. As the plug 750 is inserted into the slot 110, the engagement surface 920' engages the central portion 162 of the earth spring 160 depressing the spring 160 towards the base 120. The limit being reached when the flat portion 162 of the spring 160 touches the projection 152 of the base 120. The plug 750 is then rotated 90 degrees so that the contact arm 784 is at right angles to the protection members 796,798 which are prevented from rotating by the projecting edges 176,178. At the position shown in FIG. 16, the contacts 900', 902' engages the two conductors 126, 128 and an electrical connection is formed between the respective wires 762,766 for providing "live" and "neutral" polarities and the two conductors 126, 128.

Using the plug 750 as proposed allows a user to connect his electrical device or appliance anywhere along the track section 100 and access electrical power by a simple "insert and twist" action, similar to the power point connector 400.

Figure 17:
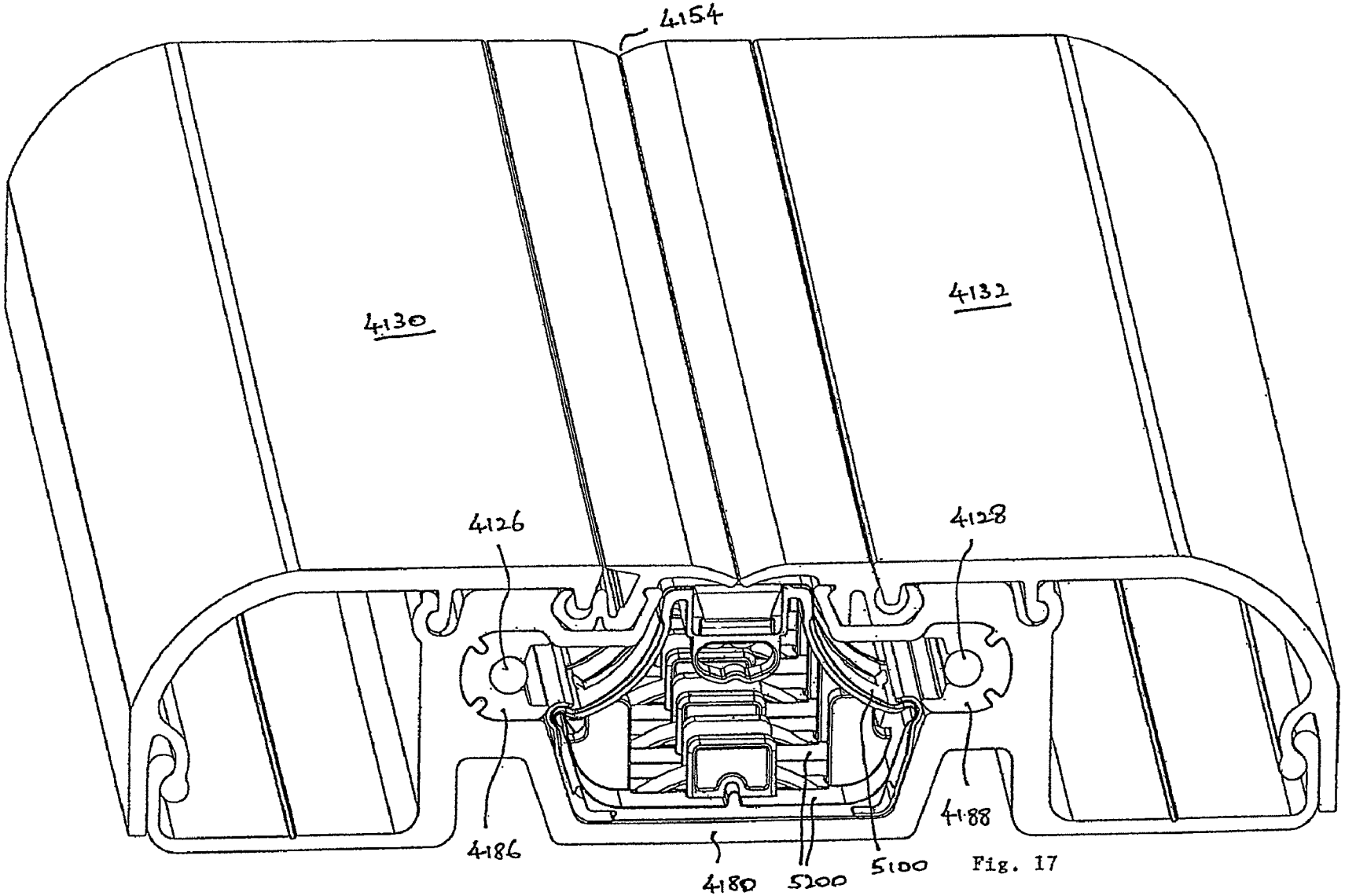
FIGS. 17 and 18 illustrate cross section views of a further embodiment of a track section which includes a different conductive member as the earth spring.
Figure 18:
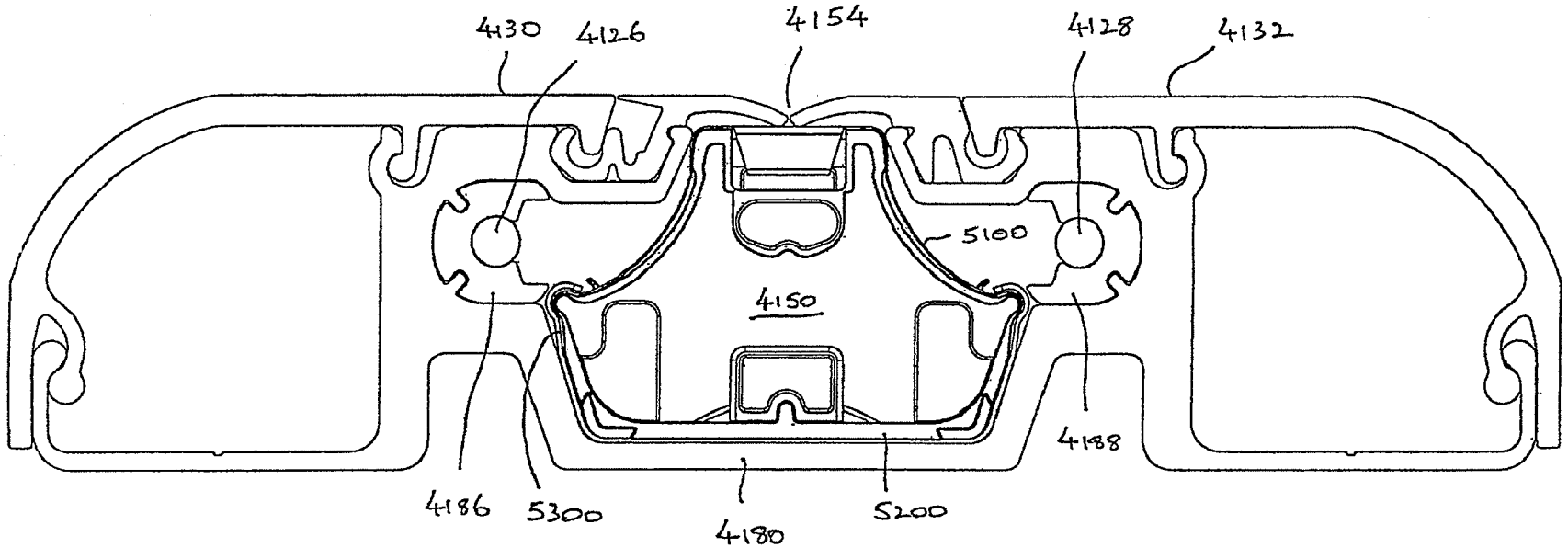

FIG. 17 shows an end perspective view of a fourth embodiment of the track section of the power supply apparatus. This embodiment is similar to the third embodiment shown in FIG. 7*a* and similar parts have similar reference numerals with the addition of 2000. The main difference between this embodiment and the third embodiment relates to the structure of the base 4180 (compare this with the base member 2180 of FIG. 7*a*) which is extruded preferably from plastic material. As shown in FIGS. 17 and 18, the base member 4180 is adapted to accommodate a variation of the conductive member 5100 which in the earlier embodiment of FIG. 7*a* is in the form of an earth spring 2160.

Figure 19:
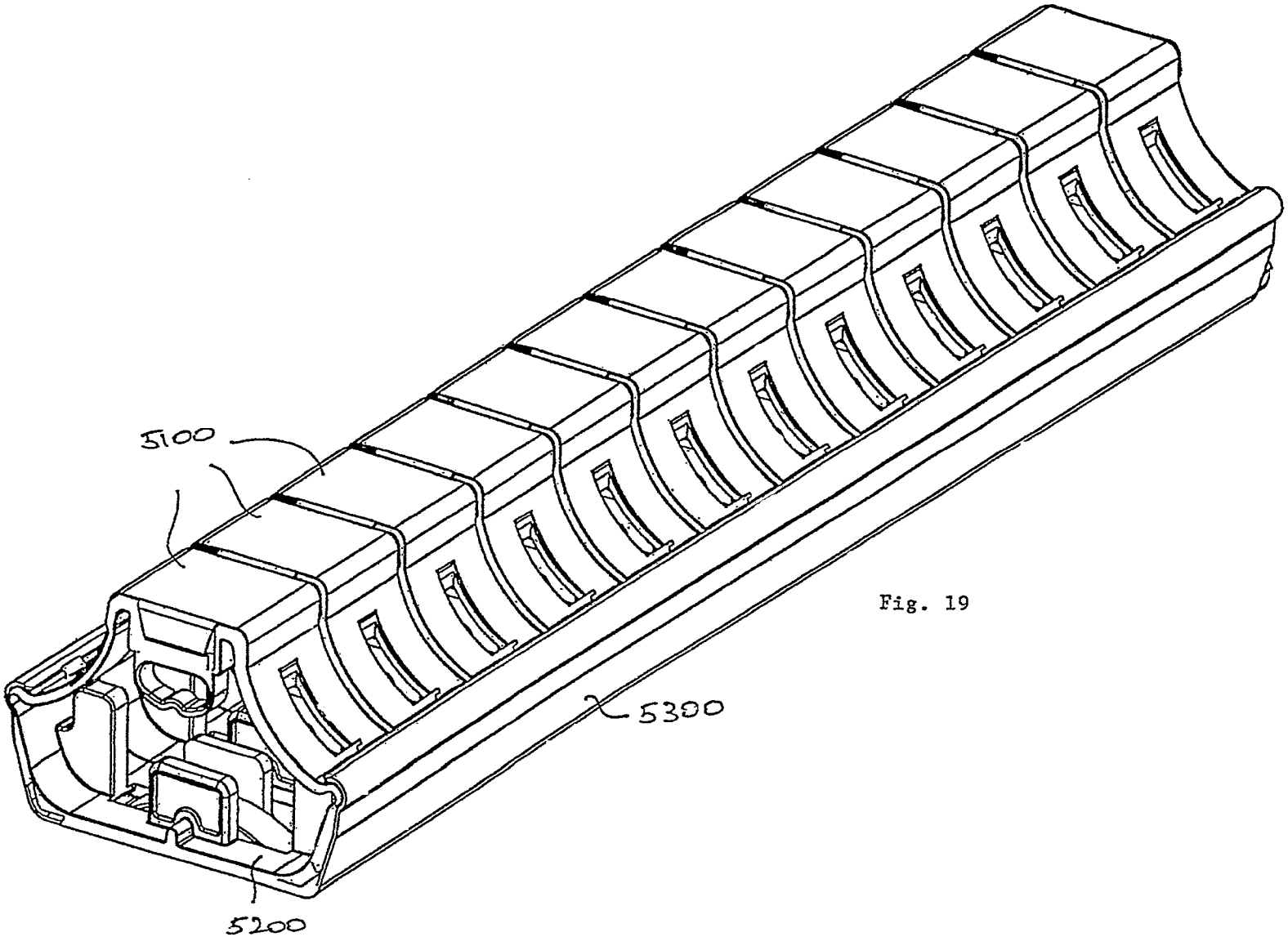
FIG. 19 shows a preferred embodiment of the conductive member of FIG. 17 being supported on respective support modules and assembled in a support tray.
Figure 20:
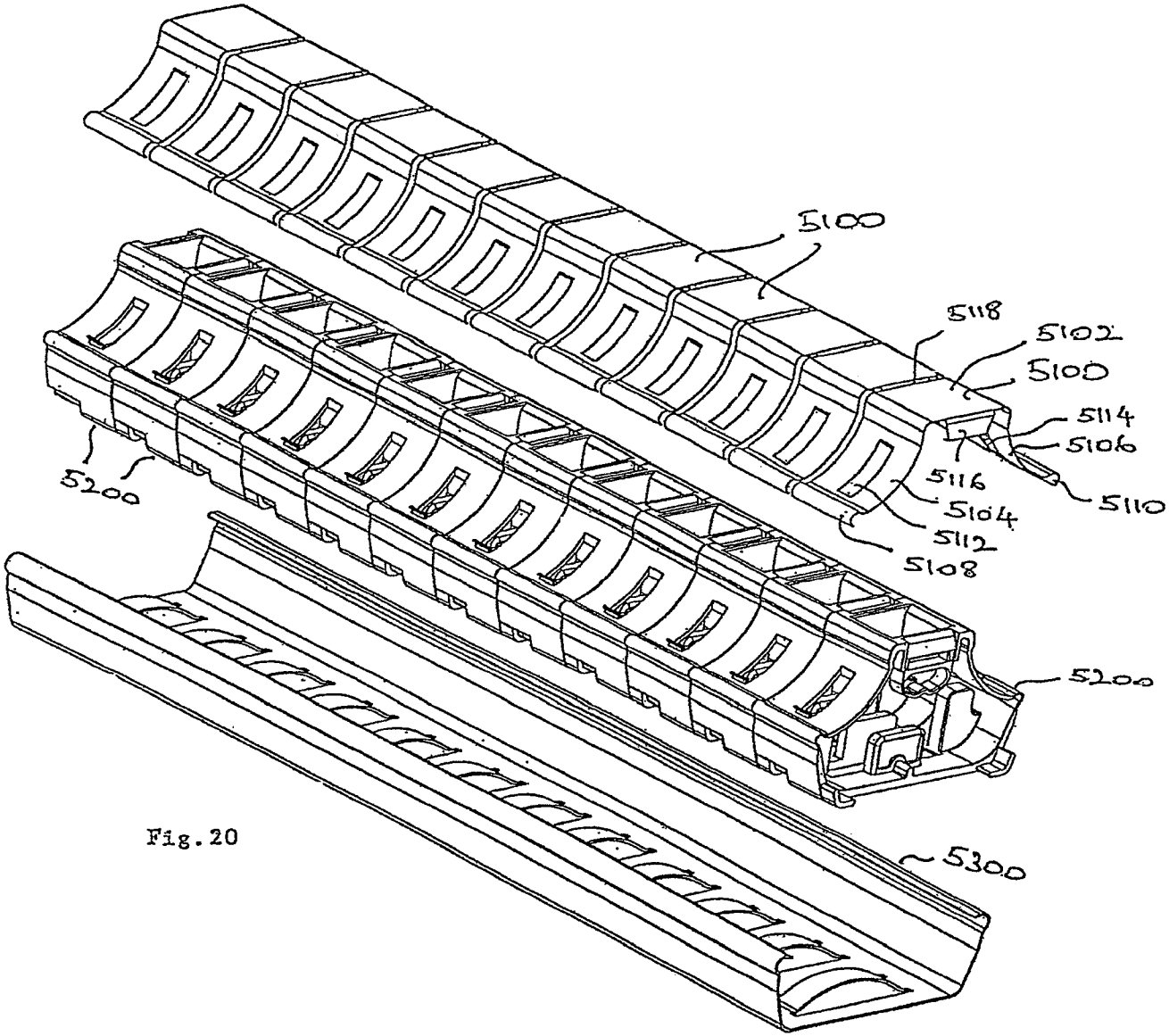
FIG. 20 shows an exploded view of the assembly of FIG. 19.

In the fourth embodiment, instead of a single earth spring spanning the length of the track section 100, the power supply apparatus includes a plurality of separate conductive members 5100 in modular form and arranged inside a cavity 4150 formed between the base member 4180 and covers 4130, 4132. Each conductive member 5100 is supported on respective support modules 5200 and collectively arranged on an elongate conductive tray 5300 as shown in FIG. 19. As will be apparent later, unlike the earlier variation, the conductive member 5100 is modular in structure and individually displaceable by a power point connector 400 or an electrical plug 750. FIG. 20 shows the arrangement of FIG. 19 with the different parts exploded in view. Each of these parts will now be elaborated.

Each conductive member 5100, which is electrically connected to earth (via the tray 5300), is formed from flexible, resilient conductive material. Each member 5100 has a flat central portion 5102 with wings 5104,5106 projecting arcuately away from the central portion 5102. At the end of each wing 5104,5106, there is a C-shape rim 5108,5110 which curved inwards for matching a corresponding portion on the support module 5200. The conductive member 5100 also has an elongate slot 5112,5114 formed in each wing 5104,5106 along the wing's length direction. At the central portion 5102, side connecting clips 5116,5118 are provided at the two sides between the two wings 5104,5106 and these clips 5116,5118 are used to releasably connect the conductive member 5100 to the support module 5200.

Figure 21:
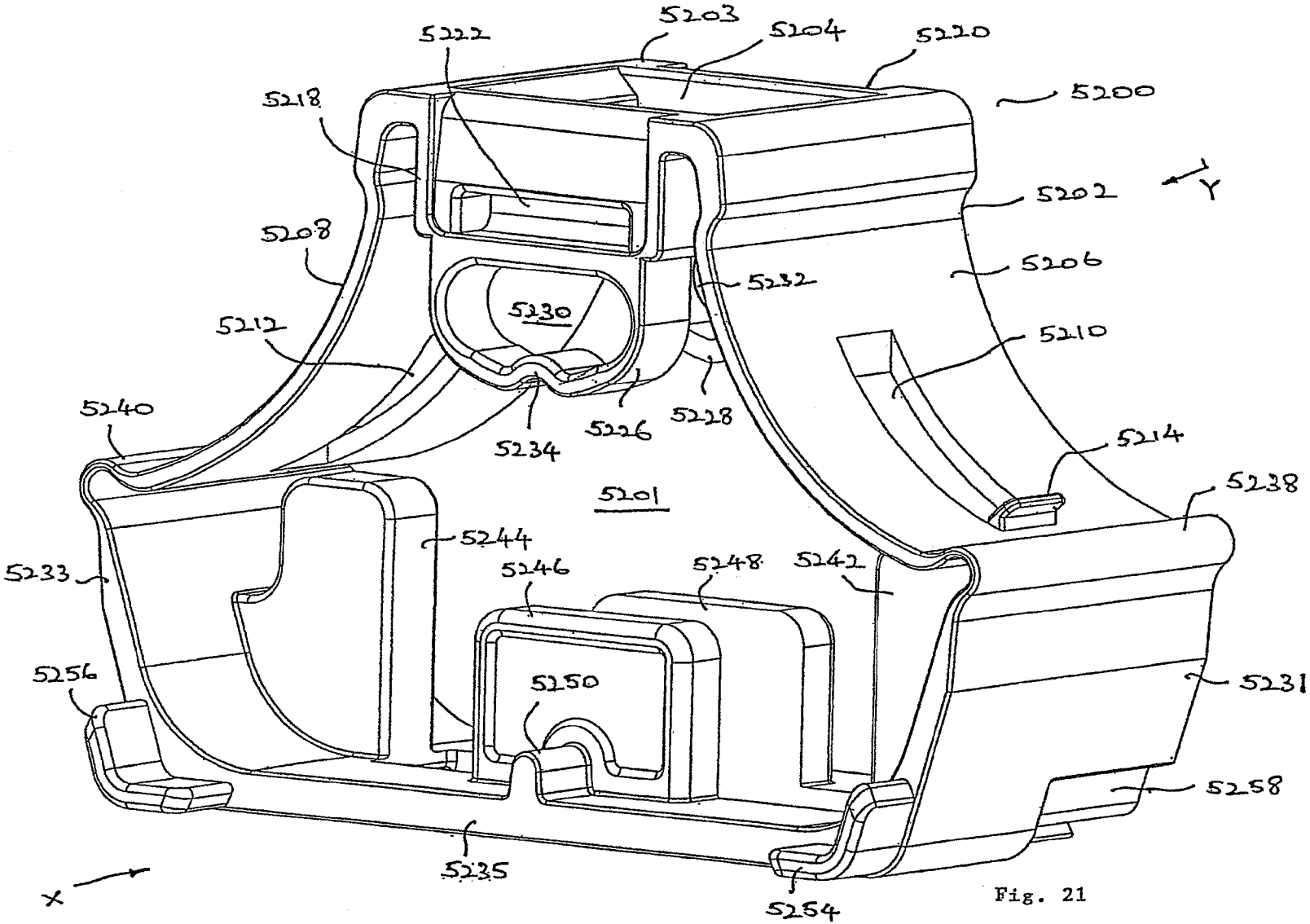
FIGS. 21 to 24 are different views of the support module of FIG. 20.
Figure 22:
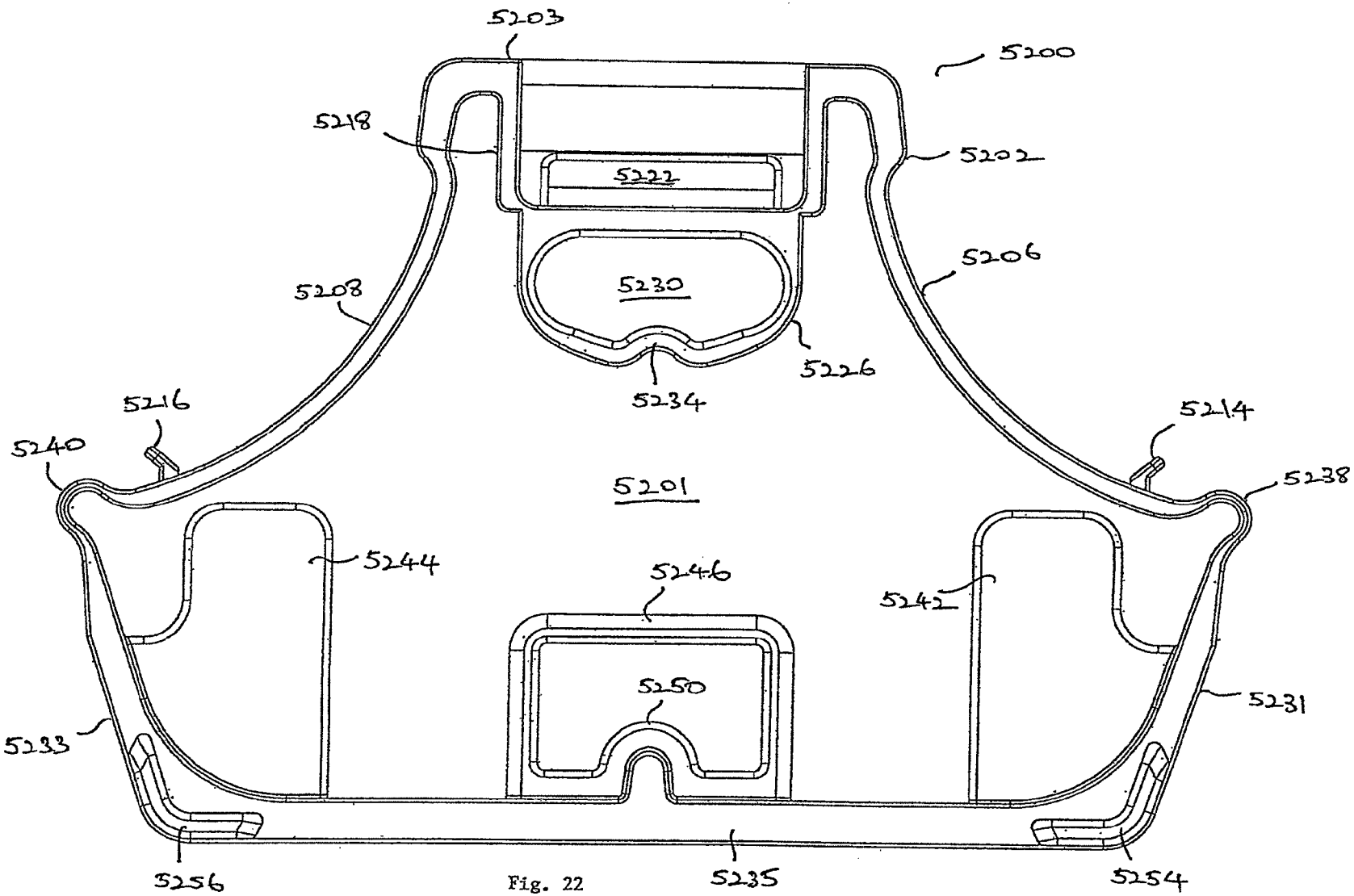
Figure 23:
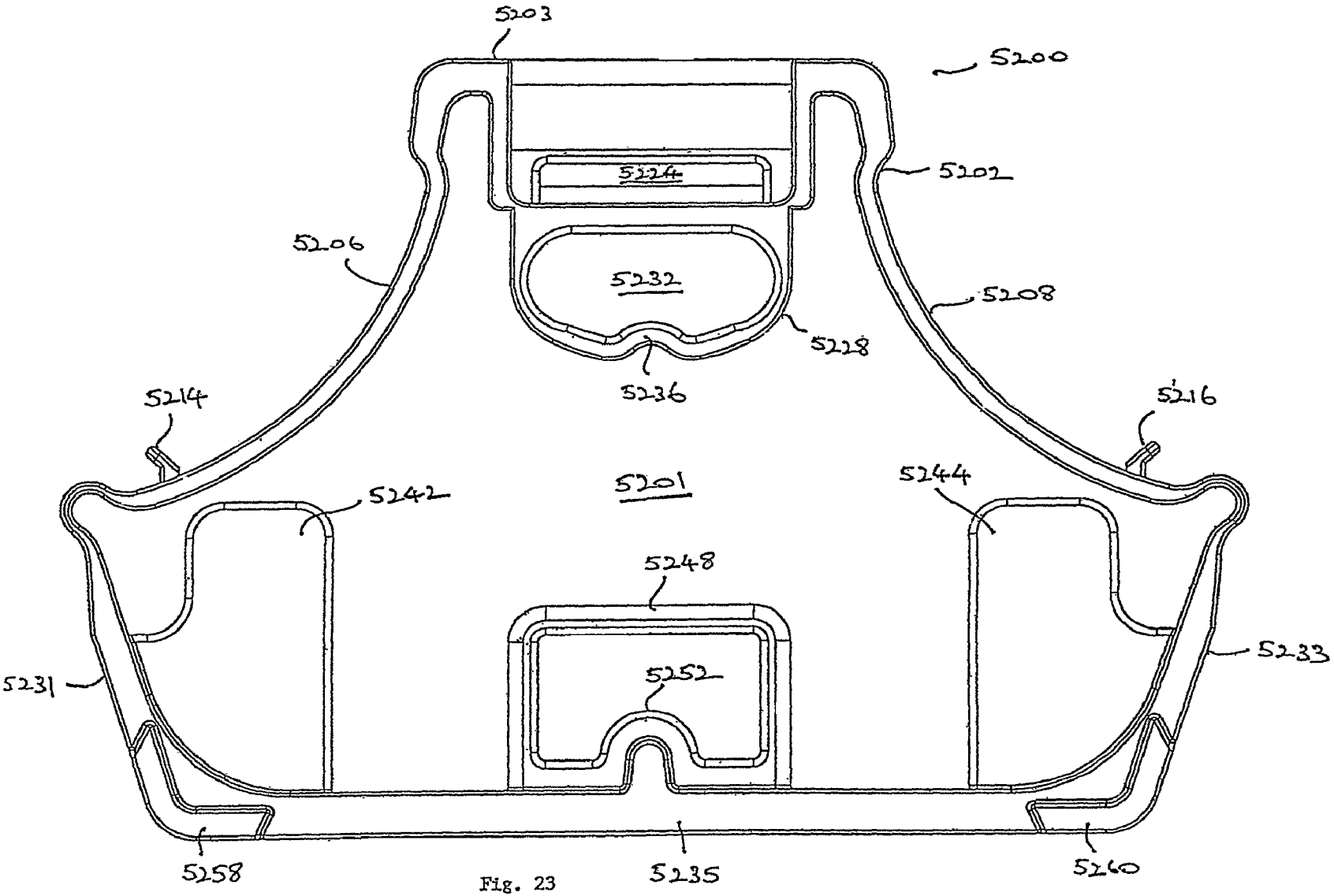

FIGS. 21 to 23 shows close-ups views of a support module with FIG. 22 depicting an end view from the X direction and FIG. 23 depicting the other end view from the Y direction of FIG. 21.

The support module 5200 is injection moulded from flexible plastic material to give the module a resilient structure. The module 5200 has a central cavity 5201 between a support portion 5202 and a base 5235. The support portion 5202 is adapted to support the conductive member 5100 and includes a rectangular flat section 5203 having a central opening 5204. The support portion 5202 also includes two wing portions 5206,5208 extending from two sides of the flat section 5203 and adapted to correspond respectively to each wing 5104, 5106 of the conductive member 5100. Each wing portion 5206,5208 has a C-shaped elongate lip 5238,5240 at the ends to correspond to the similarly shaped rim 5108,5110 of the conductive member 5100. Similar to the wings 5104,5106 of the conductive member 5100, each wing portion 5206,5208 also has an elongate opening 5210,5212, the position of which corresponds to the slots 5112,5114 formed in the wings 5104,5106. At the lower end of each elongate opening 5210, 5212 extends a catch 5214,5216 which locates within the slots 5112,5114 of the conductive member 5100. The catch 5214,5216 is angled to releasably connect the conductive member 5100 to the support module 5200.

The support module 5200 also has two side portions 5218, 5220 spaced apart and which extends downwards from the flat section 5203. Each side portion 5218,5220 has a rectangular cavity 5222,5224 formed therein to receive the connecting clips 5116,5118 of the conductive member 5100. Each side portion 5180,5220 ends with an oval shaped lobe 5226, 5228 having a central void 5230,5232. At the perimeter of each lobe 5226,5228 there is a slight arch or depression 5234,5236 and the purpose of this will be apparent later.

The base 5235 of the support module 5200 sits on the tray 5200 and has side walls 5231,5233 that meet the c-shaped lips 5238,5240 as shown in FIG. 22. The lips 5238,5240 are so shaped to correspond to the C-shaped rims 5108,5110 of the conductive member when both parts are assembled together.

The support portion 5202 of the module 5200 comprising the wing portions 5206,5208 and the flat section 5203 are resiliently displaceable or movable with respect to the base 5235. When a force is applied on the flat section 5203 towards the base 5235, the wing portions 5206,5208 spread the side walls 5231,5233 so that the section 5203 can be resiliently biased in response to the applied force. As shown in FIGS. 22 and 23, the module 5200 has two rectangular shoulders 5242, 5244 located in the cavity 5201 and which extend from the side walls of the base 5235 and the shoulders 5242,5244 are arranged to locate through the openings 5210,5212 when the top section 5202 is displaced towards the base 5235. The shoulders 5242,5244 is used to abut against a connector which is used to displace the support portion 5202 towards the base. The shoulders 5242,5244 thus act as stoppers to alleviate the force asserted on the flat section 5203. When located in respective openings 5210,5212, the shoulders 5242,5244 also alleviate lateral movement between the support portion 5202 and the base 5235 due to the force on the top section 5203.

The module 5200 also includes two guiding elements 5246,5248 in the cavity 5201 and which is connected to the base 5235. The guiding elements 5246,5248 are spaced apart and arranged side by side to locate in the space between the two lobes 5226,5228 when the flat section 5203 is biased towards the base 5235. Two arch shaped protrusions 5250, 5252 extend in opposing directions from the guiding elements 5246,5248 and the height of the protrusions 5250,5252 is adapted to abut against respective arches 5234,5236 of the resilient lobes 5226,5228 to restrain the top section 5202 from being forced towards the base so as to alleviate damage to the module 5200. The resilient lobes 5226,5228 also help to bias the section 5203 away from the base 5235 when the force on the section 5203 is removed. The lobes 5226,5228 thus provide a "spring" effect within another "spring" effect which is provided by the entire resilient structure of the support member 5200.

Figure 24:
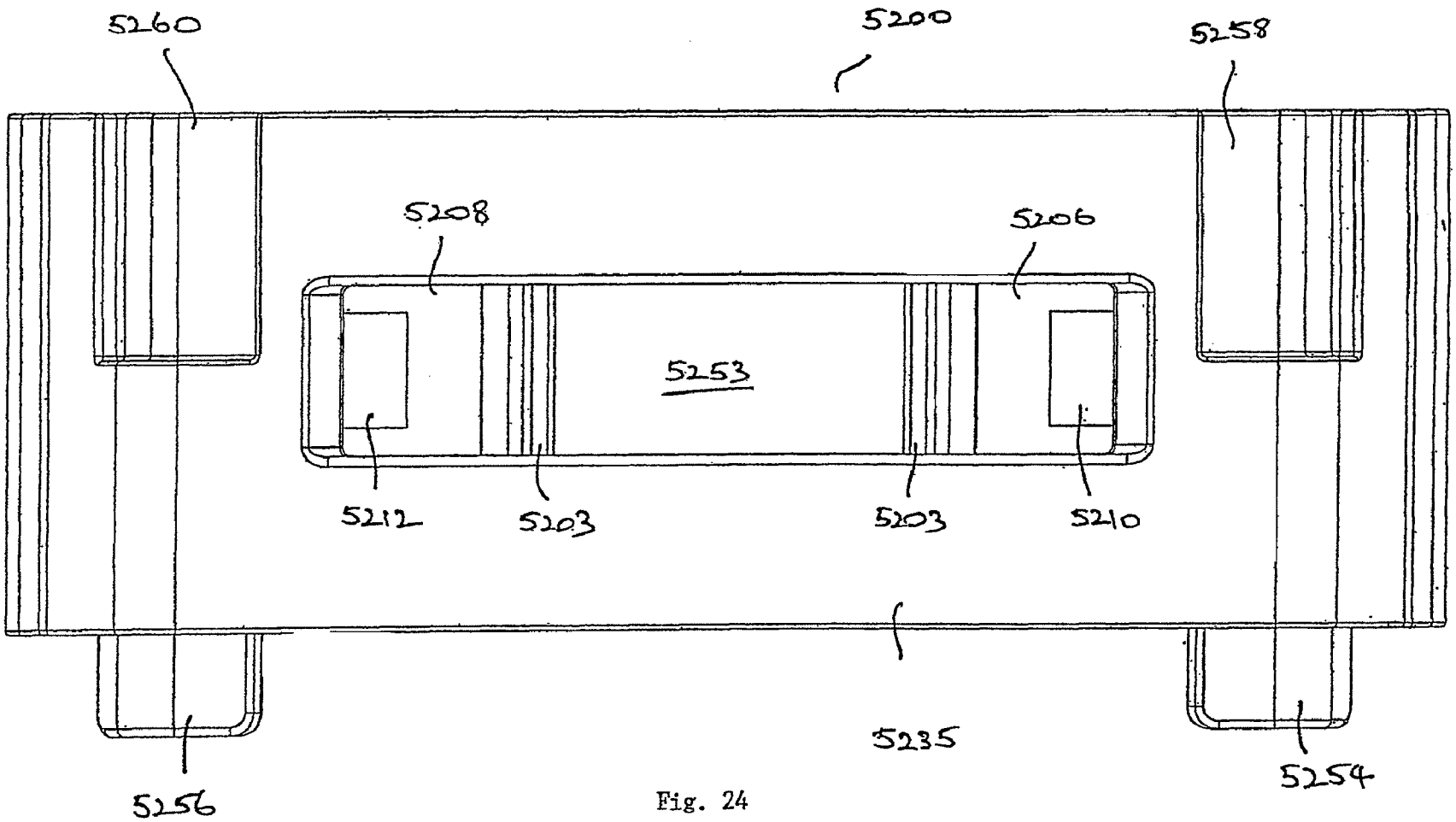

Formed in the base 5235 between the two guiding elements 5246,5248 is an elongate hole 5253 as shown in FIG. 24, which is a bottom view of the module 5200 of FIG. 21, and the hole 5253 is used for arranging the module 5200 on the tray 5300.

To align the module 5200 with a like module, the module 5200 has two angled lugs 5254,5256 extending from two corners of the module 5200 near the base 5235. On opposing corners of the module 5200 near the base 5235 are corresponding lug slots 5258,5260 adapted for receiving the angled lugs 5254,5256 of another module 5200. The arrangement of the lugs 5254,5256 and the slots 5258,5260 are illustrated in FIG. 24. To align two modules 5200 together, the angled lugs 5254,5256 of the second module are disposed in the lug slots 5258,5260 of the first module.

Figure 25:
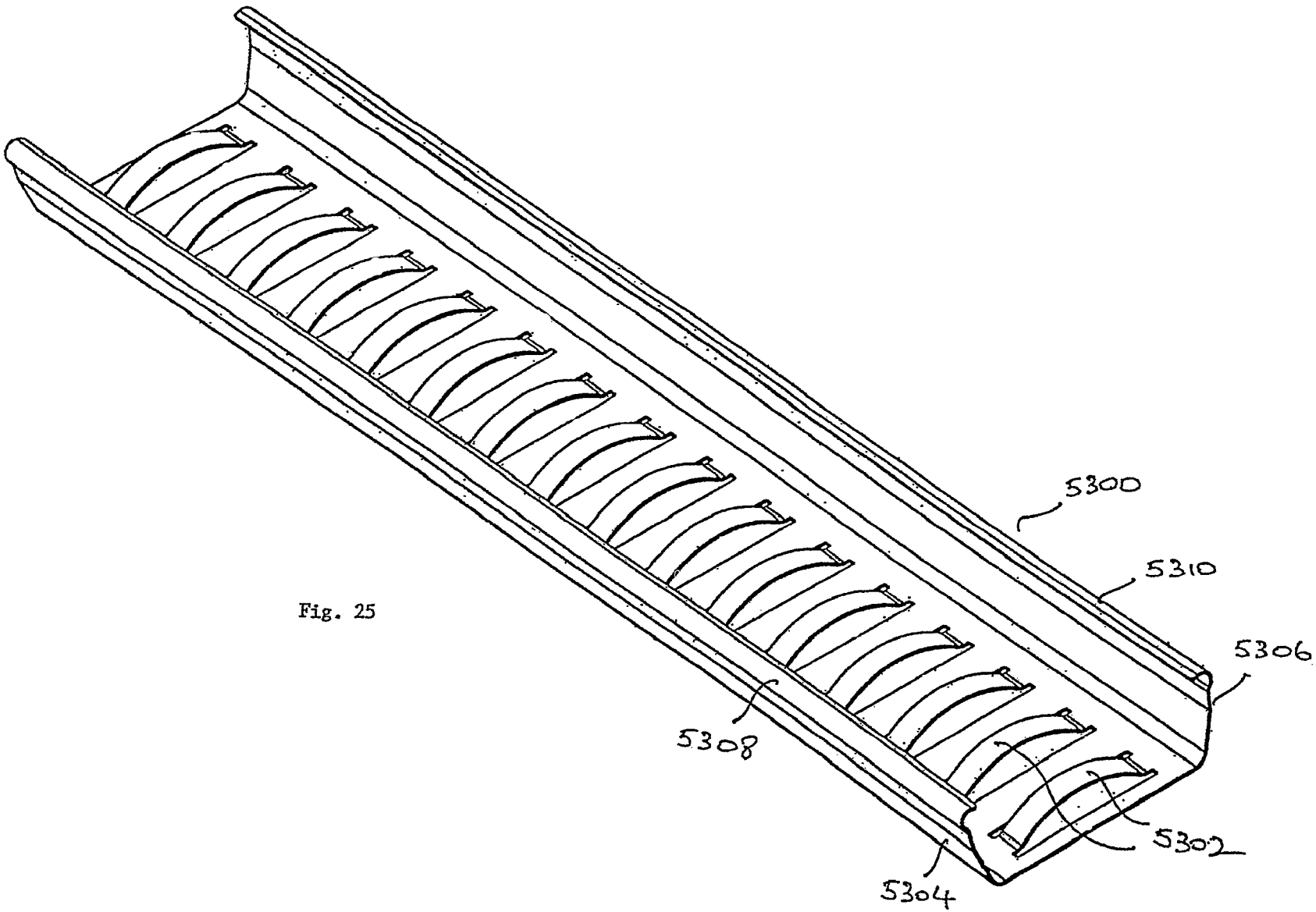
FIGS. 25 and 26 illustrate different views of the support tray arranged to receive a plurality of conductive members of FIG. 19.
Figure 26:
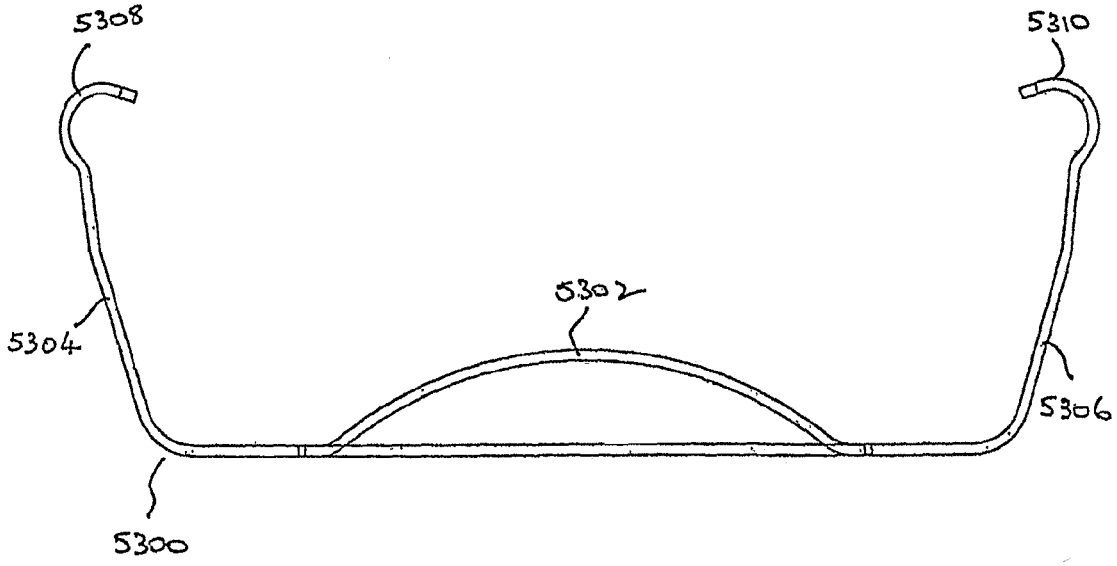

Concerning the tray 5300, this is illustrated as a perspective view in FIG. 25 and as an end view in FIG. 25. The tray 5300 is formed from conductive material and is used to receive the module 5200. The tray 5300 has a plurality of spaced strips 5302 arched inwards of the tray 5300 which are cut and stamped into the curved shaped. The side walls 5304,5306 of the tray are shaped to match the side walls 5231,5233 of the modules 5200 and at the ends of the side walls of the tray 5300 are C-shaped rims 5308,5310 for engaging the curved lips 5238,5240 of the module (and the conductive member when all these are arranged together). The spacing between the strips 5302 is arranged so that a strip 5302 can be located within the elongate hole 5253 of a module 5200.

To assemble these parts together, a conductive member 5100 is first placed on a support module 5200 by aligning the C-shaped rims 5108,5110 on respective is curved portions 5238,5240 of the module, the central portion 5102 on the flat section 5203, and hooking the catch 5214,5216 to the elongate slots 5112,5114. The side clips 5116,5118 are also clipped to the rectangular cavities 5222,5224 of the module 5200. Each of the conductive member 5100 is individually arranged on the modules 5200 and the modules 5200 are then aligned together by sliding the lugs 5254,5256 into corresponding slots 5258,5260 of a like module. Eventually, a train of modules 5200 and respective conductive members 5100 is formed. When this is done, the train is arranged in the tray 5300 with an arched strip 5302 located within a corresponding elongate hole 5253 of a module 5200. The side walls of the tray 5300 is biased open as the modules 5200 are inserted into the tray so that the c-shaped rims 5308,5310 engage the c-shaped rims 5108,5110 of the conductive member 5100 and the module's curved portion 5238,5240. Since the tray 5300 is made of conductive material, each conductive element 5200 is electrically connected to the tray via the c-shaped rims 5308,5310. If the tray 5300 is electrically connected to earth, each conductive member 5100 is also thus connected. When the components are assembled in the tray 5300, the conductive members 5100 and respective support members 5200 are depressed using a tool so that the assembled components can be inserted into the track section.

Figure 27:
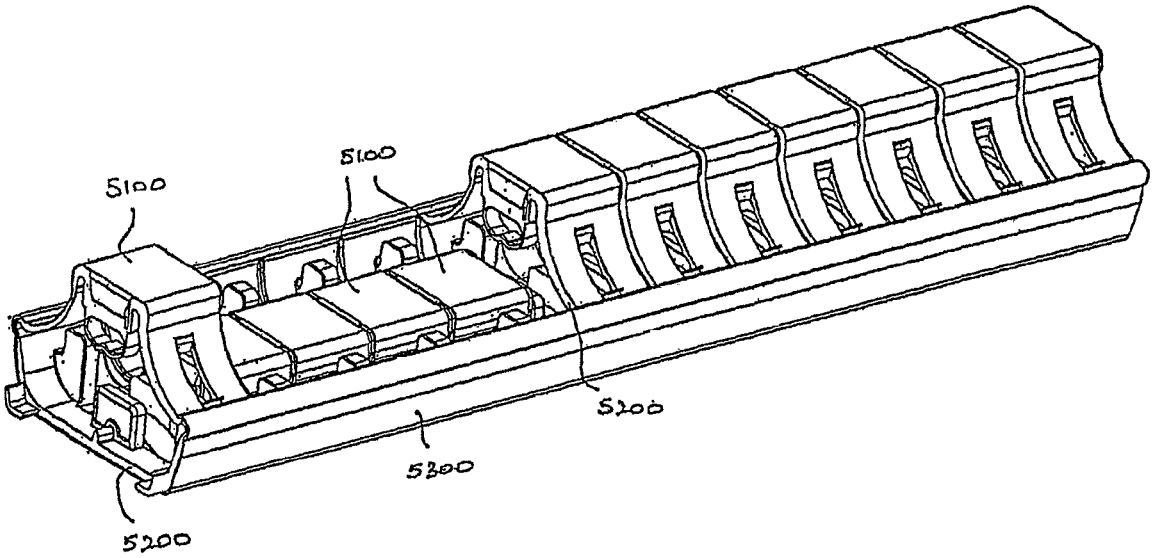
FIG. 27 is a perspective view of the assembly of FIG. 19 illustrating four support modules being displaced.
Figure 28:
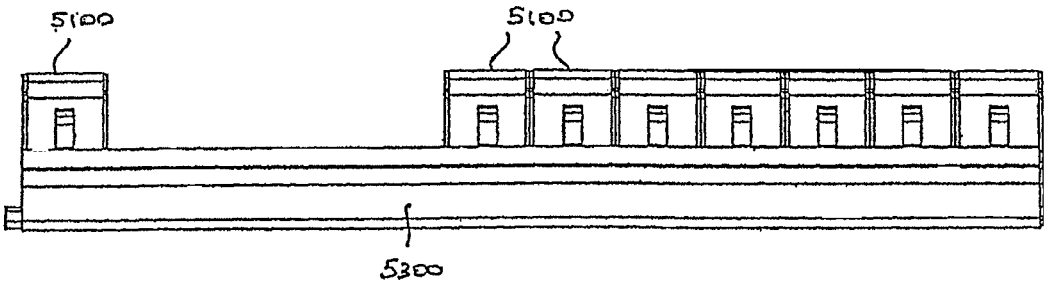
FIG. 28 is a side view of the assembly of FIG. 27.

When the conductive members 5100 are arranged on the support modules 5200, each of these conductive members 5100 is individually displaceable by a connector 400 or plug 750 and FIG. 27 showing four conductive members 5100 and corresponding support modules 5200 being displaced by a connector 400 or plug 750. FIG. 28 shows a side view of the tray of FIG. 27 to show the displacements of the four conductive elements 5100 and support modules 5200.

Figure 29:
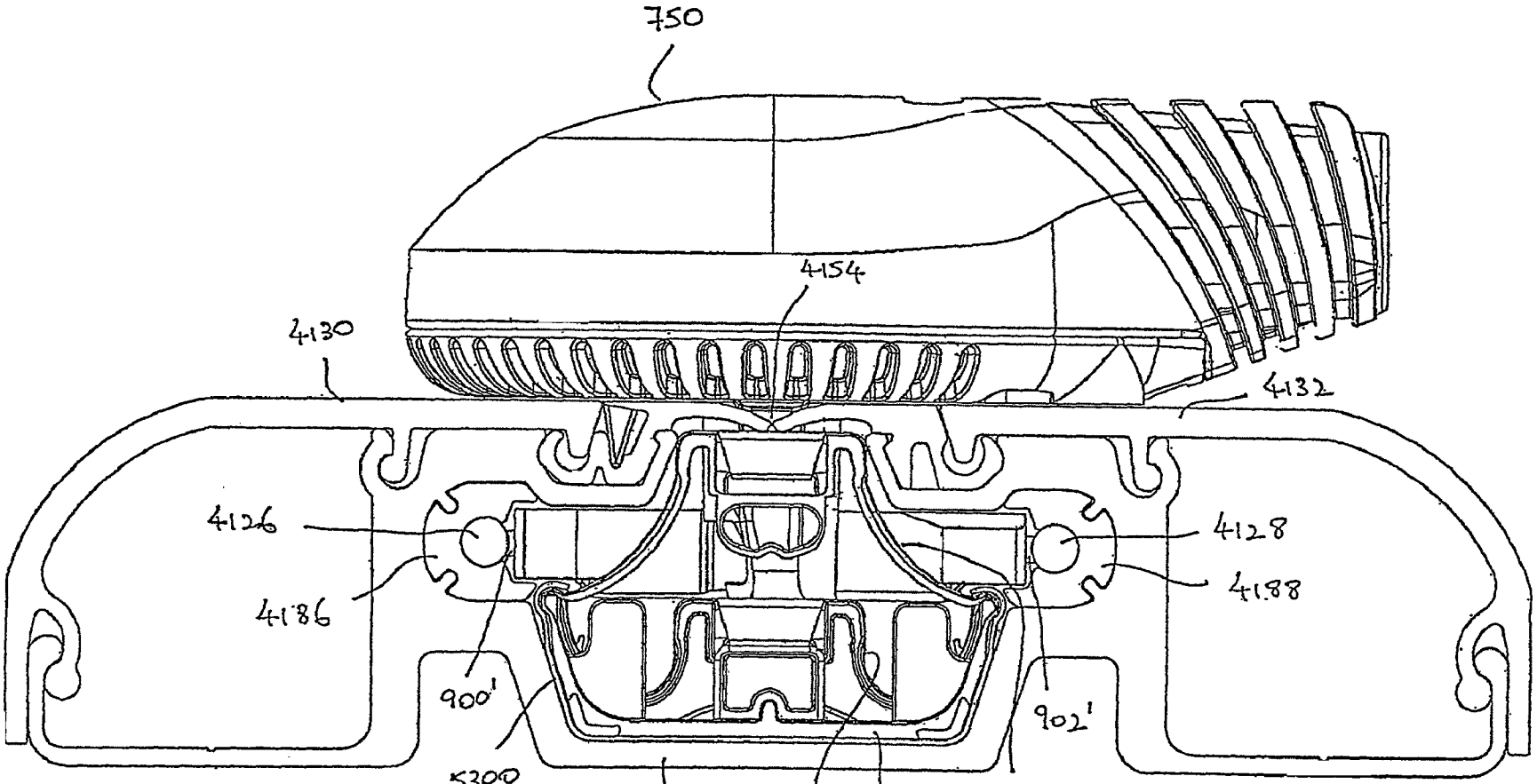
FIG. 29 shows how an electrical plug of FIG. 15 is used to displace the conductive and support members of FIG. 27 to gain access to the conductors in the track section.

Next, the use of the plug 750 of FIG. 15 to displace the support members 5100 will be described. As explained earlier, the plug 750 in the arrangement shown in FIG. 15 is connected to a track section 100 by inserting the contact arm 784 and protection members 796,798 through the slot 4154 (using the embodiment of FIG. 18 as an example). The elongate arrangement of the contact arm 784 and protection members 796,798 abut four of the conductive members 5100' and respective support modules 5200' (the ' here denotes those conductive members and support modules being displaced by the plug 750) with the engagement surface 920' making contact with one of the conductive members 5100. To secure the plug 750 to the track section 100, the plug 750 is rotated 90° as shown in FIG. 29. The end protection members 796,798 continues to depress two of the displaced conductive members 5100' and the rotated contact arm 784 depresses the centre two conductive members 5100'. The hemispheric contact heads 900', 902' thus make electrical contact with respective "live" and "neutral" conductor 4126,4128. The earth connection is formed with the engagement surface 920' being in contact with one of the conductive members 5100.

Figure 30:
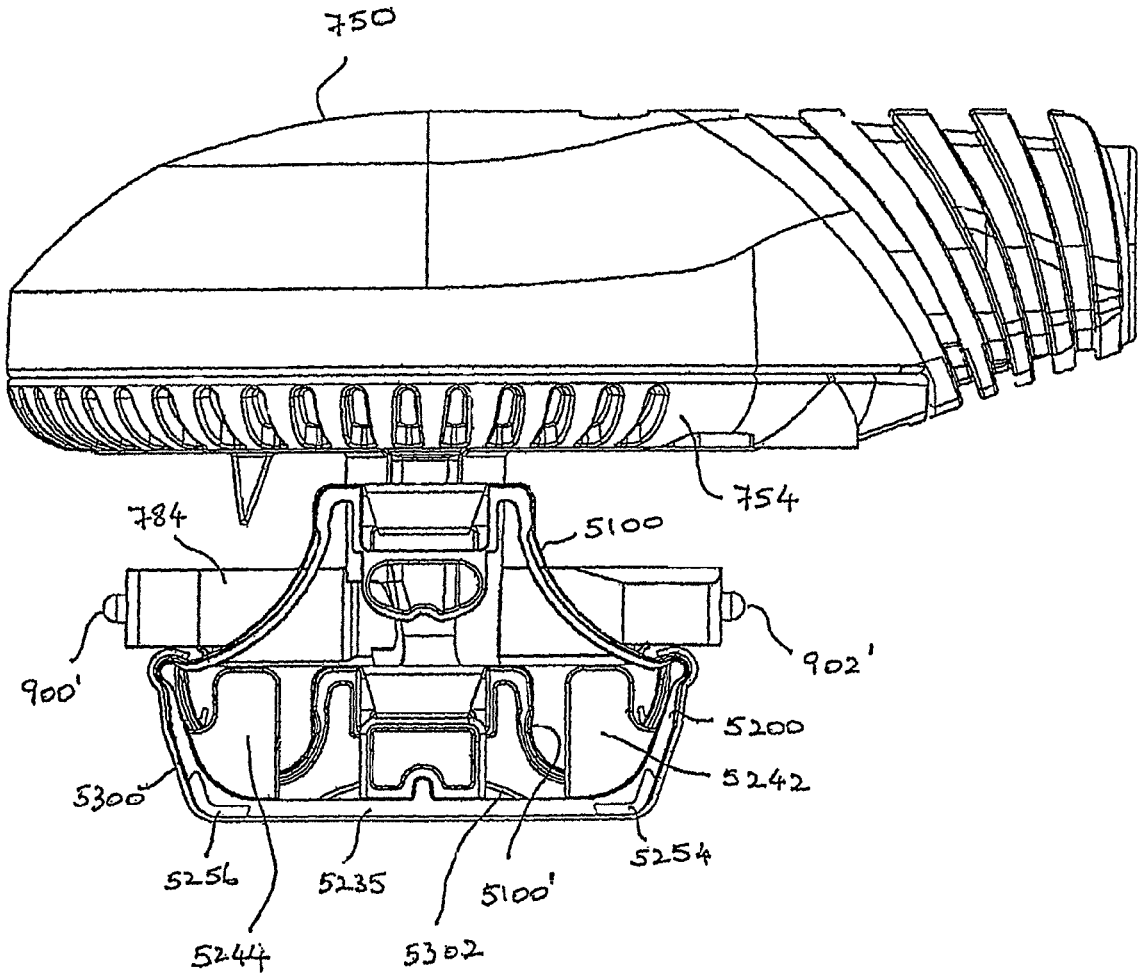
FIG. 30 shows a simplified view of the arrangement of FIG. 29 with some of the components of the track section removed.
Figure 31:
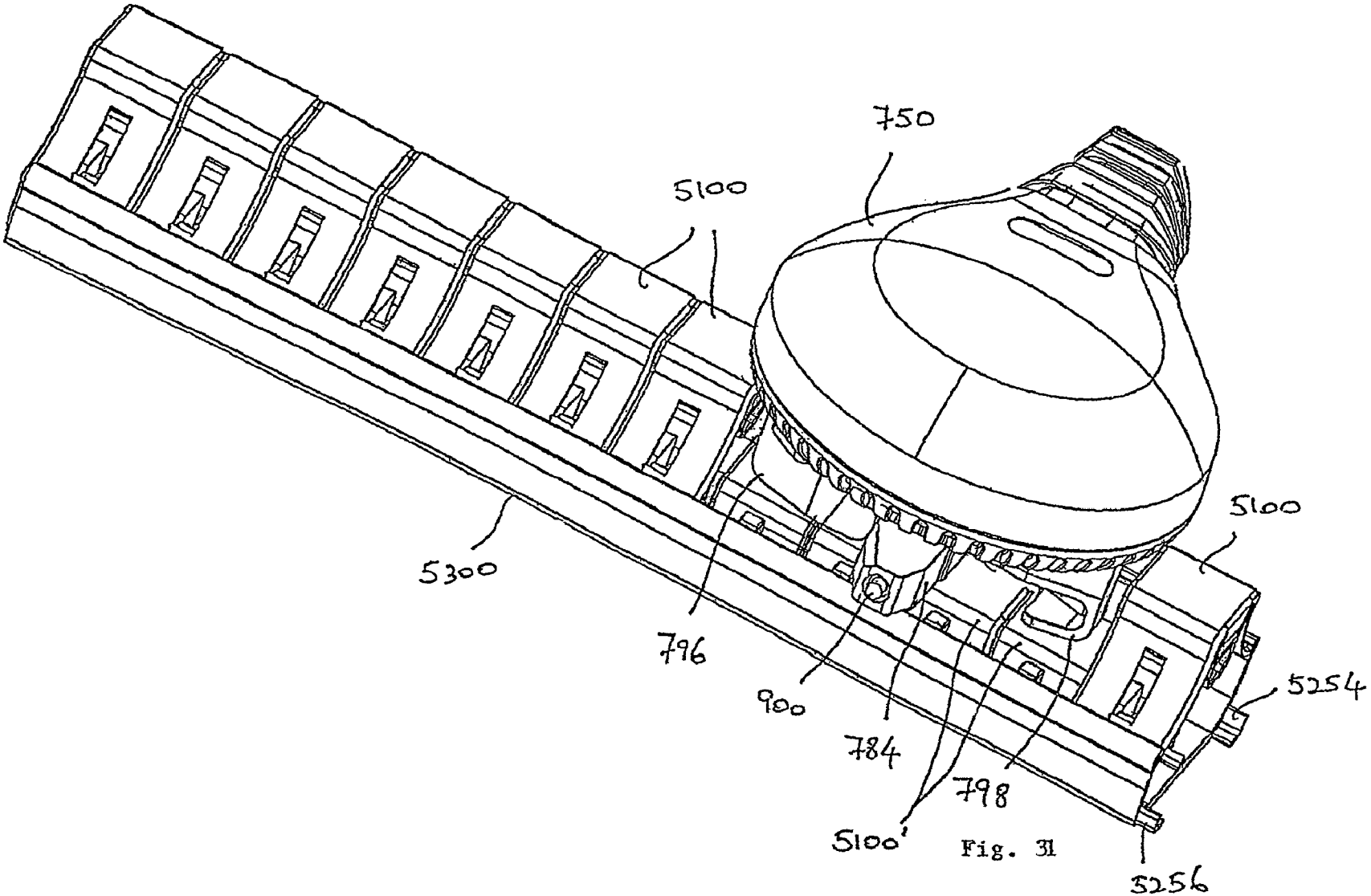
FIG. 31 illustrates a perspective view of FIG. 30.

To show the arrangement of FIG. 29 in more detail, a simplified view is shown in FIG. 30 with some of the components of the track section 100 removed. FIG. 31 further illustrates the arrangement of FIG. 30 in a perspective view to more clearly show how the contact arm 784 and protection members 796,798 displaces four of the conductive members 5100 with the plug 750 in an engaged position. Note that the first module 5200 (the module with the lugs 5254,5256 being depicted in FIG. 31) is not displaced and FIG. 29 thus shows the conductive element 5100 in an uncollapsed state.

With the conductive members 5100 in modular form, it is easier to replace and service any of the members 5100 and corresponding modules 5200. Since each of the conductive members 5100 is separately supported, each of them can be individually displaced by a plug 750. This helps to create a "zero" gap between the plug and the conductive members 5100 that are not displaced as shown in FIG. 31. This improves a safety aspect of the track section.

Figure 32:
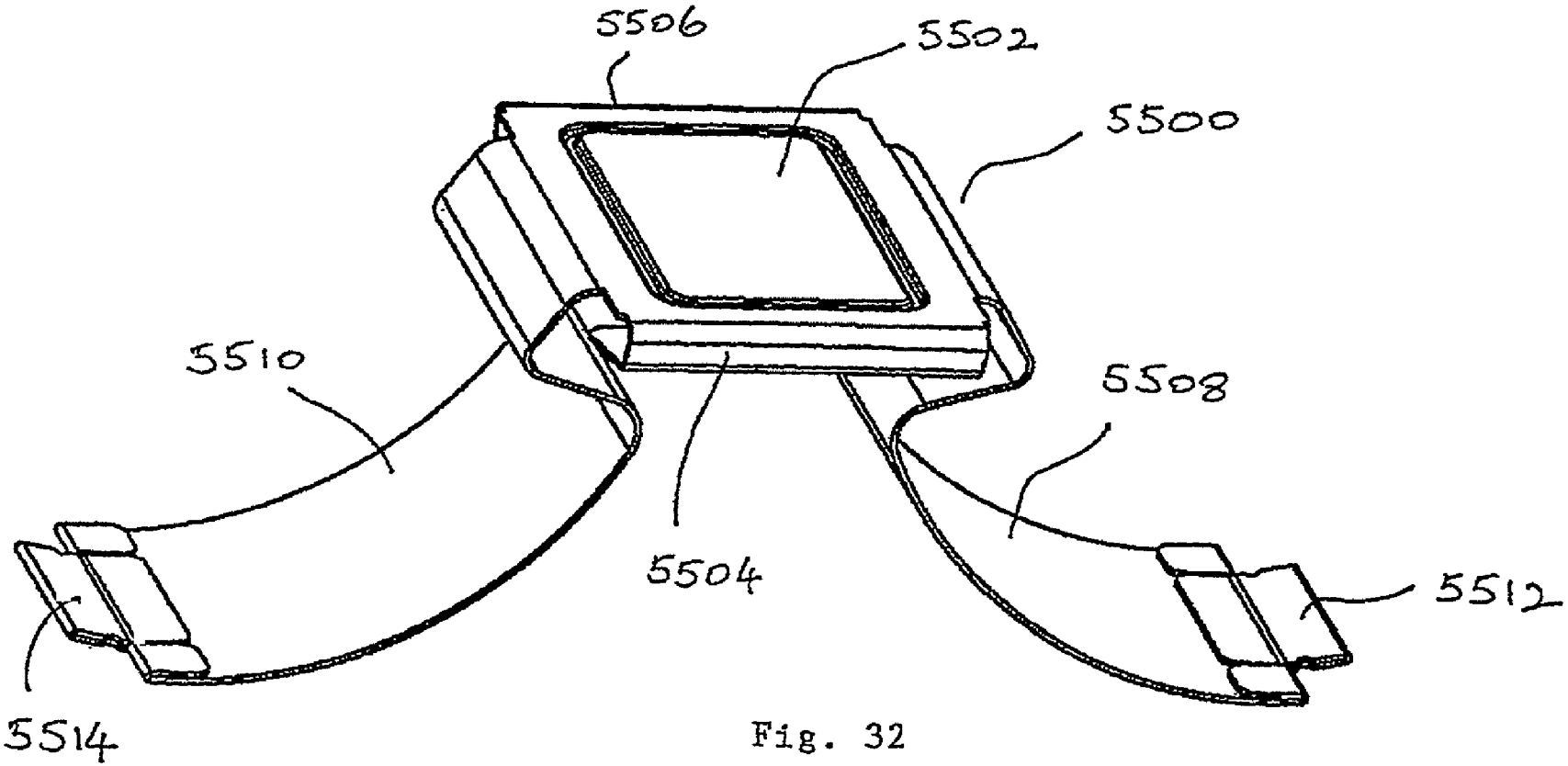
FIG. 32 is a perspective view of a variation of the conductive member of FIG. 19.

The conductive member 5100 may be in other suitable forms such as a flexible conductive member 5500 shown in FIG. 32 obviating a need for a separate support module 5200.

Figure 33:
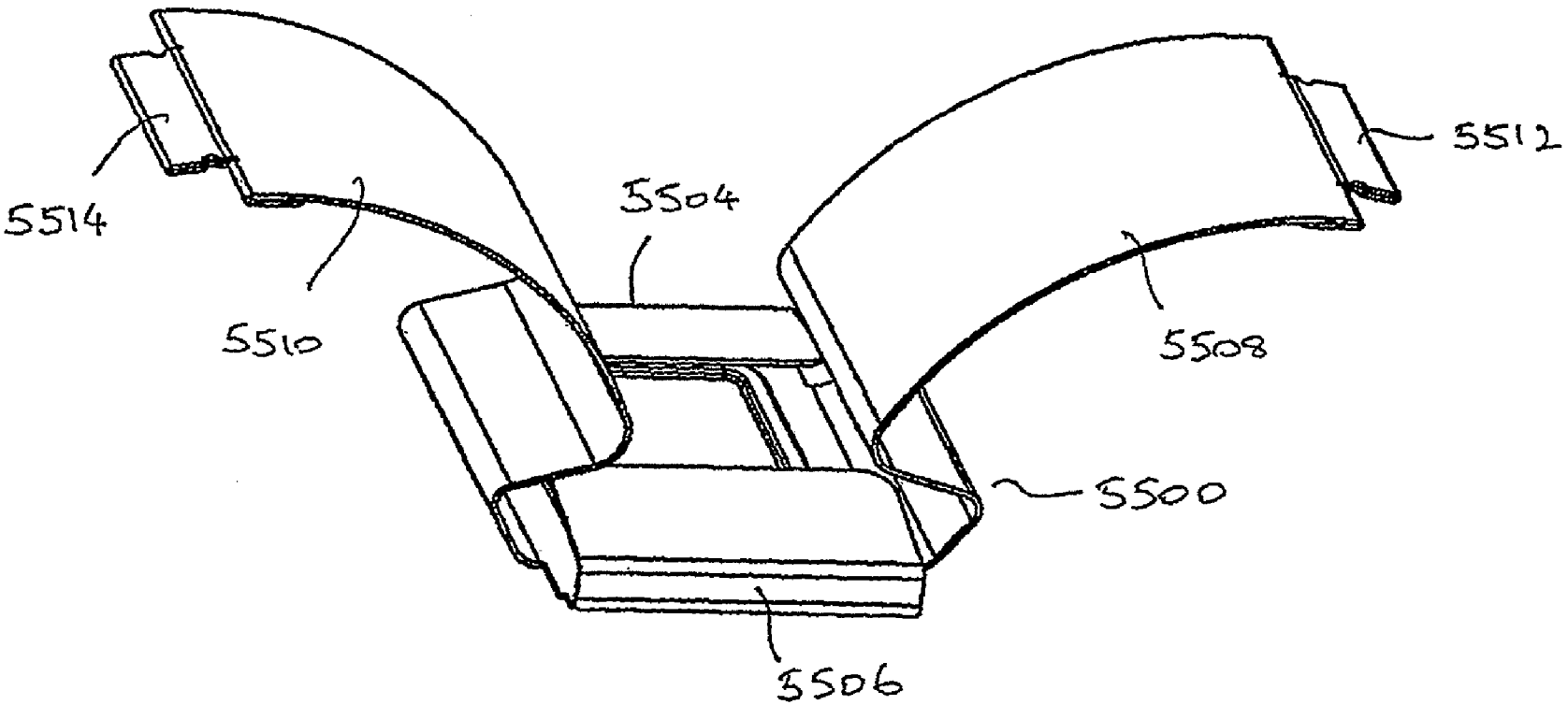
FIG. 33 is a bottom perspective view of the conductive member of FIG. 32.
Figure 34:
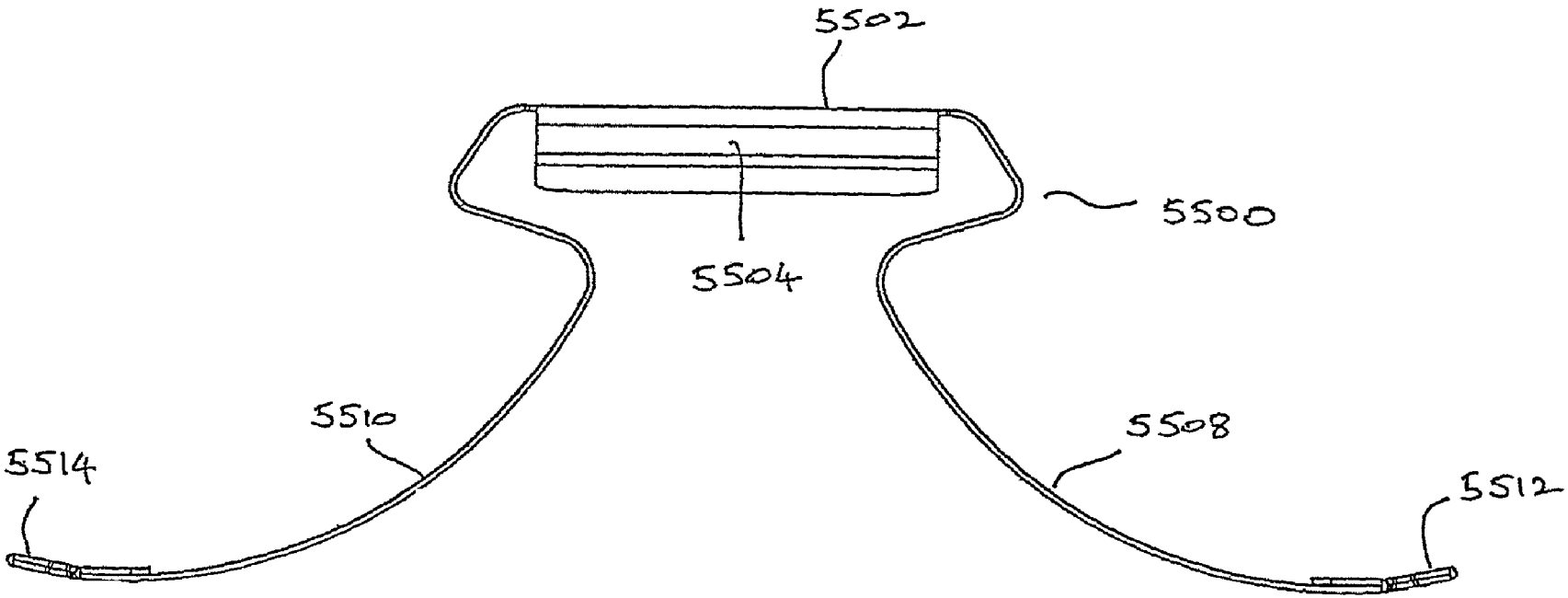
FIG. 34 is an end view of the conductive member of FIG. 32.

The conductive member 5500 is produced from a single piece of stainless steel strip and stamped into the desired shape. The conductive member 5500 has a flat rectangular abutment surface 5502 with two side portions 5504,5506 folded inwards below the surface 5502 to form a steel cap as shown in FIG. 33 which is a bottom perspective view of the conductive member 5500. Further, two side legs 5508,5510 extend between the side portions 5504,5506 in opposing directions to support the surface 5502. Each side leg 5508, 5510 arcuates inwards to resiliently support the surface 5502 to give a biasing or springing effect as is more clearly shown in FIG. 34. At the end of each leg 5508,5510 is a flat lug 5512,5514 arranged to be located in respective slots formed in a support tray 5600, which is a variation of the elongate support tray 5300 of FIG. 25.

Figure 35:
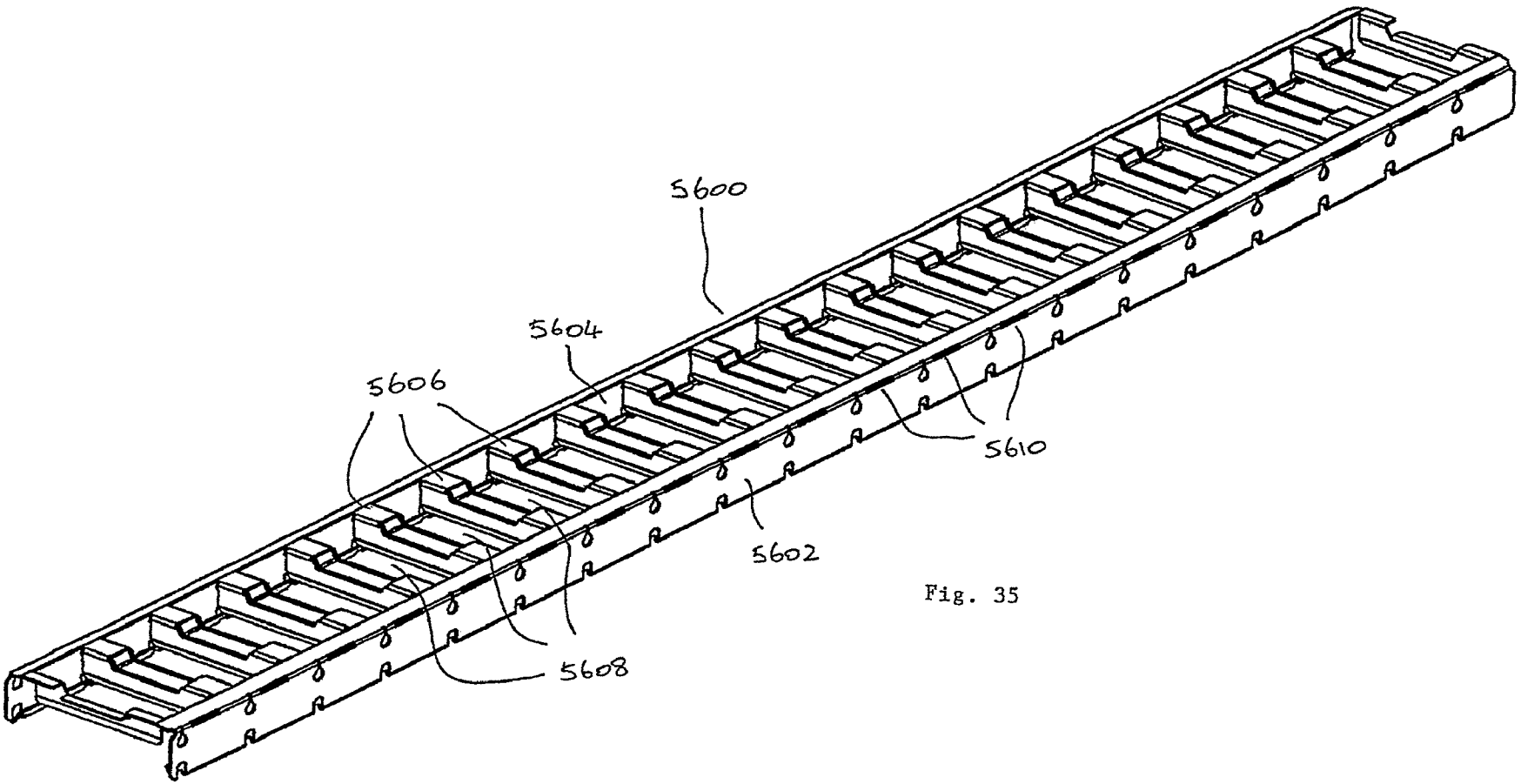
FIG. 35 is a perspective view of a variation of the support tray of FIG. 25 which is adapted to receive the conductive member of FIG. 32.

FIG. 35 is a perspective view of the support tray 5600 which is conductive and elongate in shape to span the length of the track section 100. As shown, the support tray 5600 is similar in function as the support tray 5300 of FIG. 25 but adapted to receive the conductive members 5500. The tray 5600 has side walls 5602,5604 and a number of equally spaced raised dividers 5606 and between pairs of dividers 5606 are cavities 5608 arranged to receive a conductive member 5500. The support tray 5600 also has pairs of elongate slots 5610 formed along the side walls 5602,5604 and which is arranged to receive the lugs 5512,5514 of the conductive member 5500.

Figure 36:
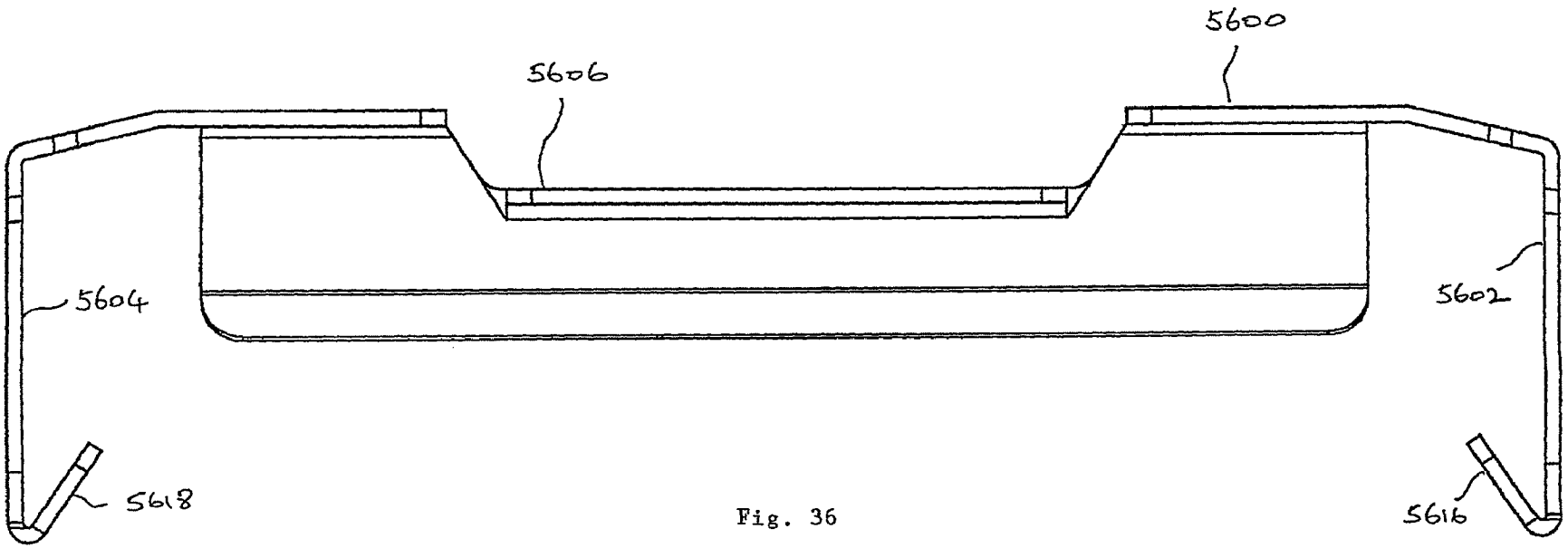
FIG. 36 is an end view of the support tray of FIG. 35.

FIG. 36 illustrates an end view of the tray 5600 which shows that the side walls 5602,5604 have bent edges 5616, 5618 to facilitate the arrangement of the tray 5600 in a track section.

The assembly of the conductive member 5500 on the tray 5600 and in a track section will now be described.

Figure 37:
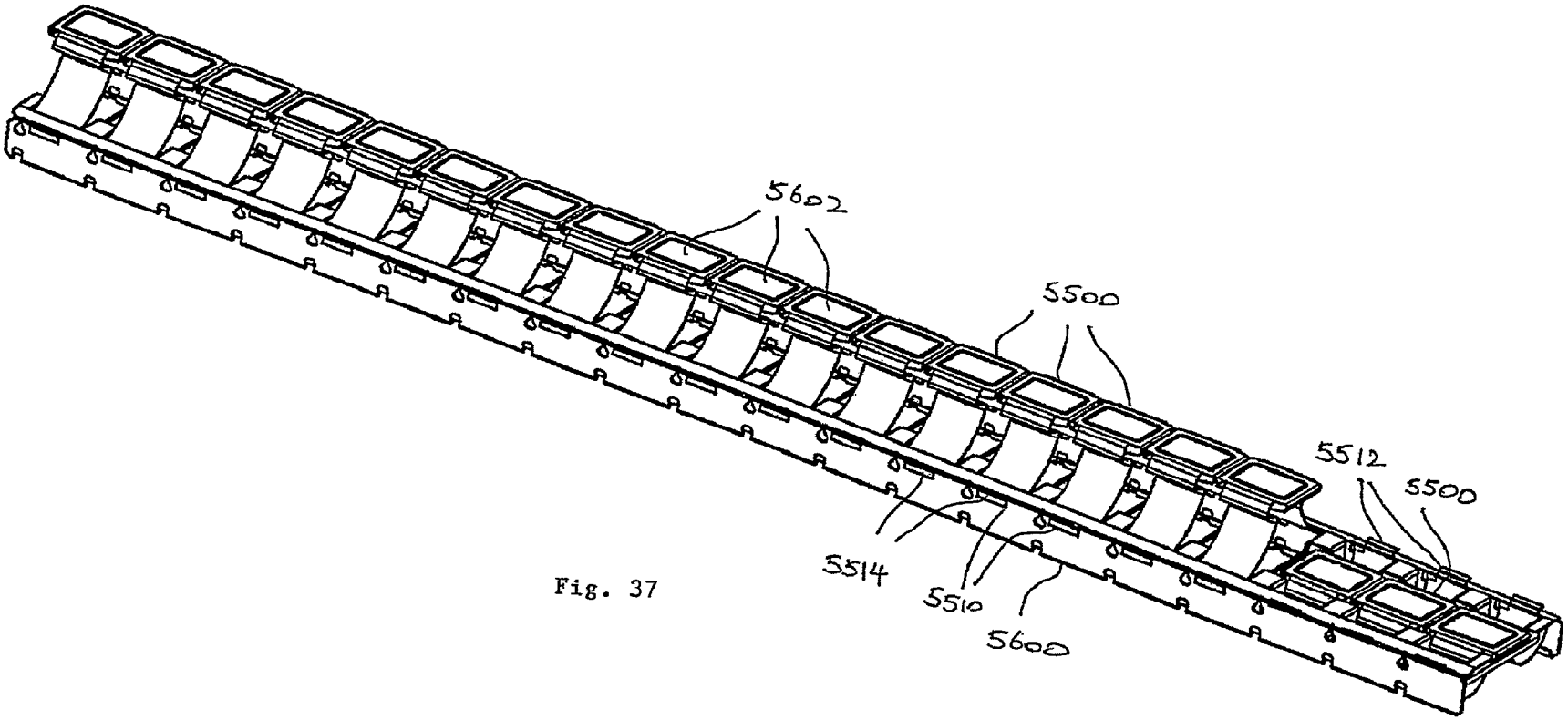
FIG. 37 illustrates a plurality of conductive members of FIG. 32 being assembled on the tray of FIG. 35.
Figure 38:
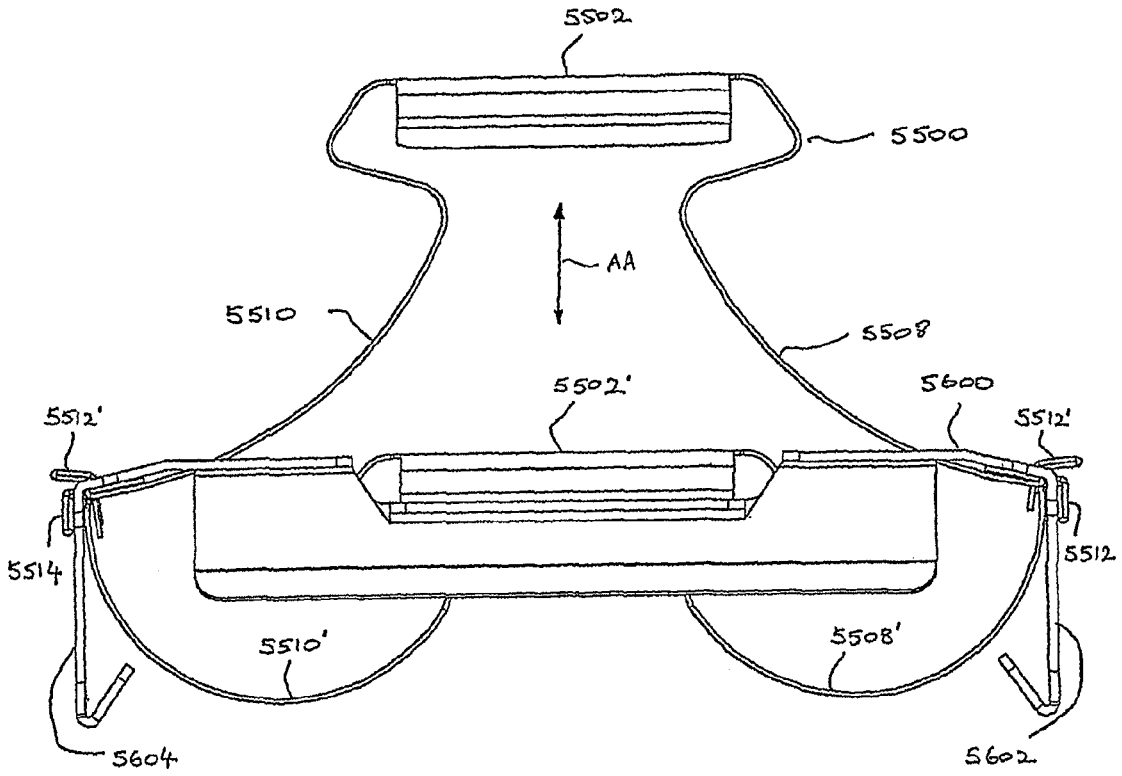
FIG. 38 is an end view of the assembly of FIG. 37 depicting how the conductive members are received in the tray.

FIG. 37 depicts a plurality of conductive members 5500 assembled on the tray 5600 with three of the conductive members 5500 illustrated as being displaced in a similar manner as FIG. 27. FIG. 38 is an end view of the assembly of FIG. 37 illustrating two positions of the conductive member 5500 (as indicated by arrow AA). In a first position, the conductive member 5500 is not depressed as shown by the stretched legs 5508,5510 and the lugs 5512,5514 received in corresponding slots 5610 and pointed in a downward direction. When a contact arm 784 of a plug 750, such as that shown in FIG. 29, is used to engage the conductive member 5500 (normally, a few of these would be engaged by the contact arm 784), the abutment surface 5502' sinks to the second position (a prime symbol is used at the end of each reference numeral to indicate the change in position of each part) with the legs 5508',5510' in compressed positions as shown in FIG. 38. The lugs 5512', 5514' in the second position are pointed sideways as illustrated.

The two positions of the lugs 5512,5514 alleviate accidental slippage of the conductive member 5500 out of the tray 5600 and this provides a method of easily securing the conductive members 5500 to the tray 5600.

Figure 39:
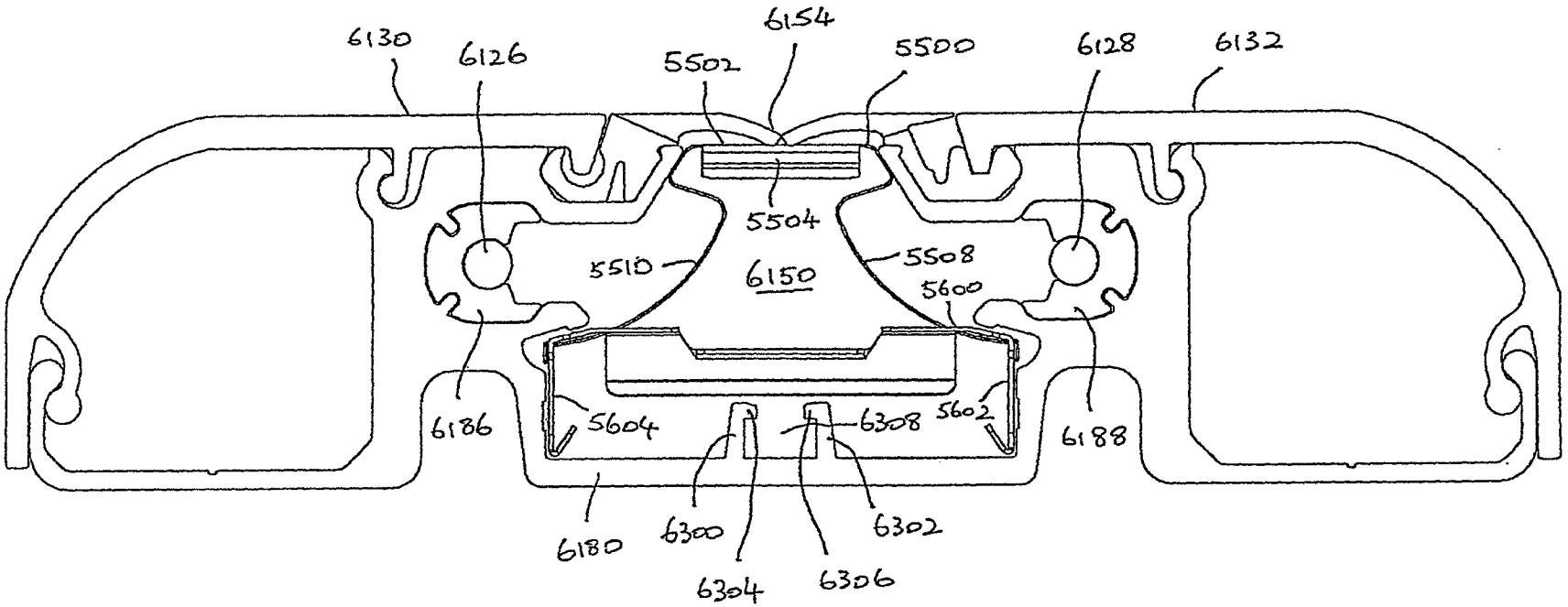
FIGS. 39 and 40 illustrates how the assembly of FIG. 38 is arranged in a track section.
Figure 54:
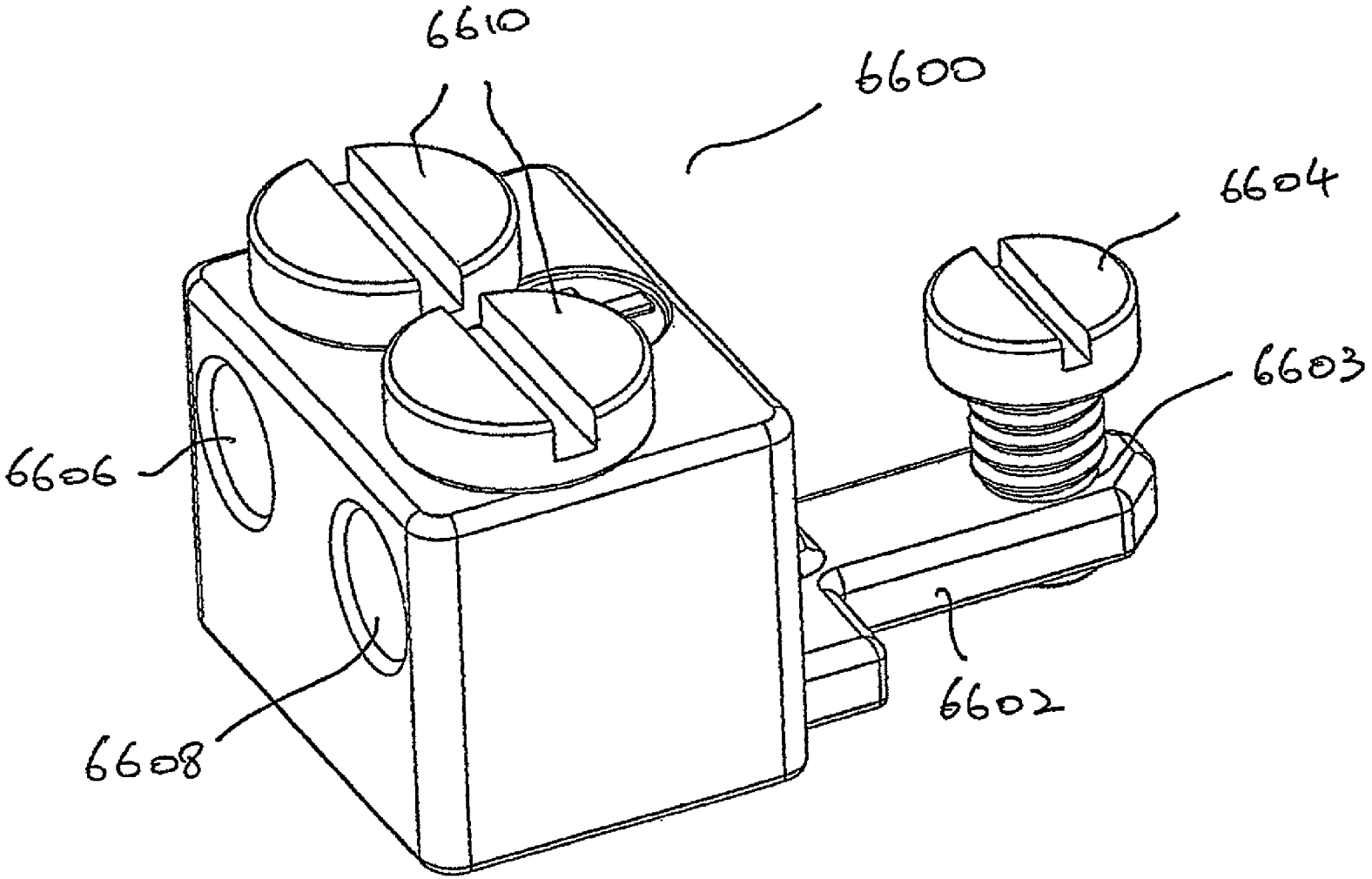
FIG. 54 shows a grounding member for grounding the track section of FIG. 39.

After assembly, the conductive members 5500 and the tray 5600 are arranged in a track section of the power supply apparatus as shown in FIG. 39. The track section is similar to that shown in FIGS. 17 and 18 and similar parts have similar reference numerals with the addition of 2000. The main difference between this variation and the embodiment of FIG. 17 relates to the structure of the base 6180 and this has two arms 6300,6302 spaced apart and which project upwards towards the flaps 6154. The free end 6304,6306 of each arm 6300, 6302 bends inwards towards each other and the cavity 6308 created therein is used to receive a grounding member 6600 such as that shown in FIG. 54 to electrically earth the base structure 6180.

Figure 55:
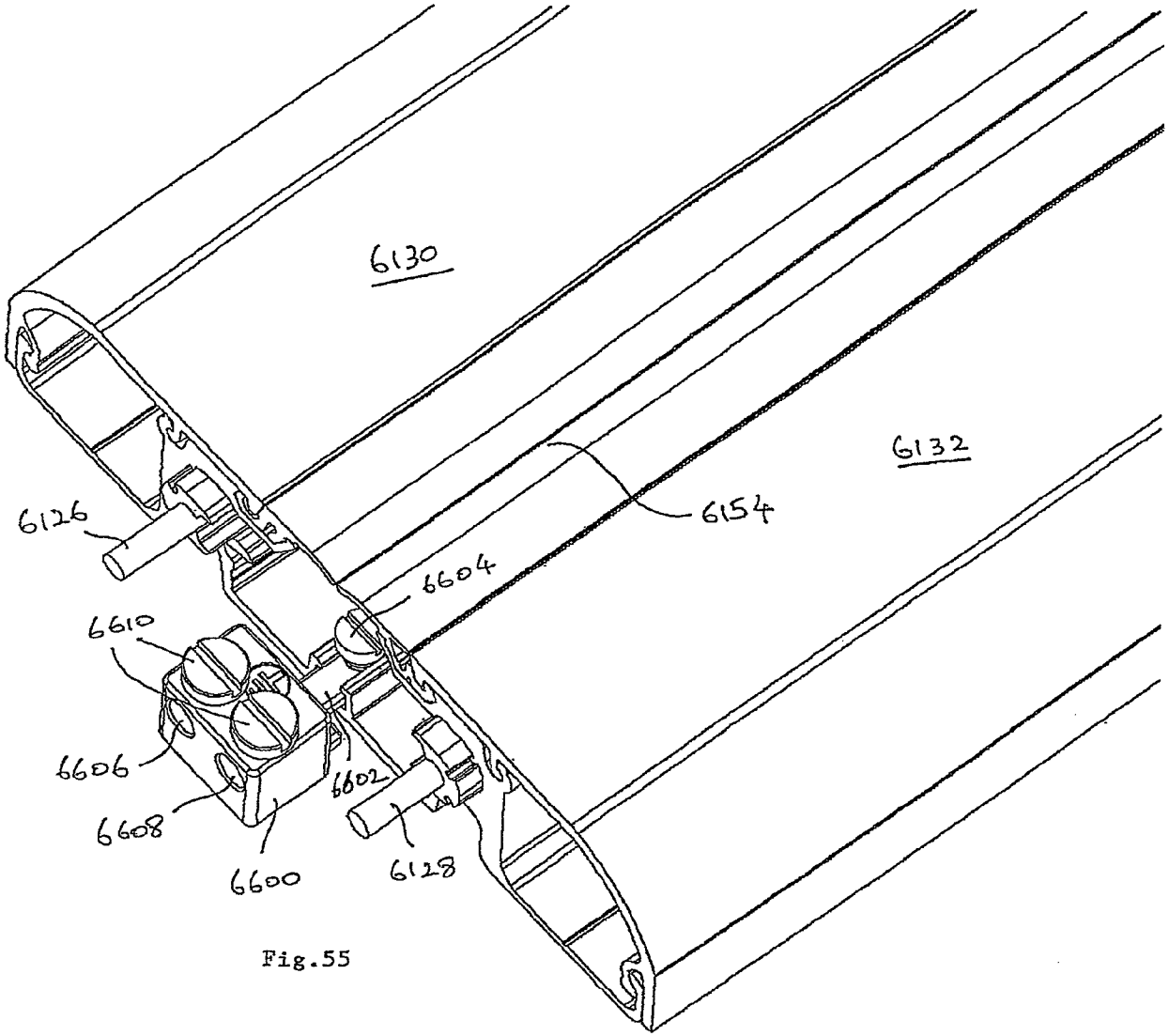
FIG. 55 is a perspective view of the track section of FIG. 39 connected to the grounding member of FIG. 54.

The grounding member 6600 has an extension arm 6602 arranged to be inserted into the cavity 6308. Further a screw 6604 is used to engage the two free ends 6304,6306 of each arm 6300,6302 so as to fixedly couple the grounding member 6600 to the track section via a threaded hole 6603 in the extension arm 6602 as illustrated in FIG. 55 and also to electrically connect the extension arm 6602 to the two arms 6300,6302. At the other end, the grounding member 6600 has two apertures 6606,6608 arranged to receive at least one electrical wire (not shown) connected to electrical earth and the wire is fixed in place using either one of two further screws

6610. When connected, the electrical wire is electrically connected to the extension arm 6602 which thus earth the base structure 6180.

The cavity 6150 formed between the base member 6180 and the covers 6130,6132 are shaped differently to accommodate the conductive members 5500 and the support tray 5600. As it will be appreciated, since the tray 5600 is electrically connected to the base 6180, each conductive member 5500 is also electrically grounded.

Figure 40:
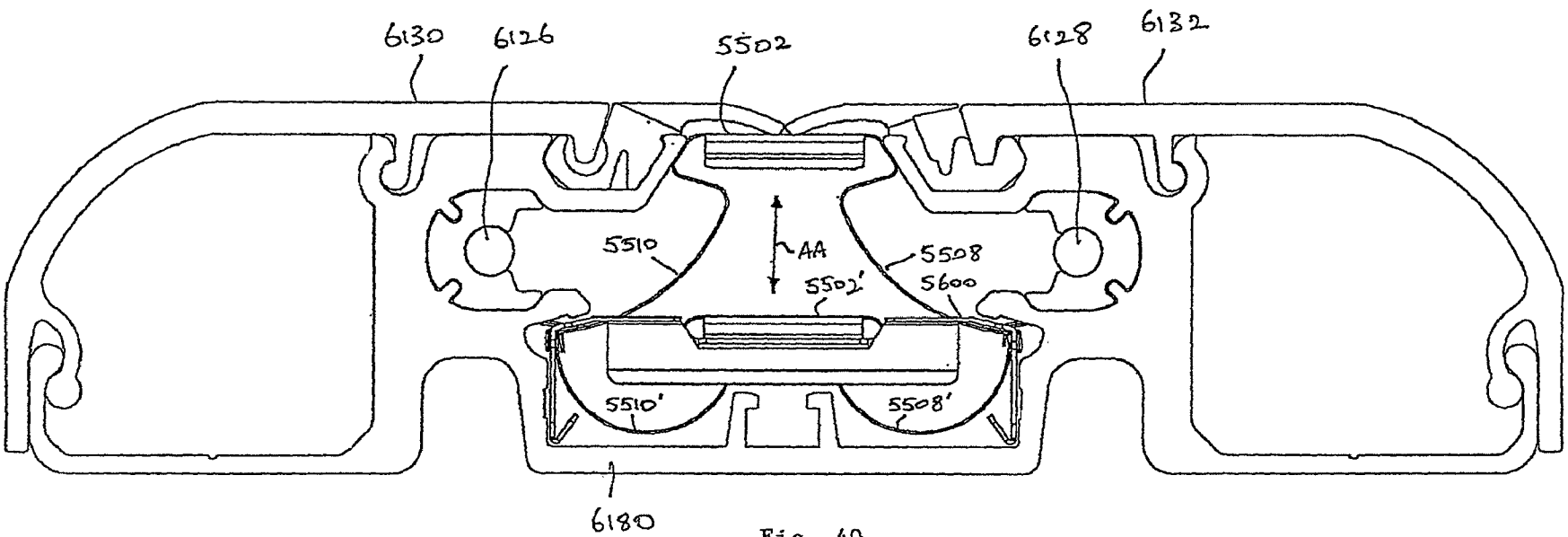

FIG. 40 illustrates the biasing motion of the conductive member 5500 in the track section which is similar to that explained for FIG. 37 (without showing the plug 750 to engage the conductive members 5500).

The conductive member 5500 in the variation depicted in FIG. 32 is easier to manufacture and reduces production costs since it alleviates a need for the support modules 5200.

Figure 41:
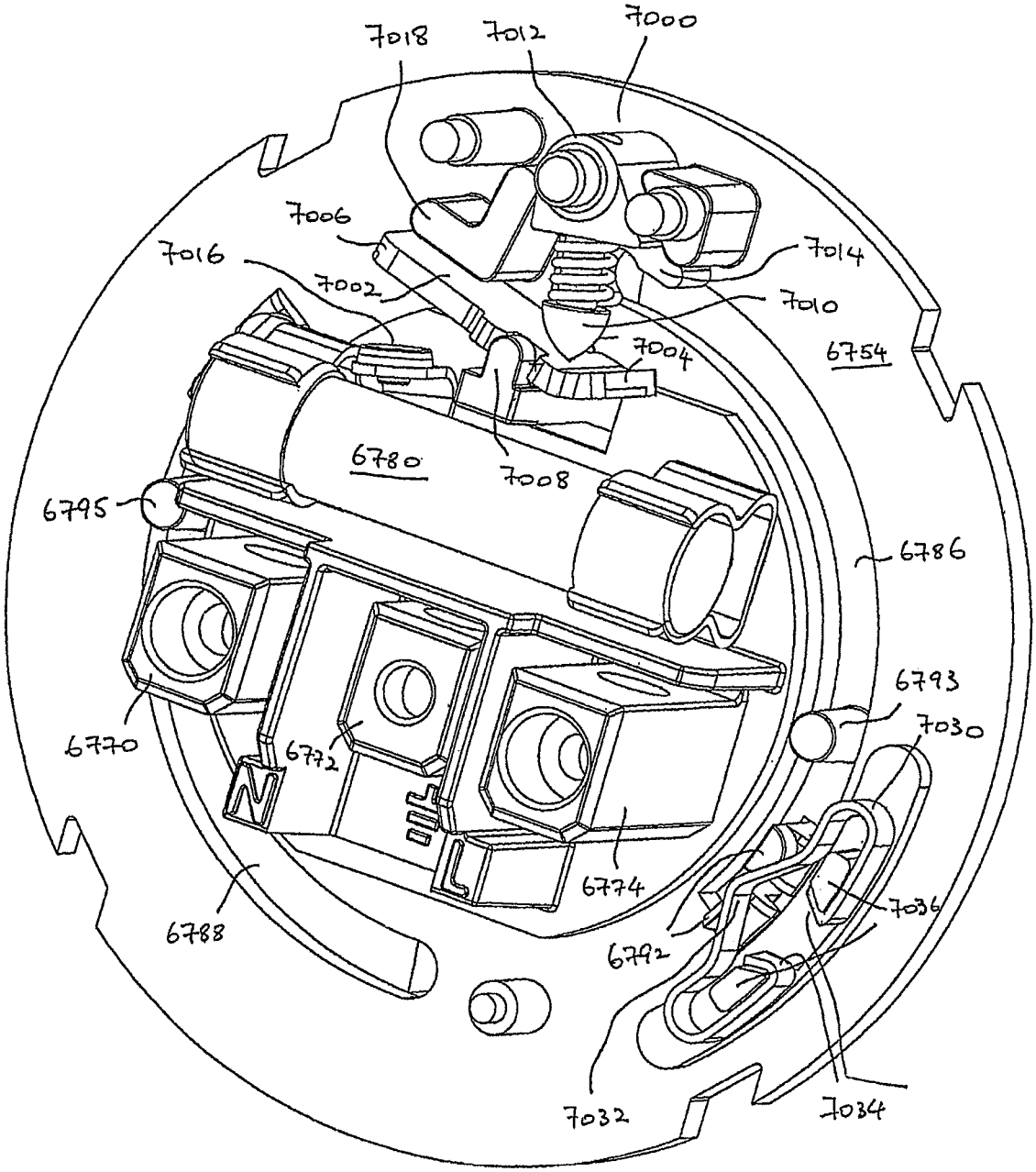
FIG. 41 illustrates a variation of the electrical plug of FIG. 12 which includes a switch in "OFF" position.

A further variation of the power plug 750 of FIG. 12 is shown in FIG. 41 with similar parts having similar reference numerals with the addition of 6000. With reference to FIG. 13, it can be seen that the protruding contact heads 900',902' are connected directly to the terminals 770,774 via the angular elements 934,936. This means that when the plug 750 is rotated and the heads 900', 902' engage the corresponding "Live" and "Neutral" conductors 6126,6128 (using the embodiment of FIG. 39 as an example), a "arching" effect may be created between the heads 900',902' and the respective conductors 6126,6128 which is undesirable. To alleviate this effect, the variation illustrated in FIG. 41 has a switch 7000 to selectively close the "circuit" after the heads 6900', 6902' engage the corresponding conductors 6126,6128.

In FIG. 41, the cover 6752 (not shown) is removed to reveal the internal parts of the plug 6750. Three conductive terminals 6770,6772,6774 function as power outlets and are used to receive electrical wires from an electrical appliance and a fuse 6780 is arranged to prevent over-current similar to the earlier embodiment. Semi-circular channels 6786,6788 are also formed near the circumference of the base 6754. The channels 6786,6788 allow a flange member 6790 similar to that shown in FIG. 12 to be attached. However, the flange member 6790 includes actuating members 6793,6795 formed near corresponding snap fit catches 6792, each actuating member 6793,6795 protrudes from the channels 6786,6788 as shown in FIG. 41. One of the actuating members 6793 (in this case) is used to control the switch 7000 to turn the switch 7000 "ON" or "OFF".

The switch 7000 comprises an elongate lever 7002 which is used to electrically link the contact 6902' to the terminal 6774. The lever 7002 is preferably made of copper clad with silver as the outer layer. The lever 7002 has two ends 7004,7006 and is pivoted near one end 7004 by a pivot member 7008 to create a seesaw effect when acted upon by a plunger 7010. The plunger 7010 is biased by spring mechanism 7012 and moves in response to movement of a C-shaped rocker arm 7014 which is arranged along the path of the actuating member 6793 moving along one of the channels 6786.

Figure 41A:
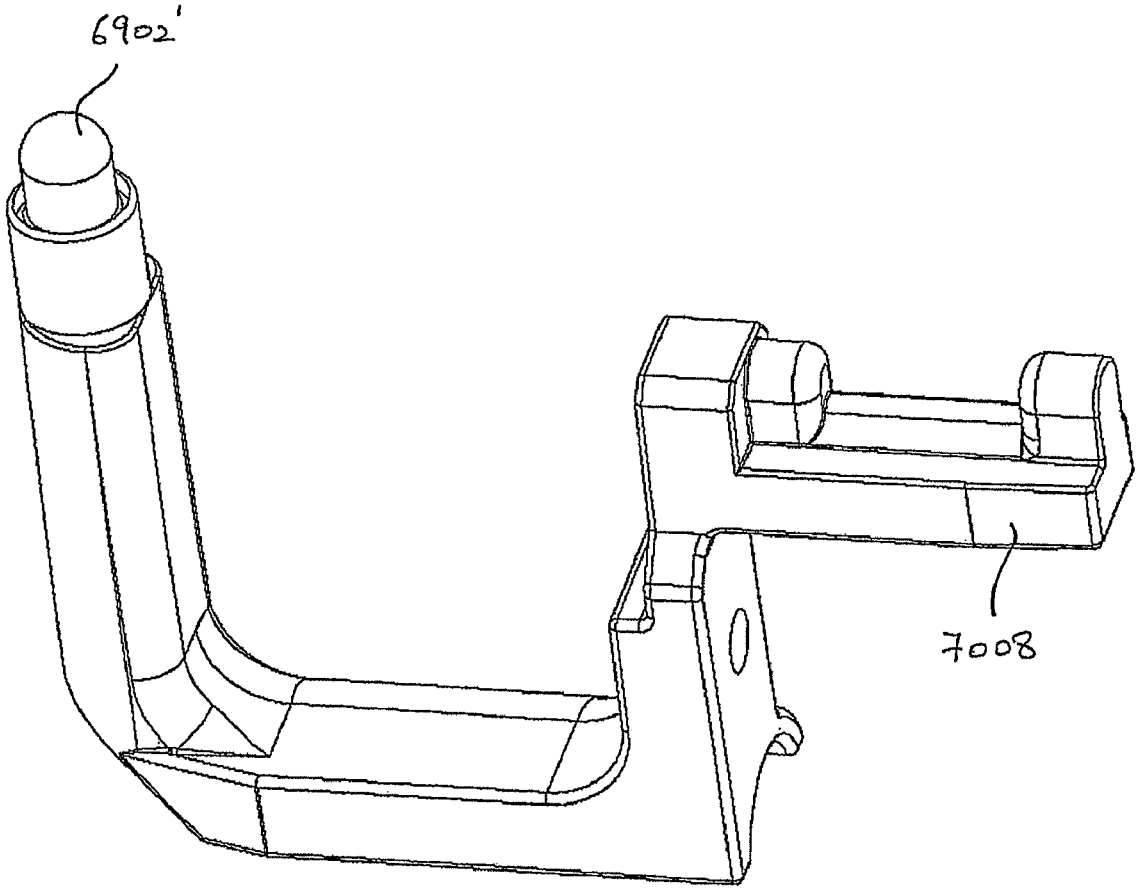
FIG. 41*a* illustrates connection of a part of the switch of FIG. 41 to a contact head.

The pivot member 7008 is conductive and is electrically connected to one of the protruding heads 6902' as illustrated in FIG. 41*a*.

Figure 42:
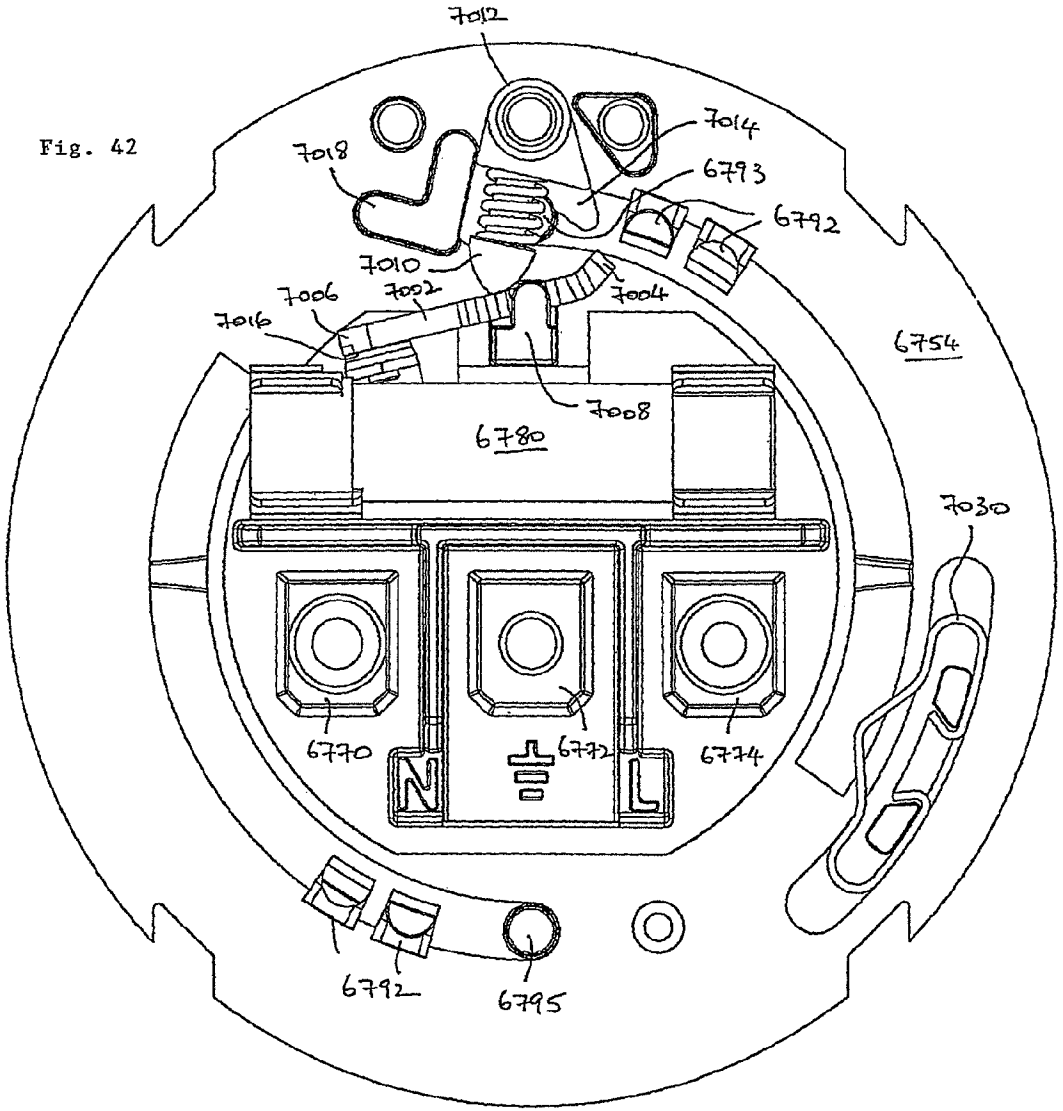
FIG. 42 illustrates the electrical plug of FIG. 41 with the switch in "ON" position.
Figure 43:
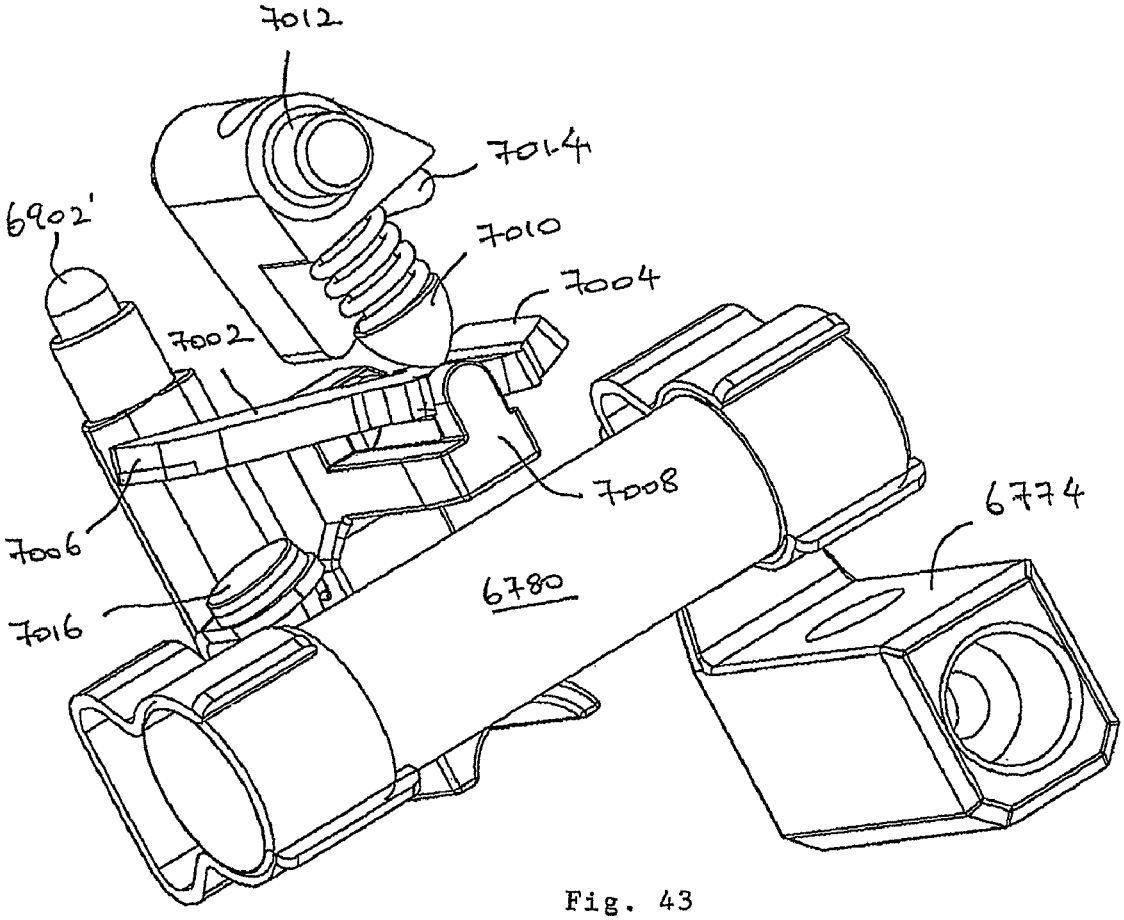
FIGS. 43 and 44 show close-up views of the switch positions of FIGS. 41 and 42 respectively.
Figure 44:
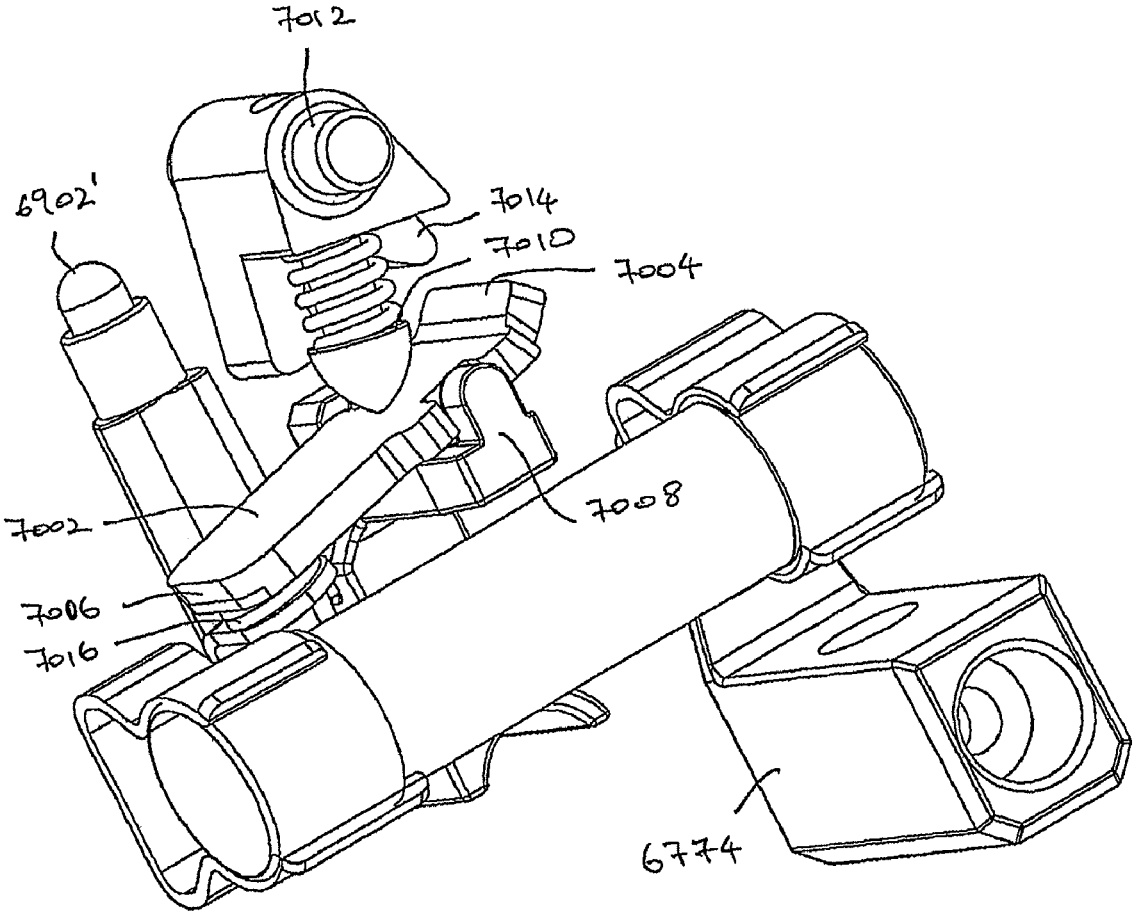

FIG. 41 shows the switch 7000 in the "OFF" state i.e. the pivot member 7008 is electrically isolated from a conductive contact surface 7016 connected to one end of the fuse 6780. FIG. 43 shows a close-up arrangement of the switch 7000 at the pivot member 7008. When acted upon, the plunger 7010 slides along the lever 7002 towards the other end 7006 and when the plunger 7010 passes the pivot point, the other end 7006 of the lever 7002 abuts against the contact surface 7016 which turns the switch 7000 "ON". This is shown in FIG. 42 as well as FIG. 44.

Thus, when the switch 7000 is in the "OFF" position, the lever 7002 is raised i.e. the end 7006 is not in contact with the contact surface 7016, such that electricity does not flow through the fuse 6780. On the other hand, when the lever's end 7006 is in contact with the contact surface 6916 i.e. the switch is in the "ON" position, electricity flows through the fuse 6780.

A detailed explanation of how the actuating member 6793 is used to control the movement of the plunger 7010 will now be described.

Figure 45:
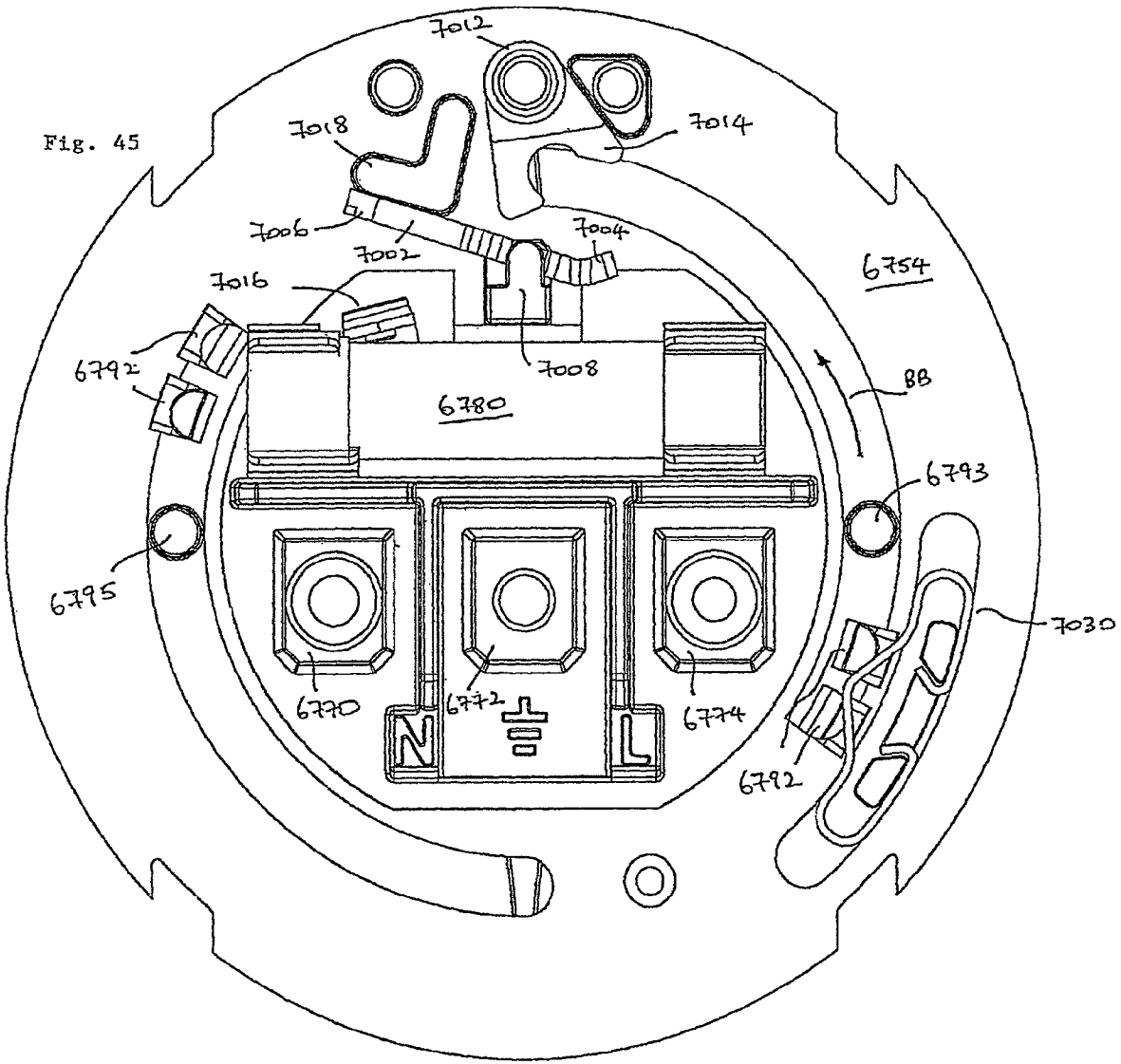
FIGS. 45 to 47 show the movement of an actuating member to actuate the switch of FIG. 41.

To insert the plug 6750 into the track section, the arm 6784 is aligned with the protection members 6796,6798 as shown in FIG. 15. The actuating members 6793,6795 are in their respective starting positions as shown in FIG. 41. After inserting into the track section, the arm 6784 depresses the conductive members 5500 (using the embodiment shown in FIG. 37 as example) and as the plug 6750 is being rotated, the flange 6790 and thus the arm 6784 move concentrically in relation to the protection members 6796,6798. The movement of the flange 6790 thus moves the actuating member 6793 towards the rocker arm 7014 of the switch 7000 as shown by arrow BB of FIG. 45 with the plunger 7010 removed to show the rocker arm 7014 more clearly. Typically, the heads 6900',6902' engage corresponding conductors 6126,6128 when the arm 6784 is at about 80° with respect to the main axis of the protection members 6796,6798. In the earlier embodiment without the switch 7000, electricity starts to flow between the terminals 770,774 (FIG. 13) at about this position but in this variation, no electricity flows between the terminals 6770, 6774 since the switch 7000 is still in the "OFF" position.

Figure 46:
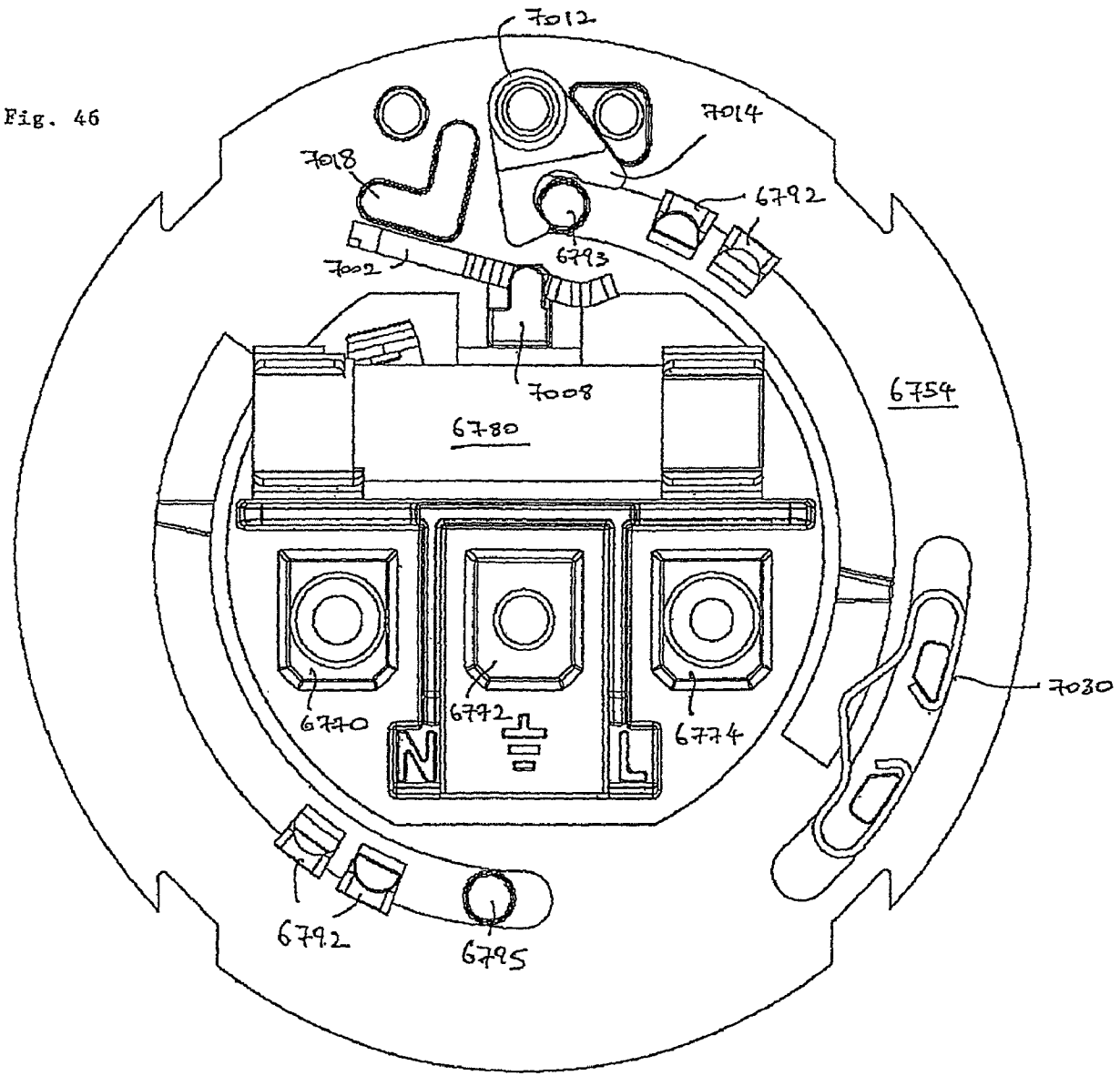
Figure 47:
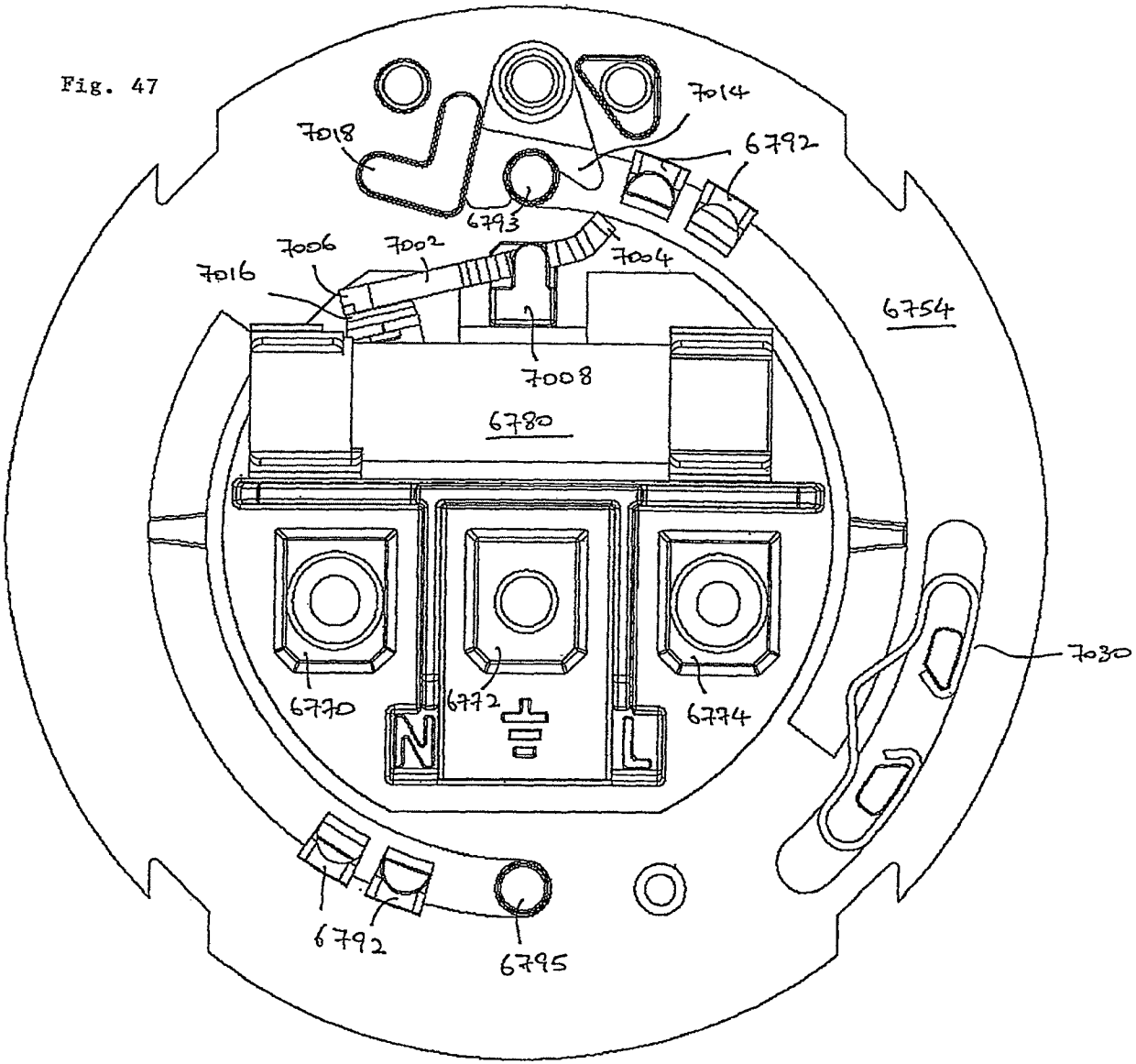

As the plug 6750 is further rotated and when the arm 6784 is about 87° with respect to the main axis of the protection members 6796,6798, the actuating member 6793 is received in the rocker arm 7014 as shown in FIG. 46. Further rotation of the plug 6750 urges the rocker arm 7014 to swing to the position shown in FIG. 47 and this also cause the plunger 7010 to slide across the lever 7002 to turn the switch 7000 to the "ON" position as shown in FIG. 42, and thus electricity flows between the "live" and "neutral" terminals 6770,6774. In this position, the arm 6784 is about 90° with respect to the protection members 6796,6798 as shown in FIG. 16.

The use of the switch 7000 provides a delay between the engagement of the conductors 6126,6128 by the contact heads 6900', 6902' and when electricity flows through the terminals 6770,6774. The arching effect between the contact heads 6900',6902' and the conductors 6126,6128 is thus transferred to the switch 7000 and with the arching effect also being minimised due to the swift connection created by the lever 7002 when urged to move by the plunger 7010.

When the plug 6750 is rotated in a reverse direction to disconnect from the track section, the lever 7002 is first to "break" contact with the contact surface 7016 compared to the contact between the contact heads 6900',6902' and the conductors 6126,6128. As the flange 6790 is rotated with respect to the base 6754 in the reverse direction of arrow BB, the actuating member 6793 "rocks" the rocker arm 7014 in the other direction back to the position shown in FIG. 46. This action swings the plunger 7010 to slide along the lever 7002 towards the end 7004 to elevate the other end 7006 of the lever thus isolating the pivot member 7008 from the contact surface 7016 which stops electricity flow. At this point, the contact heads 6900',6902' are still engaged with the conductors 6126, 6128 but electricity is already cut. Further rotation of the plug 6750 disengages the actuating member 6793 from the rocker arm 7014 until the actuating member 6793 is back to its starting position which is when the arm 6784 is aligned with the protection members 6796,6798 as shown in FIG. 15.

Thus, before the contact heads 6900',6902' are disengaged from the conductors 6126,6128, the switch 7000 breaks the electricity flow thus preventing an arching effect between the contact heads 6900, 6902' and the conductors 6126,6128.

Figure 48:
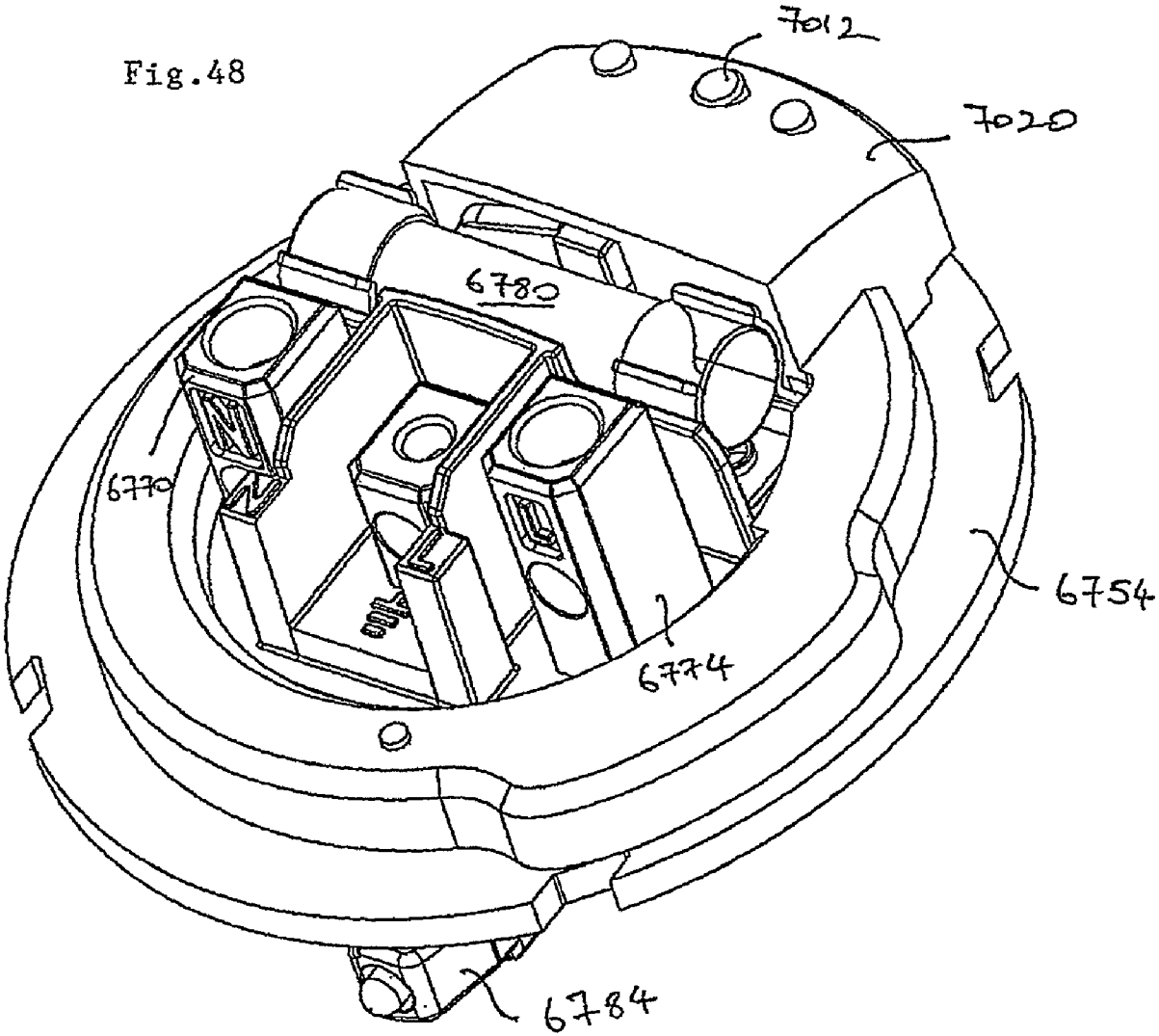
FIG. 48 is a perspective view of the plug of FIG. 41 including a switch cover.

In this variation, the plug 6750 also includes a L-shaped stopper 7018 arranged to abut against part of the rocker arm 7014 when the switch 7000 is in the "ON" position and against part of the lever 7002 when the switch 7000 is in the "OFF" position. These are illustrated respectively in FIGS. 47 and 45. The stopper 7018 thus acts to control the movement of the rocker arm 7014 as well as the lever 7002. The plug 6750 is also provided with a switch cover 7020 for covering the switch 7000 and this also secures the spring mechanism 7012, as shown in FIG. 48.

Further, the plug 6750 also includes a sound producing device in the form of a clicking device 7030 formed near the starting position of the actuating member 6793 as shown in FIG. 41. The clicking device 7030 includes a piece of resilient metal strip adapted to form a protruding centre portion 7032 with ends 7034 arranged round two support elements 7036 formed on the base 6754. The protruding centre portion 7032 is engaged by one of the snap-fit catches 6792 thus creating a "clicking" sound whenever the catch 6792 travels over the protruding portion 7032.

Figure 49:
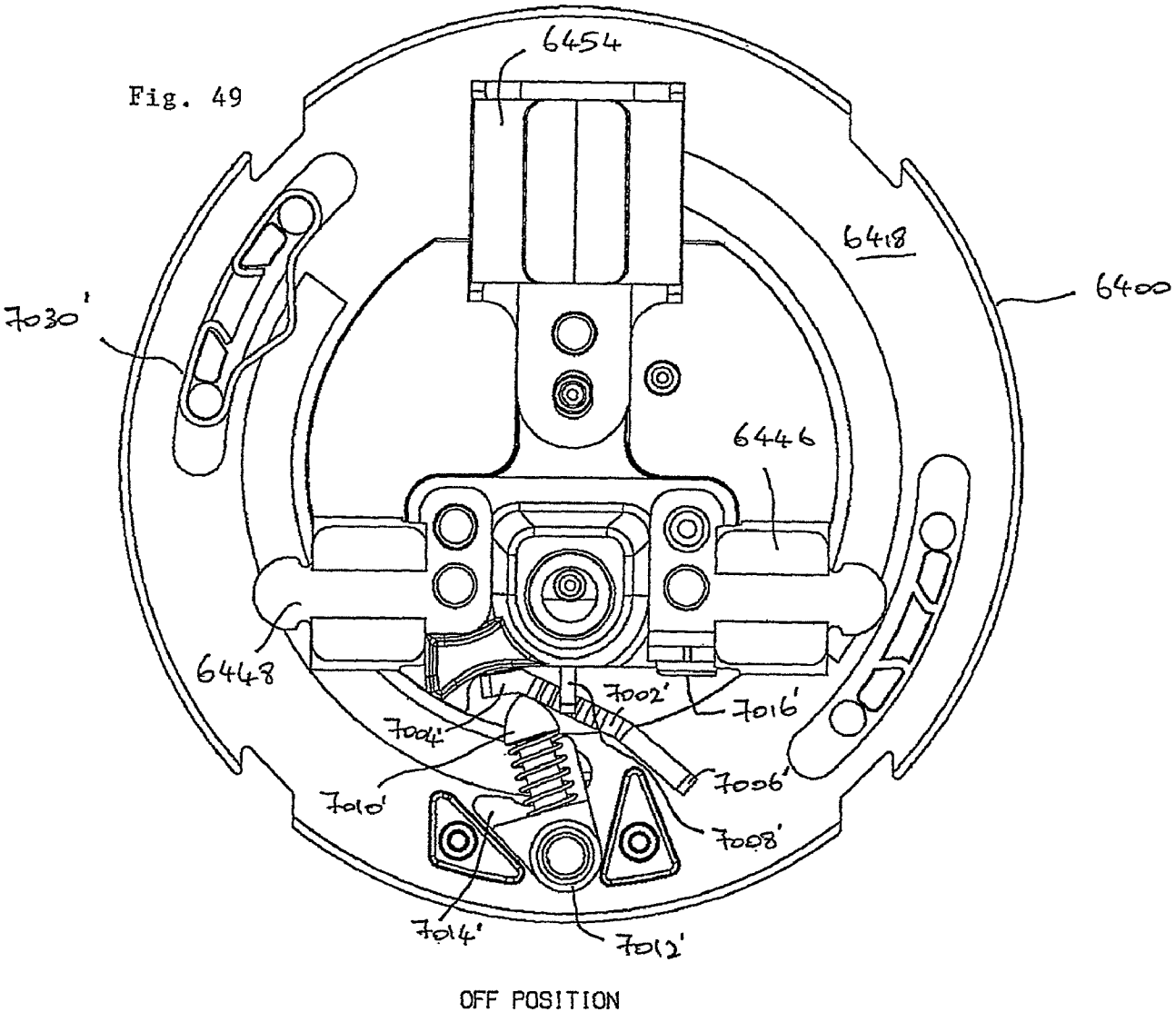
FIG. 49 shows a variation of a power point connector of FIG. 2 which includes a switch in the "OFF" position similar to that shown in FIG. 41.
Figure 50:
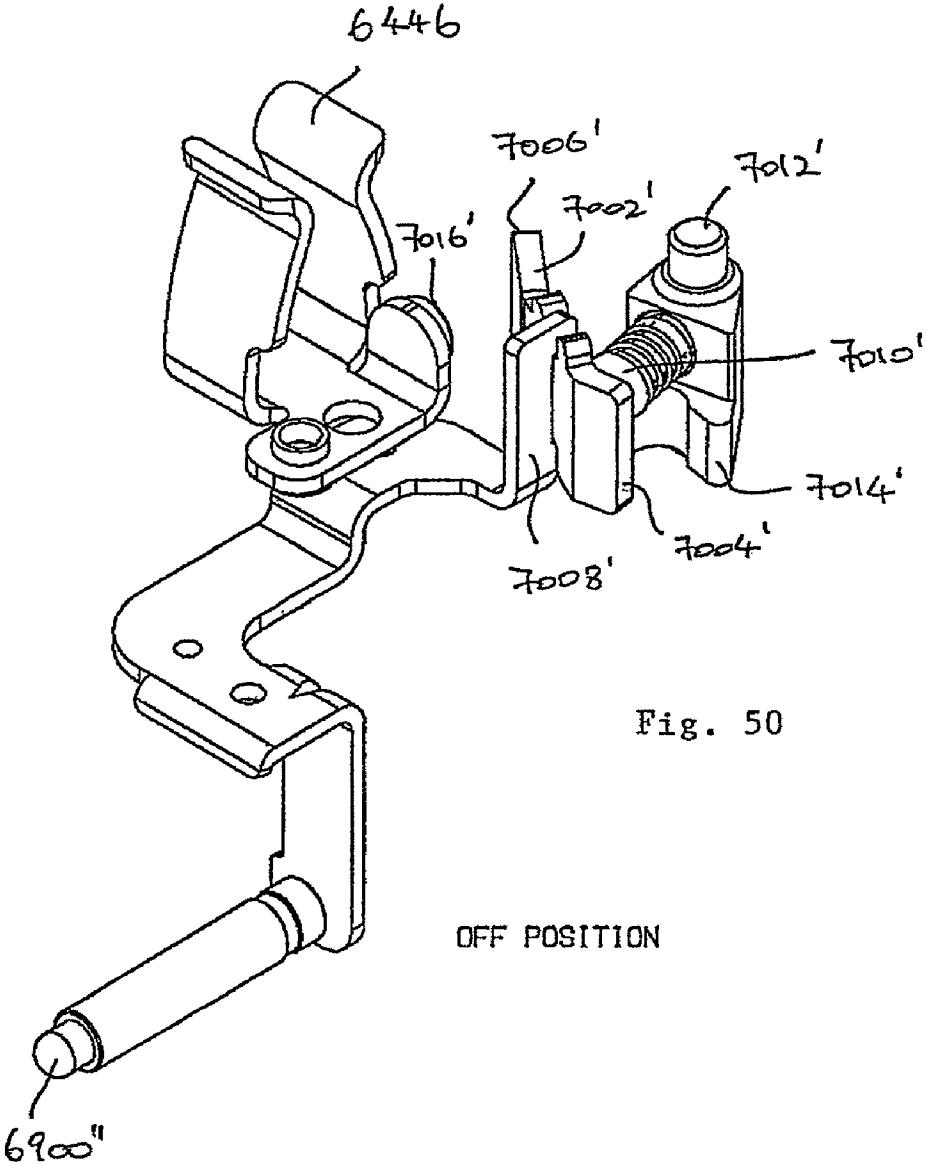
FIGS. 50 and 51 show close-up views of the switch of FIG. 49 and how the switch is connected to a female member and a contact head.
Figure 51:
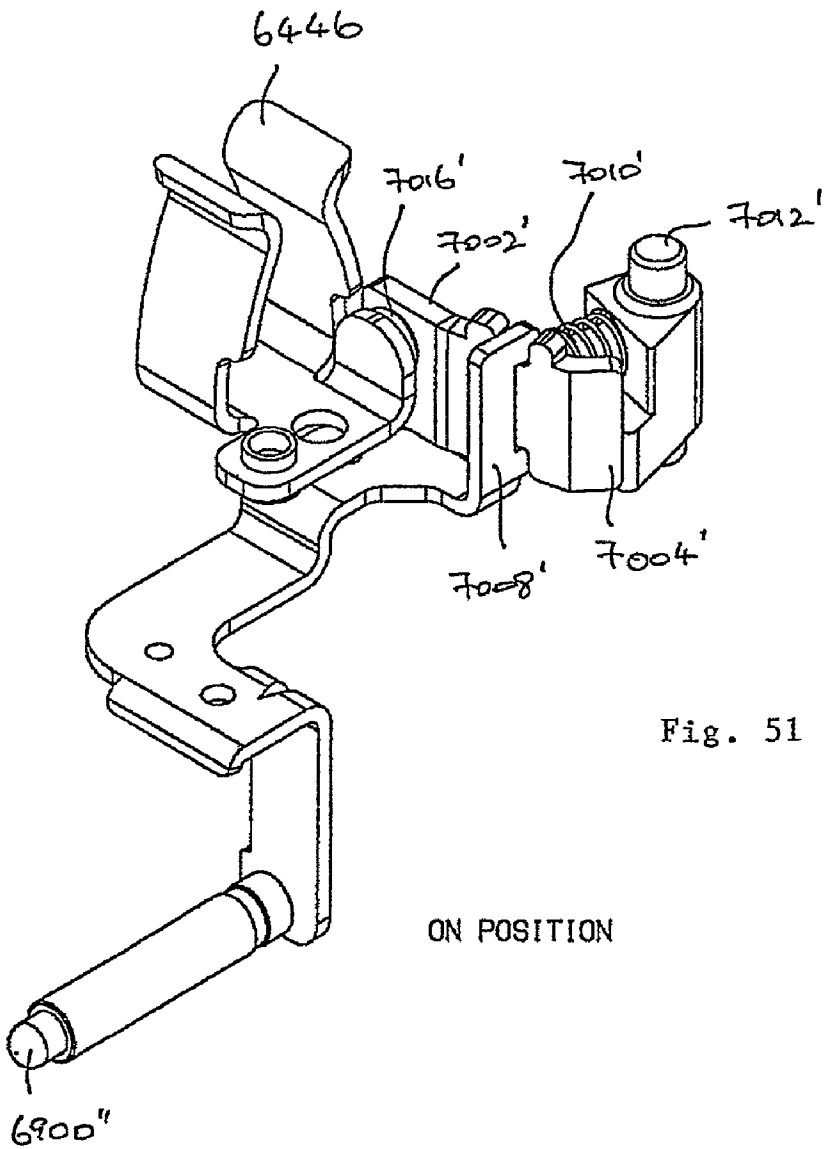

The switch 7000 can also be adapted to be provided in the power point connector 400 of FIG. 2 and FIG. 49 shows an end view of such a variation of the connector 6400. Similar parts have similar reference numerals with the addition of 6000. The power point connector 6400 has a base 6418 and supporting mechanism similar to that described earlier for connector 400. The connector 6400 also has female members 6446,6448,6454 arranged to receive a three-pin electrical plug of a UK type. FIGS. 50 and 51 depict how a switch 7000' (to differentiate from the switch 7000 used in the plug 6750 although both are generally the same) is used to control the flow of electricity from a contact head 6900" to one of the female members 6446.

Figure 52:
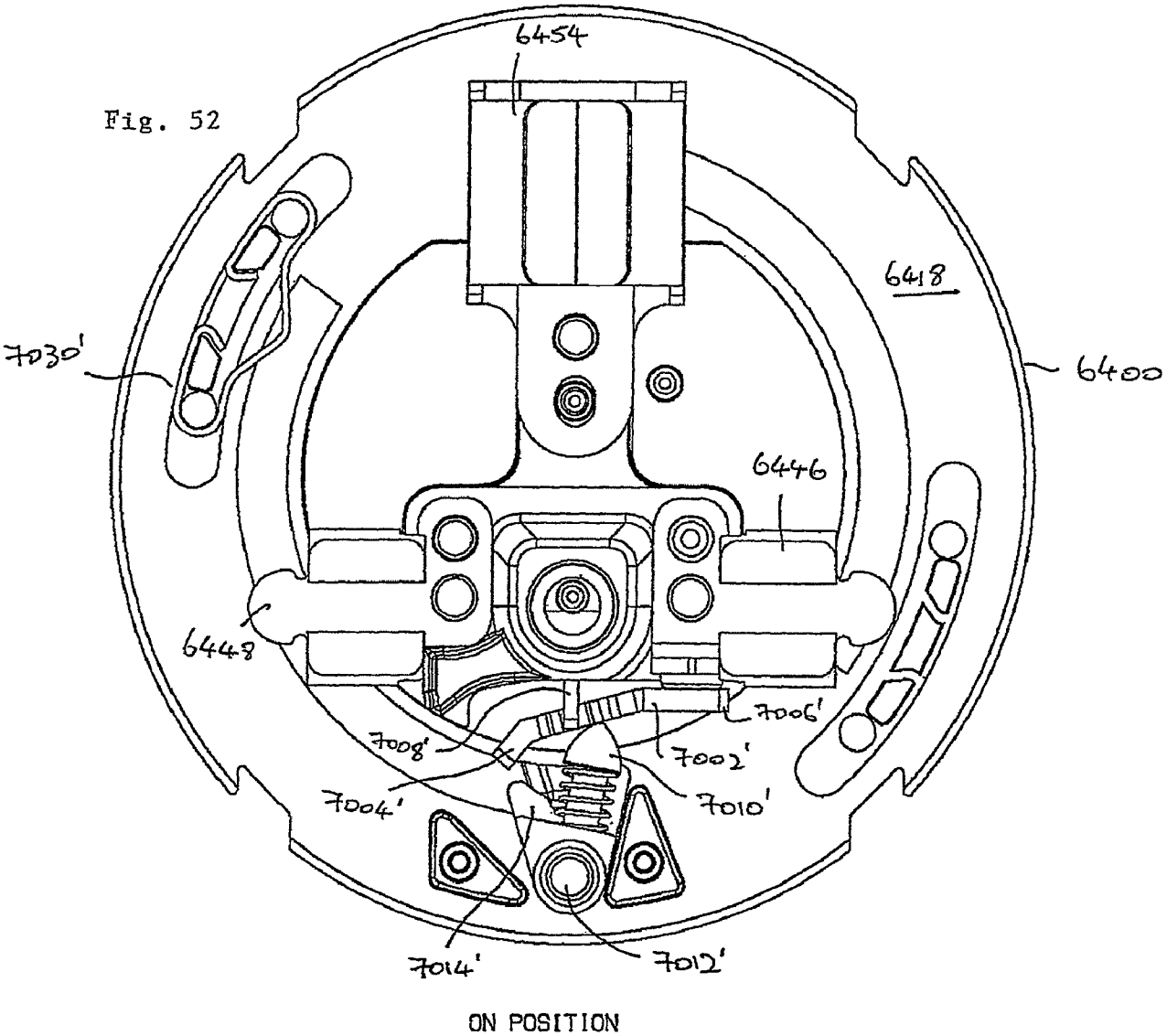
FIG. 52 depicts the connector of FIG. 49 with the switch in "ON" position.

As illustrated in FIG. 50, in the "OFF" state, the contact head 6900" is electrically isolated from the female member 6446 and the electrical connection is controlled by the switch 7000'. An actuating member 6793' is also provided in a flange member 6420 for engaging the rocker arm 7014' to urge the plunger 7010' into motion. The lever 7002' thus moves in response to the position of the plunger 7010' alternating between the "OFF" position shown in FIG. 50 and the "ON" position shown in FIGS. 51 and 52. In the "ON" position, the lever 7002' is in contact with the contact surface 7016' to connect the female member 6446 electrically to the contact heads 6900' (and thus the conductors 6126,6128).

Figure 53:
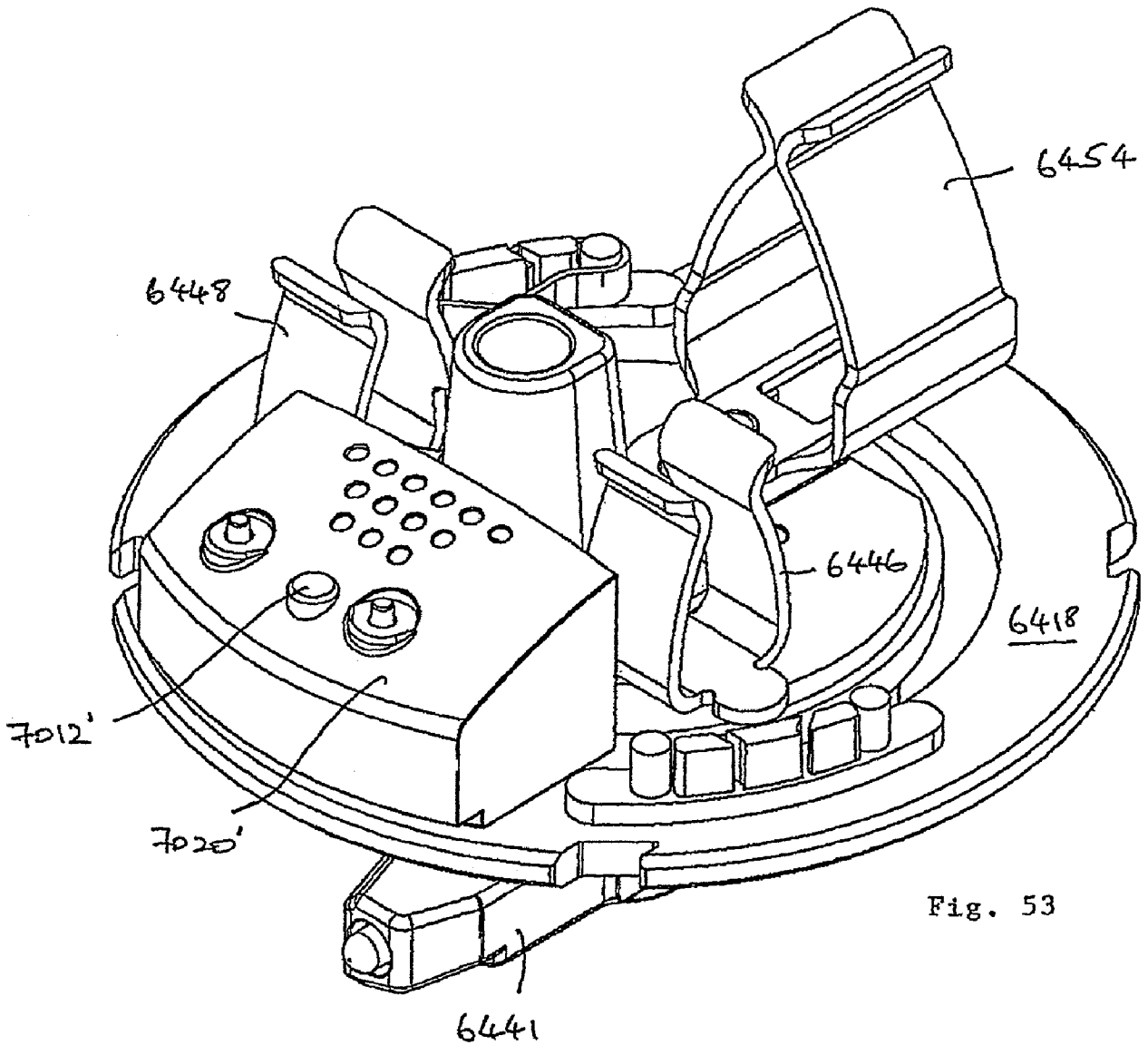
FIG. 53 shows the connector of FIG. 49 including a switch cover.

Similar to the plug 6750, a switch cover 7020' can also be used to cover the switch 7000' and secure the spring mechanism 7012', as shown in FIG. 53. Further, a clicking device 7030' (see FIG. 49) can similarly be provided in the connector 6400 to produce sounds to notify the user when the arm 6441 is aligned so that the connector 6400 can be disengaged from the track section. The described embodiments should not be construed as limitative. In the support module 5200, lugs 5254,5256 are used to align like support modules together but connection means can be used as long as the connection means is near the base 5235 and which does not interfere with the biasing of the support portion 5202.

In FIG. 31, the plug 750 is depicted as displacing four of the conductive members 5100 and support modules 5200. It should be apparent that this is not necessary the case and depending on design, the plug 750 and/or conductive members 5100 and/or support modules 5200 can be adapted so that more or less conductive members 5100 are displaceable by the plug 750.

The support member 5200 may be in other suitable forms such as a resilient spring coil supporting a steel cap (conductive member 5100). In addition, the conductive members 5100 with the support members 5200 may be used as "shutters" which occludes the slot 4154 without a need for protective flaps.

Figure 5:
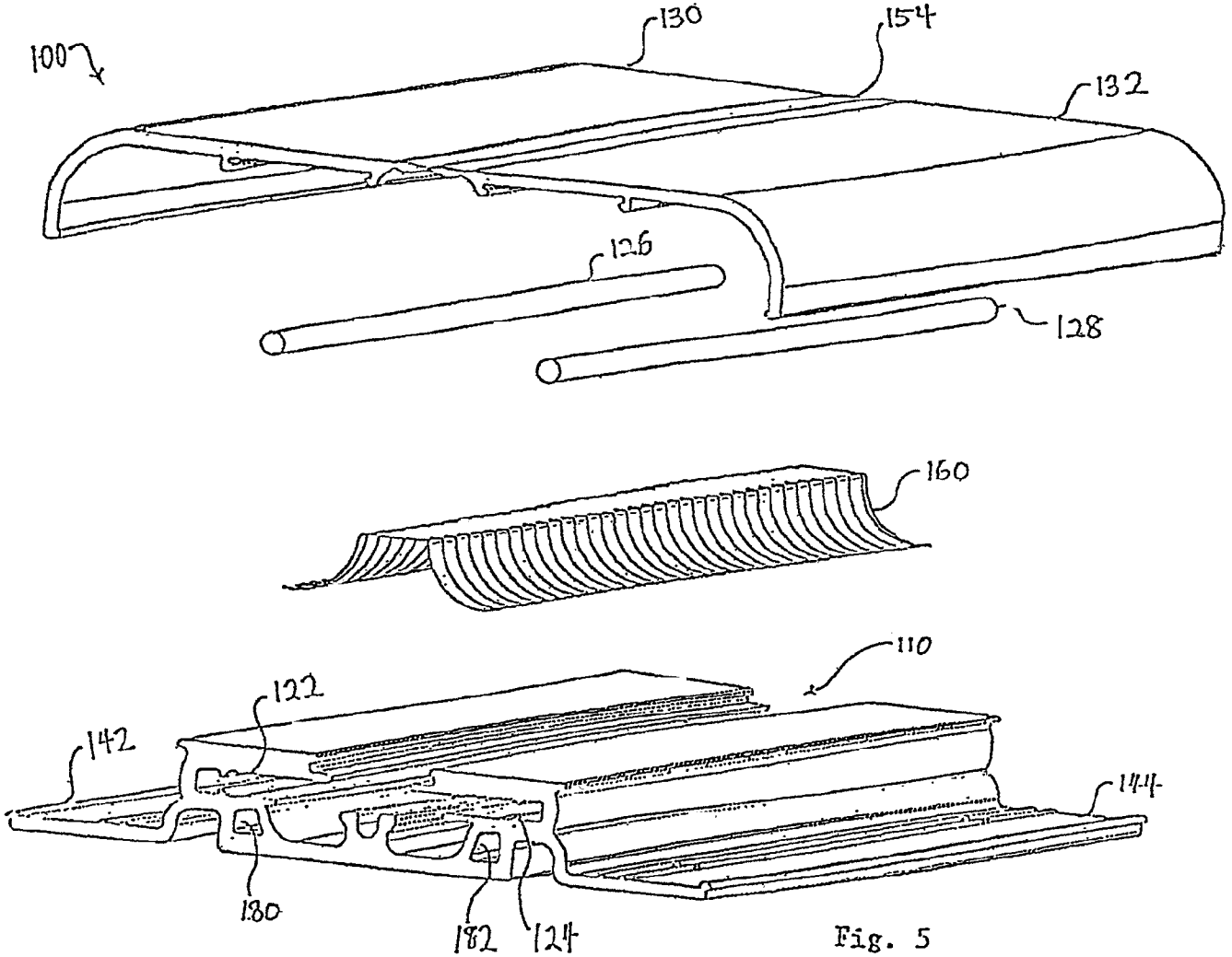
FIG. 5 is an exploded perspective view of part of the track section of FIG. 2.

Although it is preferred to have the conductive member 5100 resiliently supported by a support member 5200, this is not absolutely necessary since the earth spring 160 of FIG. 5 can be modularised such that the earth spring 160 is divided into individual conductive members with each member separately supported by a part of the conduit similar to that illustrated in FIG. 7*a*.

Instead of the mechanical switch 7000, other suitable forms of switches or delays such as an electrical or electronic delay are also envisaged to provide the necessary delay between the contact heads engaging the corresponding conductors and when the connection is made to allow electricity flow.

The switch 7000 can also be employed in other forms of power supply connectors suitable for use with an electrical power distribution apparatus to allow electricity flow automatically after contact heads of the connector are engaged with corresponding current carrying conductors. Thus, other forms of movement of the contact heads are also envisaged, not just rotational.

In the described embodiments, the clicking device 7030, 7030' is arranged to create a sound when the contact heads of the connector or plug are in the "disengage" position but it is also envisaged that the clicking device 7030,7030' can also be arranged to create a sound when contact heads are in the engaged position with the conductors.

The described embodiments of the track section may be particularly used as a fixed power distribution apparatus, with the combination of track sections and connectors as shown in FIG. 1 being connected to a suitable supporting surface, such as a wall or movable partition or furniture item. However, the described embodiments may also be used in a movable manner, for example as an extension cable, with a single track section being provided with two end connectors, one end connector being connected to a cable having a suitable plug at its free end, in the manner of a normal extension cable. One or more power point connectors may then be attached to the track section according to need.

The invention claimed is:

1. An electrical connector comprising first and second electrical contacts arranged to engage corresponding conductors of an electrical power supply distribution apparatus to provide a power inlet, the contacts being disposed at opposed ends of an arm rotatable between a first position in which the contacts are arranged to disengage from the conductors and a second position in which the contacts are arranged to engage with the conductors, a connection member arranged to provide a power outlet; and a switching device operable to connect or disconnect one of the contacts to the connection member in response to the rotation of the arm.

2. An electrical connector according to claim 1, further comprising an actuating member rotatable in response to the rotation of the arm for actuating the switching device to connect or disconnect said contact to the connection member.

3. An electrical connector according to claim 2, wherein the actuating member is arranged to actuate the switching device to connect said contact to the connection member after the arm is rotated to the second position.

4. An electrical connector according to claim 2, wherein the actuating member is arranged to actuate the switching device to disconnect said contact from the connection member before the arm is rotated to the first position.

5. An electrical connector according to claim 1 , wherein the switching device comprises a lever movable between a first position in which the lever is arranged to electrically disconnect the contact from the connection member, and a second position in which the lever is arranged to electrically connect the contact to the connection member.

6. An electrical connector according to claim 5, wherein the switching device further comprises means for moving the lever between the two positions, the moving means being actuated by the actuating member.

7. An electrical connector according to claim 6, wherein the moving means includes a plunger and a rocker arm connected to the plunger, the plunger being coupled to the lever and arranged to urge the lever between the two positions in response to the movement of the rocker arm, the rocker arm being arranged to be actuated by the actuating member.

8. An electrical connector according to claim 1, further comprising means for producing a sound when the arm is in the first position.

9. An electrical connector according to claim 1, further comprising means for producing a sound when the arm is in the second position.

10. An electrical connector according to claim 1, wherein the connection member is in the form of a female member arranged to receive a male member of an electrical plug.

11. An electrical connector according to claim 1, wherein the connection member is arranged to be connected to an electrical wire.

12. An electrical connector according to claim 1, wherein the contacts are disposed on two separate arms.

13. An electrical connector comprising first and second electrical contacts arranged to engage corresponding conductors of an electrical power supply distribution apparatus to provide a power inlet, the contacts being disposed at opposed ends of an arm rotatable between a first position in which the contacts are arranged to disengage from the conductors and a second position in which the contacts are arranged to engage with the conductors, a connection member arranged to provide a power outlet; and a switching device operable to connect one of the contacts to the connection member in response to the rotation of the arm and after the contact has engaged the corresponding conductors of the power distribution apparatus.

* * * * *